US007227522B2

(12) United States Patent
Fujimoto et al.

(10) Patent No.: US 7,227,522 B2
(45) Date of Patent: Jun. 5, 2007

(54) METHOD OF DRIVING A LIQUID CRYSTAL DISPLAY AND DRIVER CIRCUIT FOR DRIVING A LIQUID CRYSTAL DISPLAY

(75) Inventors: Kazushi Fujimoto, Tokyo (JP); Takahiro Takemoto, Tokyo (JP)

(73) Assignee: NEC Corporation, Tokyo (JP)

( * ) Notice: Subject to any disclaimer, the term of this patent is extended or adjusted under 35 U.S.C. 154(b) by 860 days.

(21) Appl. No.: 10/026,688

(22) Filed: Dec. 27, 2001

(65) Prior Publication Data

US 2002/0080107 A1 Jun. 27, 2002

(30) Foreign Application Priority Data

Dec. 27, 2000 (JP) ..... 2000-399460

(51) Int. Cl.
*G09G 3/36* (2006.01)
*G09G 5/00* (2006.01)

(52) U.S. Cl. ..... 345/87; 345/89; 345/98; 345/99; 345/213; 345/690

(58) Field of Classification Search ..... 345/87–100, 345/204–215, 690–699
See application file for complete search history.

(56) References Cited

U.S. PATENT DOCUMENTS 5,113,181 A * 5/1992 Inoue et al. ..... 345/84
5,504,522 A * 4/1996 Setogawa ..... 348/185
5,790,165 A * 8/1998 Kuboki et al. ..... 347/257
5,973,661 A * 10/1999 Kobayashi et al. ..... 345/100
6,097,234 A * 8/2000 Yeo ..... 327/295
6,515,679 B1 * 2/2003 Igarashi ..... 345/698
6,670,942 B1 * 12/2003 Van Asma et al. ..... 345/99

FOREIGN PATENT DOCUMENTS

JP 12-388920 A 12/2000

* cited by examiner

*Primary Examiner*—Vijay Shankar
(74) *Attorney, Agent, or Firm*—Sughrue Mion, PLLC

(57) ABSTRACT

A method of driving a liquid crystal display device includes: branching original image data having an original data rate into branched plural-systems image data comprising plural systems having a converted data rate that is equal to either said original data rate or a half of said original data rate; supplying a source driver circuit with said branched plural-systems image data in synchronization with at least one clock signal having a clock frequency that is a quarter of said original data rate; and allowing said source driver circuit to further branch said branched plural-systems image data into gray-scale voltage signals. Circuitry for driving the liquid crystal display device may include: a timing controller; a plurality of data bus lines; and a plurality of source driver circuits for incorporating said image data in synchronization with said at least one clock signal and converting said image data into gray-scale voltage signals.

24 Claims, 45 Drawing Sheets

| | | | | | | | | | | | | |
|---|---|---|---|---|---|---|---|---|---|---|---|---|
| A-port data | RA0 ~ RAx | R0 | R2 | R4 | R6 | R8 | ··· | R258 | R258 | R260 | R262 | ··· |
| | GA0 ~ GAx | G0 | G2 | G4 | G6 | G8 | ··· | G258 | G258 | G260 | G262 | ··· |
| | BA0 ~ BAx | B0 | B2 | B4 | B6 | B8 | ··· | B256 | B258 | B260 | B262 | ··· |
| B-port data | RB0 ~ RBx | R1 | R3 | R5 | R7 | R9 | ··· | R257 | R259 | R261 | R263 | ··· |
| | GB0 ~ GBx | G1 | G3 | G5 | G7 | G9 | ··· | G257 | G259 | G261 | G263 | ··· |
| | BB0 ~ BBx | B1 | B3 | B5 | B7 | B9 | ··· | B257 | B259 | B261 | B263 | ··· |
| C-port data | RC0 ~ RCx | R128 | R130 | R132 | R134 | R136 | ··· | R384 | R386 | R388 | R390 | ··· |
| | GC0 ~ GCx | G128 | G130 | G132 | G134 | G136 | ··· | G384 | G386 | G388 | G390 | ··· |
| | BC0 ~ BCx | B128 | B130 | B132 | B134 | B136 | ··· | B384 | B386 | B388 | B390 | ··· |
| D-port data | RD0 ~ RDx | R128 | R131 | R133 | R135 | R137 | ··· | R385 | R387 | R389 | R391 | ··· |
| | GD0 ~ GDx | G129 | G131 | G133 | G135 | G137 | ··· | G385 | G387 | G389 | G391 | ··· |
| | BD0 ~ BDx | B129 | B131 | B133 | B135 | B137 | ··· | B385 | B387 | B389 | B391 | ··· |

| | | | | | | | | | | | | |
|---|---|---|---|---|---|---|---|---|---|---|---|---|
| A-port | RA0 ~ RAx | R0 | R2 | R4 | R6 | R8 | --- | R256 | R258 | R260 | R262 | --- |
| | GA0 ~ GAx | G0 | G2 | G4 | G6 | G8 | --- | G256 | G258 | G260 | G262 | --- |
| | BA0 ~ BAx | B0 | B2 | B4 | B6 | B8 | --- | B256 | B258 | B260 | B262 | --- |
| B-port | RB0 ~ RBx | R1 | R3 | R5 | R7 | R9 | --- | R257 | R259 | R261 | R263 | --- |
| | GB0 ~ GBx | G1 | G3 | G5 | G7 | G9 | --- | G257 | G259 | G261 | G263 | --- |
| | BB0 ~ BBx | B1 | B3 | B5 | B7 | B9 | --- | B257 | B259 | B261 | B263 | --- |
| C-port | RC0 ~ RCx | R128 | R130 | R132 | R134 | R136 | --- | R384 | R386 | R388 | R390 | --- |
| | GC0 ~ GCx | G128 | G130 | G132 | G134 | G136 | --- | G384 | G386 | G388 | G390 | --- |
| | BC0 ~ BCx | B128 | B130 | B132 | B134 | B136 | --- | B384 | B386 | B388 | B390 | --- |
| D-port | RD0 ~ RDx | R129 | R131 | R133 | R135 | R137 | --- | R385 | R387 | R389 | R391 | --- |
| | GD0 ~ GDx | G129 | G131 | G133 | G135 | G137 | --- | G385 | G387 | G389 | G391 | --- |
| | BD0 ~ BDx | B129 | B131 | B133 | B135 | B137 | --- | B385 | B387 | B389 | B391 | --- |

FIG. 37

| n | 1 | 2 | 3 | 4 | 5 | ..... | 22 | 23 | 24 |
|---|---|---|---|---|---|---|---|---|---|
| dan | H | H | L | H | H | ..... | H | H | H |
| dcn | H | L | H | L | L | ..... | H | L | H |
| An | L | H | H | H | H | ..... | L | H | L |

FIG. 38A

| n | 1 | 2 | 3 | 4 | 5 | 6 | 7 | 8 | 9 | 10 | 11 | 12 | 13 | 14 | 15 | 16 | 17 | 18 | 19 | 20 | 21 | 22 | 23 | 24 |
|---|---|---|---|---|---|---|---|---|---|---|---|---|---|---|---|---|---|---|---|---|---|---|---|---|
| Xn | L | L | L | L | L | L | L | L | L | L | L | L | L | L | L | L | L | L | L | L | L | L | L | L |
| Yn | H | H | H | H | H | H | H | L | L | L | L | L | H | H | H | H | H | L | L | L | L | L | L | L |
| Zn | H | H | H | H | H | H | H | L | L | L | L | L | H | H | H | H | H | L | L | L | L | L | L | L |

FIG. 38B

| n | 1 | 2 | 3 | 4 | 5 | 6 | 7 | 8 | 9 | 10 | 11 | 12 | 13 | 14 | 15 | 16 | 17 | 18 | 19 | 20 | 21 | 22 | 23 | 24 |
|---|---|---|---|---|---|---|---|---|---|---|---|---|---|---|---|---|---|---|---|---|---|---|---|---|
| Xn | L | L | L | L | L | L | L | L | L | L | L | L | L | L | L | L | L | L | L | L | L | L | L | L |
| Yn | H | H | H | H | H | H | H | L | L | L | L | L | H | H | H | H | H | L | L | L | L | L | L | L |
| Zn | L | L | L | L | L | L | L | H | H | H | H | H | H | H | H | H | H | L | L | L | L | L | L | L |

FIG. 38C

| n | 1 | 2 | 3 | 4 | 5 | 6 | 7 | 8 | 9 | 10 | 11 | 12 | 13 | 14 | 15 | 16 | 17 | 18 | 19 | 20 | 21 | 22 | 23 | 24 |
|---|---|---|---|---|---|---|---|---|---|---|---|---|---|---|---|---|---|---|---|---|---|---|---|---|
| Xn | L | L | L | L | L | L | L | L | L | L | L | L | L | L | L | L | L | L | L | L | L | L | L | L |
| Yn | H | H | H | H | H | H | H | H | L | L | L | L | H | H | H | H | L | L | L | L | L | L | L | L |
| Zn | L | L | L | L | L | L | L | L | H | H | H | H | H | H | H | H | L | L | L | L | L | L | L | L |

FIG. 38D

| n | 1 | 2 | 3 | 4 | 5 | 6 | 7 | 8 | 9 | 10 | 11 | 12 | 13 | 14 | 15 | 16 | 17 | 18 | 19 | 20 | 21 | 22 | 23 | 24 |
|---|---|---|---|---|---|---|---|---|---|---|---|---|---|---|---|---|---|---|---|---|---|---|---|---|
| Xn | L | L | L | L | L | L | L | L | L | L | L | L | L | L | L | L | L | L | L | L | L | L | L | L |
| Yn | H | H | H | H | H | H | H | H | H | L | L | L | H | H | H | L | L | L | L | L | L | L | L | L |
| Zn | L | L | L | L | L | L | L | L | L | H | H | H | H | H | H | L | L | L | L | L | L | L | L | L |

METHOD OF DRIVING A LIQUID CRYSTAL DISPLAY AND DRIVER CIRCUIT FOR DRIVING A LIQUID CRYSTAL DISPLAY

BACKGROUND OF THE INVENTION

1. Field of the Invention

The present invention relates to a method of driving a liquid crystal display device and a driver circuit for driving a liquid crystal display device, and more particularly to a method of driving a liquid crystal display device and a driver circuit for driving a liquid crystal display device for an ultra-high fine and multi-gray scale display with reducing an electro-magnetic interference.

2. Description of the Related Art

A liquid crystal display has a liquid crystal panel including an array of pixels, each of which includes a pixel electrode and a switching transistor. The switching transistor comprises a thin film transistor. A voltage having a corresponding voltage level to a gray scale is applied through the thin film transistor to the pixel electrode.

It would be important for the liquid crystal display to realize an ultra-high fine display and an increased high speed driving performance of the liquid crystal panel with an increased number of the pixels and an increased area of a display screen.

FIG. 1 is a block diagram illustrative of a first conventional driver circuit for driving a liquid crystal display. The liquid crystal display includes a display panel 50 and a driver circuit having the following circuit configuration.

The display panel 50 has an array of pixels, each of which includes a pixel electrode and a thin film transistor. The thin film transistor has a gate electrode connected to a gate signal line 501, a source electrode connected to a source signal line 502 and a drain electrode connected to the pixel electrode. The display panel 50 also has a plurality of gate signal lines 501 extending in a row direction and a plurality of source signal lines 502 extending in a column direction.

The driver circuit includes a row alignment of plural source drivers 30 and a column alignment of plural gate drivers 40. The number of the source drivers 30 is "N", whilst the number of the gate drivers 40 is "M". Each of the source drivers 30 is connected to a plurality of the source signal lines 502 for driving the source signal lines 502. Each of the gate drivers 40 is connected to a plurality of the gate signal lines 501 for driving the gate signal lines 501.

The driver circuit farther includes a graphic controller 11, a transmitter 12 and an interface board 20. On the interface board 20, a receiver unit 201, a display control unit 202 and a power supply circuit 203 are provided. The graphic controller 11 outputs control signals and image data which are then transmitted through the transmitter 12 to the receiver unit 201. The control signals include timing control signals. The timing control signals may for example, be a clock signal, a horizontal synchronous signal, and a vertical synchronous signal.

The receiver unit 201 receives the timing control signals and the image data from the graphic controller 11. The timing control signals and the image data are then supplied to the display control unit 202. The display control unit 202 generates a gate driver clock signal, a frame start signal, a source driver clock signal and a start signal based on the timing control signals as well as generates image signals based on the image data. The gate driver clock signal and the frame start signal are supplied to the gate drivers 40. The source driver clock signal and the start signal are supplied to the source drivers 30.

The power supply circuit 203 generates powers supplied to the source drivers 30, another power supplied to a common electrode of the display panel 50 and still another power supplied to the gate driver.

The image data and the timing control signals are supplied in parallel-transmission from the graphic controller 11 to the transmitter 12. The transmitter 12 performs a parallel-to-serial conversion of the image data and the timing control signals, so that the image data and the timing control signals are supplied in serial-transmission from the transmitter 12 to the receiver unit 201. The serial data including the image data and the timing control signals may be transmitted in any available transmission system such as a low voltage differential signaling (LVDS), a transmission minimized differential signaling (TMDS), a gigabit video interface (GVIF) and a low voltage differential signaling display interface (LDI).

The receiver unit 201 performs a serial-to-parallel conversion of the image data and the timing control signals, so that the image data and the timing control signals are supplied in parallel-transmission from the receiver unit 201 to the display control unit 202.

Each of the source drivers 30 accepts an input of the image data or incorporates the image data based on the start signal and in synchronization with the source driver clock signal, and then each source driver 30 converts the image data into corresponding voltage levels to the image data for applying the source signal lines 502 with respective gray-scale voltage signals having the corresponding voltage levels, so that the voltage signals are transmitted through the source signal lines 502 and the thin film transistors to the pixel electrodes.

Each of the gate drivers 40 drives the gate signal lines 501 sequentially one-by-one based on the frame start signal and in synchronization with the gate driver clock signal. The thin film transistors connected to the gate signal line 501 on the selection are placed to allow the gray-scale voltage signals to be transmitted from the source signal lines 502 through the thin film transistors to the pixel electrodes.

There were proposed following plural conventional methods of display controls in timing of supply of the image data and the source driver clock signals to the source drivers 30 and also in timing of accepting the inputs of the image data into the source drivers 30.

FIG. 2 is a fragmentary block diagram illustrative of a first conventional circuit configuration including a timing controller and source drivers, wherein the circuit configuration is included in the circuit configuration of FIG. 1. FIG. 3 is a view illustrative of contents of image data to be supplied in synchronization with a clock signal from the timing controller to the source drivers 30 in FIG. 2.

The display control unit 202 includes a timing controller 202A shown in FIG. 2. The timing controller 202A has a clock port "clock signal", from which the source driver clock signal is supplied to the source drivers 30. The timing controller 202A also has a first data port "A-port", from which odd-number image data for the pixels of odd numbers is supplied to the source drivers 30. The timing controller 202A also has a second data port "B-port", from which even-number image data for the pixels of even numbers is supplied to the source drivers 30. The odd-number image data may be referred to as "A-port image data" and the even-number image data may be referred to as "B-port image data".

As shown in FIG. 3, the image data includes red-color data of 8-bits, green-color data of 8-bits, and blue-color data of 8-bits. For the 8-bits data, eight signal lines are provided.

The image data is isolated into the odd-number image data and the even-number image data. Namely, each of the red-color green-color, and blue-color data is isolated into the odd-number image data or the even-number image data. The odd-number image data (or A-port image data) comprises plural sets of the red-color, green-color, and blue-color data for the odd-number pixels. The even-number image data (or B-port image data) comprises plural sets of the red-color, green-color, and blue-color data for the even-number pixels.

The timing controller 202A generates a clock signal "clock signal" having the same cyclic frequency as a data rate of the above image data. The image data and the clock signal are supplied from the timing controller 202-A to the source drivers 30, so that each of the source drivers 30 incorporates the image data at a timing of a rising edge timing of the clock signal for generating corresponding gray-scale voltages to the image data, whereby each of the source drivers 30 applies the gray-scale voltages onto the source signal lines 502. The above A-port data, the B-port data, and the clock signal are common signals to all of the source drivers 30.

FIG. 4 is a fragmentary block diagram illustrative of a second conventional circuit configuration including a timing controller and source drivers, wherein the circuit configuration is included in the circuit configuration of FIG. 1. FIG. 5 is a view illustrative of contents of image data to be supplied in synchronization with a clock signal from the timing controller to the source drivers in FIG. 4.

The display control unit 202 includes a timing controller 202B shown in FIG. 4. The timing controller 202B has a clock port "clock signal", from which the source driver clock signal is supplied to all of the source drivers 3B1, 3B2, 3B3, 3B4, - - - . The timing controller 202B also has a first data port "A-port", from which A-port image data is supplied to the source drivers 3B1, 3B3, - - - . The timing controller 202B also has a second data port "B-port", from which B-port image data is supplied to the source drivers 3B1, 3B3, - - - . The timing controller 202B also has a third data port "C-port", from which C-port image data is supplied to the source drivers 3B2, 3B4, - - - . The timing controller 202B also has a fourth data port "D-port", from which D-port image data is supplied to the source drivers 3B2, 3B4, - - - .

The timing controller 202B generates a clock signal "clock signal" having the same cyclic frequency as a data rate of the above image data. The timing controller 202B also generates the A-port data, the B-port data, the C-port data, and the D-port data, wherein the image data comprises plural sets of four-data units. First two-data units are divided into the even numbers and the odd numbers as the A-port data and the B-port data. Second two-data units are divided into the even numbers and the odd numbers as the C-port data and the D-port data.

The image data and the clock signal are supplied from the timing controller 202B to the source drivers 3B1, 3B2, 3B3, 3B4, - - - , so that each of the source drivers 3B1, 3B2, 3B3, 3B4, - - - incorporates the image data at a timing of a rising edge timing of the clock signal for generating corresponding gray-scale voltages to the image data, whereby each of the source drivers 3B1, 3B2, 3B3, 3B4, - - - applies the gray-scale voltages onto the source signal lines 502. The clock signal is a common signal to all of the source drivers 3B1, 3B2, 3B3, 3B4, - - - .

FIG. 6 is a fragmentary block diagram illustrative of a third conventional circuit configuration including a timing controller and source drivers, wherein the circuit configuration is included in the circuit configuration of FIG. 1. FIG. 7 is a view illustrative of contents of image data to be supplied in synchronization with a clock signal from the timing controller to the source drivers in FIG. 6.

The display control unit 202 includes a timing controller 202C shown in FIG. 6. The timing controller 202C has a first clock port "clock signal 1", from which a first source driver clock signal is supplied to odd-number source drivers 3B1, 3B3, - - - . The timing controller 202C has a second clock port "clock signal 2", from which a second source driver clock signal is supplied to even-number source drivers 3B2, 3B4, - - - . The second source driver clock signal is delayed by a half cycle from the first source driver clock signal, so that the second source driver clock signal is opposite in phase to the first source driver clock signal.

The timing controller 202C also has a first data port "A-port", from which A-port image data is supplied to the source drivers 3B1, 3B3, - - - . The timing controller 202C also has a second data port "B-port", from which B-port image data is supplied to the source drivers 3B1, 3B3, - - - . The timing controller 202C also has a third data port "C-port", from which C-port image data is supplied to the source drivers 3B2, 3B4, - - - . The timing controller 202C also has a fourth data port "D-port", from which D-port image data is supplied to the source drivers 3B2, 3B4, - - - .

As described above, the image data are isolated into four-system image data, for example, the A-port image data, the B-port image data, the C-port image data and the D-port image data. The A-port image data and the B-port image data are supplied to odd number source drivers 3B1, 3B3, - - - on odd number stages. The C-port image data and the D-port image data are supplied to even number source drivers 3B2, 3B4, - - - on even number stages. The C-port image data and the D-port image data are different in phase by a half data cycle from the A-port image data and the B-port image data.

As shown in FIG. 7, the four system image data include first odd-and-even two system image data for the adjacent two source drivers 3B1 and 3B2 and second odd-and-even two system image data for the following adjacent two source drivers 3B3 and 3B4 on the follower stages to the source drivers 3B1 and 3B2.

The timing controller 202C generates the first and second clock signals "clock signal 1" and "clock signal 2" having the same cyclic frequency as a data rate of the above image data but different in phase by a half cycle from each other, wherein the first clock signal "clock signal 1" is supplied to the odd number source drivers 3B1, 3B3, - - - , whilst the second clock signal "clock signal 2" is supplied to the even number source drivers 3B2, 3B4, - - - . The timing controller 202C also generates the A-port data, the B-port data, the C-port data, and the D-port data, wherein the image data comprises plural sets of four-data units. First two-data units are divided into the even numbers and the odd numbers as the A-port data and the B-port data. Second two-data units are divided into the even numbers and the odd numbers as the C-port data and the D-port data, which are delayed by a half cycle from the A-port data and the B-port data.

The image data and the clock signal are supplied from the timing controller 202C to the source drivers 3B1, 3B2, 3B3, 3B4, - - - . Each of the odd-number source drivers 3B1, 3B3, - - - incorporates the image data at a timing of a rising edge timing of the first clock signal "clock signal 1" for generating corresponding gray-scale voltages to the image data, whereby each of the odd-number source drivers 3B1, 3B3, - - - applies the gray-scale voltages onto the source signal lines 502. Each of the even-number source drivers 3B2, 3B4, - - - incorporates the image data at a half-cycle-delayed timing of the rising edge timing of the second clock signal "clock signal 2" for generating corresponding gray-scale voltages to the image data, whereby each of the even-number source drivers 3B2, 3B4, - - - applies the gray-scale voltages onto the source signal lines 502.

FIG. 8 is a fragmentary block diagram illustrative of a fourth conventional circuit configuration including a timing controller and source drivers, wherein the circuit configuration is included in the circuit configuration of FIG. 1. FIG. 9 is a view illustrative of contents of image data to be supplied in synchronization with a clock signal from the timing controller to the source drivers in FIG. 8. This fourth conventional circuit configuration is disclosed in Japanese laid-open patent publication No. 10-340070. A frequency of the clock signal can be reduced without increasing the width of the data bus for transmitting the image data.

The display control unit 202 includes a timing controller 202D shown in FIG. 8. The timing controller 202D has a first clock port "clock signal 1", from which a first source driver clock signal is supplied to odd-number source drivers 3B1, 3B3, - - - . The timing controller 202D has a second clock port "clock signal 2", from which a second source driver clock signal is supplied to even-number source drivers 3B2, 3B4, - - - . The second source driver clock signal is delayed by a half cycle from the first source driver clock signal, so that the second source driver clock signal is opposite in phase to the first source driver clock signal.

The timing controller 202D also has a first data port "A-port", from which A-port image data is supplied to all of the source drivers 3B1, 3B2, 3B3, 3B4, - - - . The timing controller 202D also has a second data port "B-port", from which B-port image data is supplied to all of the source drivers 3B1, 3B2, 3B3, 3B4, - - - .

As described above, the image data is isolated into two-data systems, for example, odd number data and even number data. The timing controller 202D generates the first and second clock signals "clock signal 1" and "clock signal 2" having the same cyclic frequency as a data rate of the above image data but different in phase by a half cycle from each other, wherein the first clock signal "clock signal 1" is supplied to the odd-number source drivers 3B1, 3B3, - - - , whilst the second clock signal "clock signal 2" is supplied to the even-number source drivers 3B2, 3B4, - - - . The first and second clock signals "clock signal 1" and "clock signal 2" have a cyclic frequency corresponding to a half of the data rate of the image data. The timing controller 202D also generates the A-port data and the B-port data.

The image data and the clock signal are supplied from the timing controller 202D to the source drivers 3B1, 3B2, 3B3, 3B4, - - - . Each of the odd-number source drivers 3B1, 3B3, - - - incorporates the image data at a timing of a rising edge timing of the first clock signal "clock signal 1" for generating corresponding gray-scale voltages to the image data, whereby each of the odd-number source drivers 3B1, 3B3, - - - applies the gray-scale voltages onto the source signal lines 502. Each of the even-number source drivers 3B2, 3B4, - - - incorporates the image data at a half-cycle-delayed timing of the rising edge timing of the second clock signal "clock signal 2" for generating corresponding gray-scale voltages to the image data, whereby each of the even-number source drivers 3B2, 3B4, - - - applies the gray-scale voltages onto the source signal lines 502.

In accordance with the fourth conventional method, the image data for the adjacent two source drivers 3B1 and 3B2 are isolated into two systems, for example, even number data and odd number data, and also the image data for the follower two source drivers 3B3 and 3B4 following to the adjacent two source drivers 3B1 and 3B2 are also isolated into two systems, for example, even number data and odd number data. The odd and even numbers data are subjected to a time-division multiplexing to form the A-port data and the B-port data.

In accordance with the above conventional methods, the data rate is defined by the width of each box indicating the content of the image data, for example, R0, G0, and B0 shown in FIGS. 3, 5, 7 and 9. The cyclic frequency of the clock signal is defined by the waveform shown in FIGS. 3, 5, 7 and 9.

The first, second and third conventional methods have the following disadvantages. As shown in FIGS. 3, 5 and 7, the cyclic frequency of the clock signal is equal to the data rate of the image data. This means that the frequency of transition in voltage level of the clock signal is higher by two times than the data rate of the image data. The improvement in the high definition and the increase in the area of the display panel would cause the increase of the image data for each source line, whereby the frequency of the clock signal is thus increased. The increase in the frequency of the clock signal would raise a problem with the electromagnetic interference. Namely, the characteristic in the electromagnetic interference of the liquid crystal display device is deteriorated.

In order to avoid the deterioration in the characteristic in the electromagnetic interference of the liquid crystal display device, it is effective to reduce the frequency of the clock signal. For the reasons described above, it is, however, difficult for the first, second and third conventional methods to respond to the requirement for increase of the image data for each source line without increase in the frequency of the clock signal. Namely, it would be difficult to satisfy both requirements for the increase of the image data and for avoiding the problem with the electromagnetic interference.

On the other hand, the above described fourth conventional method utilizes the clock signal having the cyclic frequency which is a half of the data rate as shown in FIG. 9. This fourth conventional method is suitable for reducing the frequency of the clock signal and for avoiding the problem with the electromagnetic interference.

The fourth conventional method is to reduce the frequency of the clock signal without increase in the width or the number of the data bus, for which reason it is difficult to realize a desirable high speed data processing or data transmission. This means it difficult to realize a desirable improvement in high definition and a desirable increase in size of the display screen of the liquid crystal display panel. The two system image data make it more difficult to realize the desirable improvement in high definition and the desirable increase in size of the display screen of the liquid crystal display panel.

The but lines for transferring the image data are provided for the primary three colors, for example, red, green and blue separately. This increases the total number of the necessary bus lines for transferring the image data, and also increases the times of changing the voltage levels or the bit values of the bus lines. This emphasizes the problem with the electromagnetic interference.

The electromagnetic interference provides the undesirable influence to operations of peripheral electric, electronic or electron devices. The provision of any counter-measure tool against the electromagnetic interference increases the cost. Further, it is difficult to distinguish an electromagnetic noise radiated from the bus line from other electromagnetic noises.

The above conventional methods are also engaged with a further problem with the cross-talk noise which may cause data error.

In the above circumstances, the developments of a novel method of driving a liquid crystal display device and of a novel driver circuit for driving a liquid crystal display device free from the above problems is desirable.

SUMMARY OF THE INVENTION

Accordingly, it is an object of the present invention to provide a novel method of driving a liquid crystal display device free from the above problems.

It is a further object of the present invention to provide a novel method of driving a liquid crystal display device, which is capable of reducing a frequency of a clock signal used for transferring image data to a liquid crystal display panel.

It is a still further object of the present invention to provide a novel method of driving a liquid crystal display device, which is capable of reducing the number of time of transition in voltage level of bits of the image data in addition to the reduction in frequency of the clock signal used for transferring image data to the liquid crystal display panel, in order to suppress the electromagnetic interference as many as possible.

It is yet a further object of the present invention to provide a novel method of driving a liquid crystal display device, which is capable of both reducing a frequency of a clock signal used for transferring image data to a liquid crystal display panel and increasing the transfer rate of the image data to a liquid crystal display panel.

It is another object of the present invention to provide a novel driver circuit for driving a liquid crystal display device free from the above problems.

It is a further object of the present invention to provide a novel driver circuit for driving a liquid crystal display device, which is capable of reducing a frequency of a clock signal used for transferring image data to a liquid crystal display panel.

It is a still further object of the present invention to provide a novel driver circuit for driving a liquid crystal display device, which is capable of reducing the number of time of transition in voltage level of bits of the image data in addition to the reduction in frequency of the clock signal used for transferring image data to the liquid crystal display panel, in order to suppress the electromagnetic interference as many as possible.

It is yet a further object of the present invention to provide a novel driver circuit for driving a liquid crystal display device, which is capable of both reducing a frequency of a clock signal used for transferring image data to a liquid crystal display panel and increasing the transfer rate of the image data to a liquid crystal display panel.

The present invention provides a method of driving a liquid crystal display device having a plurality of bus lines for transmitting image data. The method comprises: branching original image data having an original data rate into branched plural-systems image data comprising plural systems having a converted data rate which is equal to either the original data rate or a half of the original data rate; supplying a source driver circuit with the branched plural-systems image data in synchronization with at least one clock signal having a clock frequency which is a quarter of the original data rate; and allowing the source driver to further branch the branched plural-systems image data into gray-scale voltage signals.

The present invention also provides a circuitry for driving a liquid crystal display device. The circuit comprises: a timing controller for generating image data and at least one clock signal; a plurality of data bus lines for transmitting the image data and at least one clock signal; and a plurality of source driver circuits for incorporating the image data in synchronization with the at least one clock signal and converting the image data into gray-scale voltage signals, wherein the timing controller includes: a branching unit for branching original image data having an original data rate into branched plural-systems image data comprising plural systems having a converted data rate which is equal to either the original data rate or a half of the original data rate.

The above and other objects, features and advantages of the present invention will be apparent from the following descriptions.

BRIEF DESCRIPTION OF THE DRAWINGS

Preferred embodiments according to the present invention will be described in detail with reference to the accompanying drawings.

Figure 25:
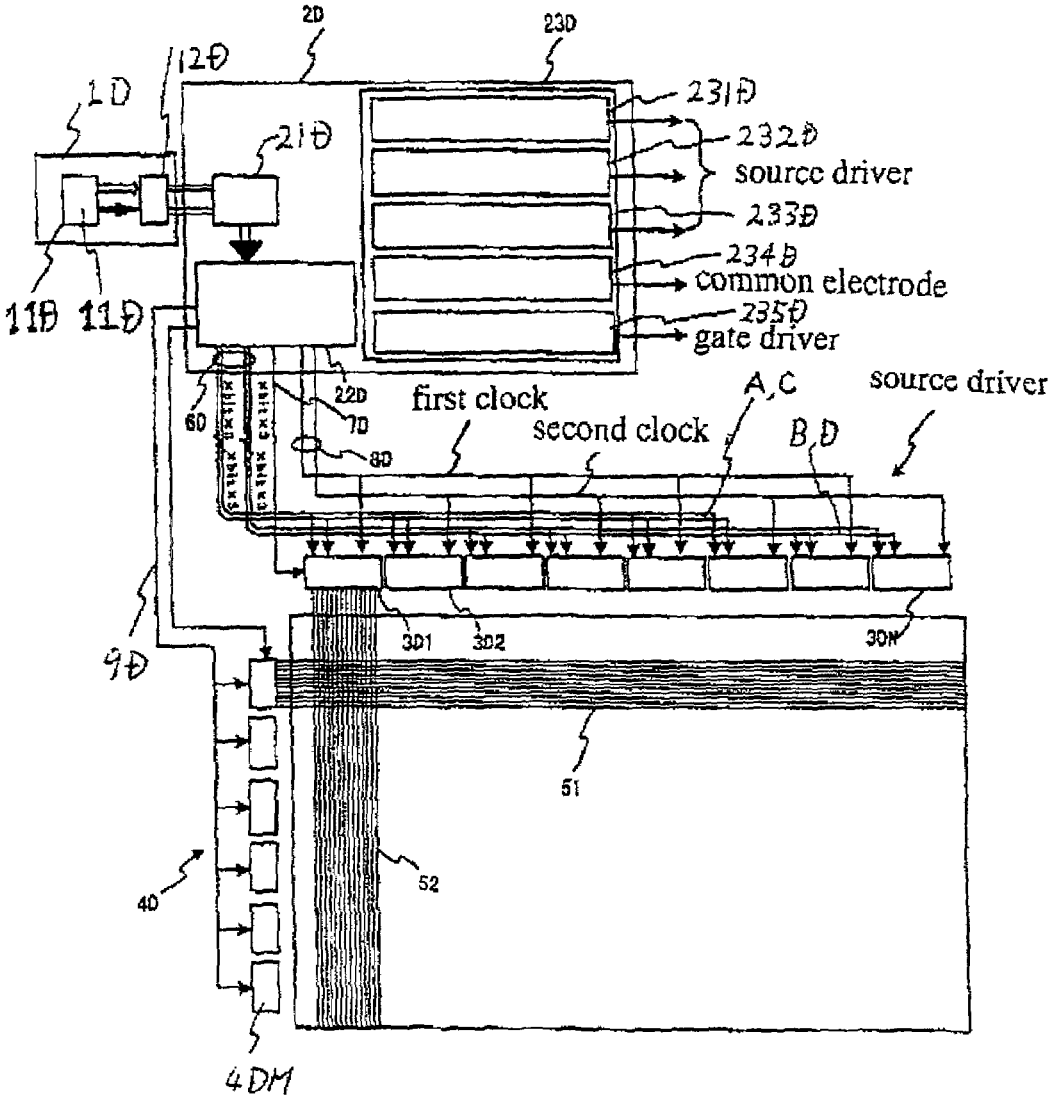
FIG. 25 is a block diagram illustrative of a novel driver circuit for driving a liquid crystal display in a fourth embodiment in accordance with the present invention.

PIG. 28 is a block diagram illustrative of an internal configuration of each of the source drivers shown in FIG. 25.

Figure 29:
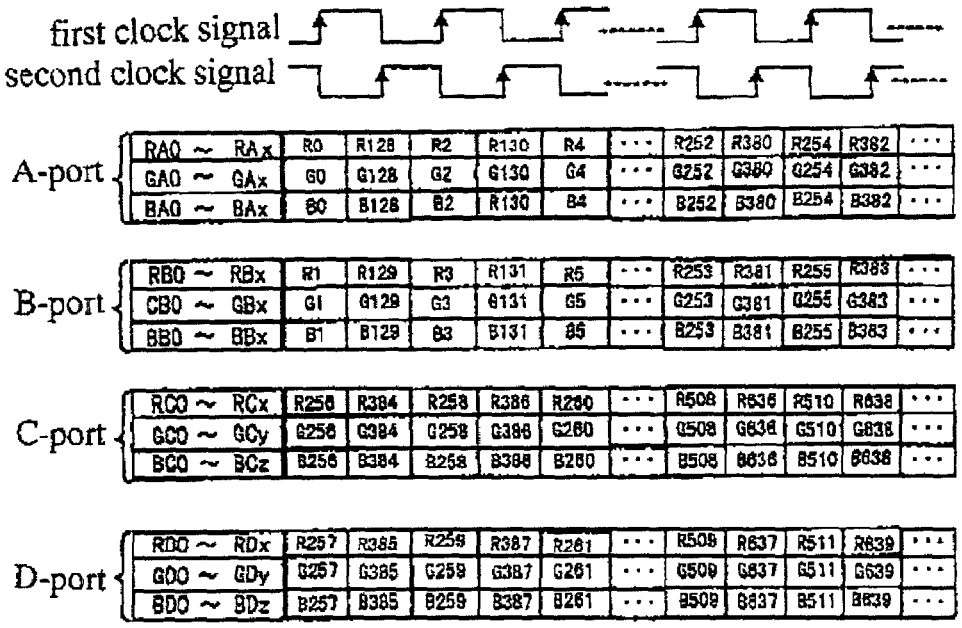

FIG. 29 is a timing chart showing first and second clock signals and A-port image data, B-port image data, C-port image data, and D-port image data, wherein the rising edges of the first and second clock signals arc used as trigger edges.

Figure 30:
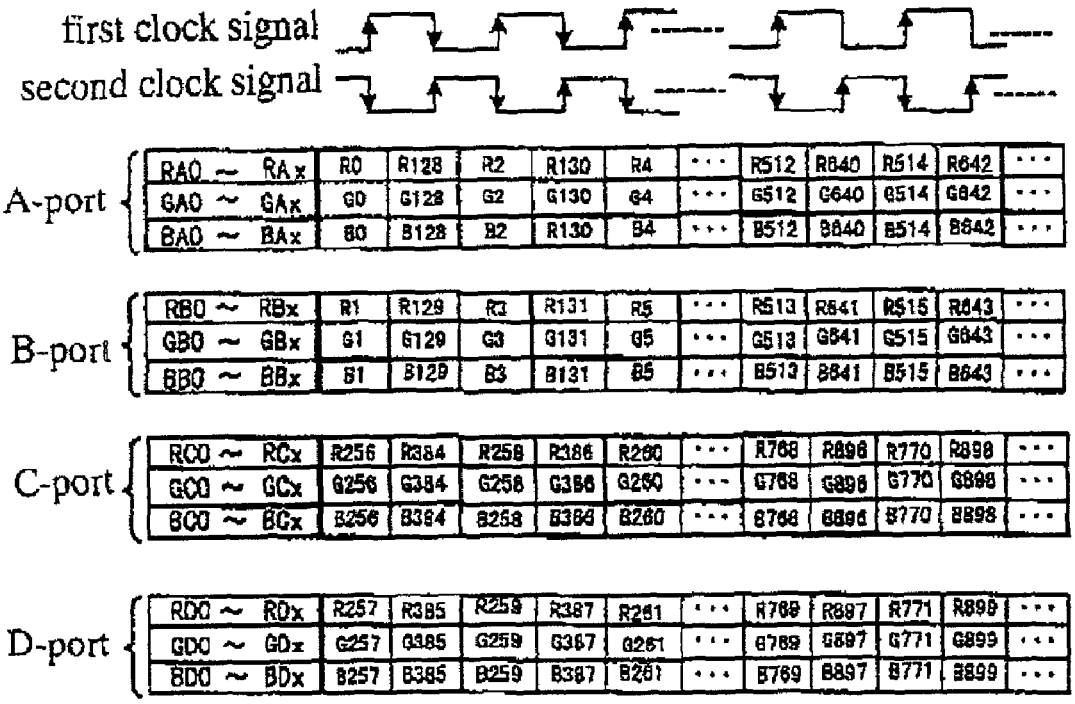

FIG. 30 is a timing chart showing first and second clock signals and A-port image data, B-port image data, C-port image data, and D-port image data, wherein the rising and falling edges of the first and second clock signals are used as trigger edges.

Figure 31:
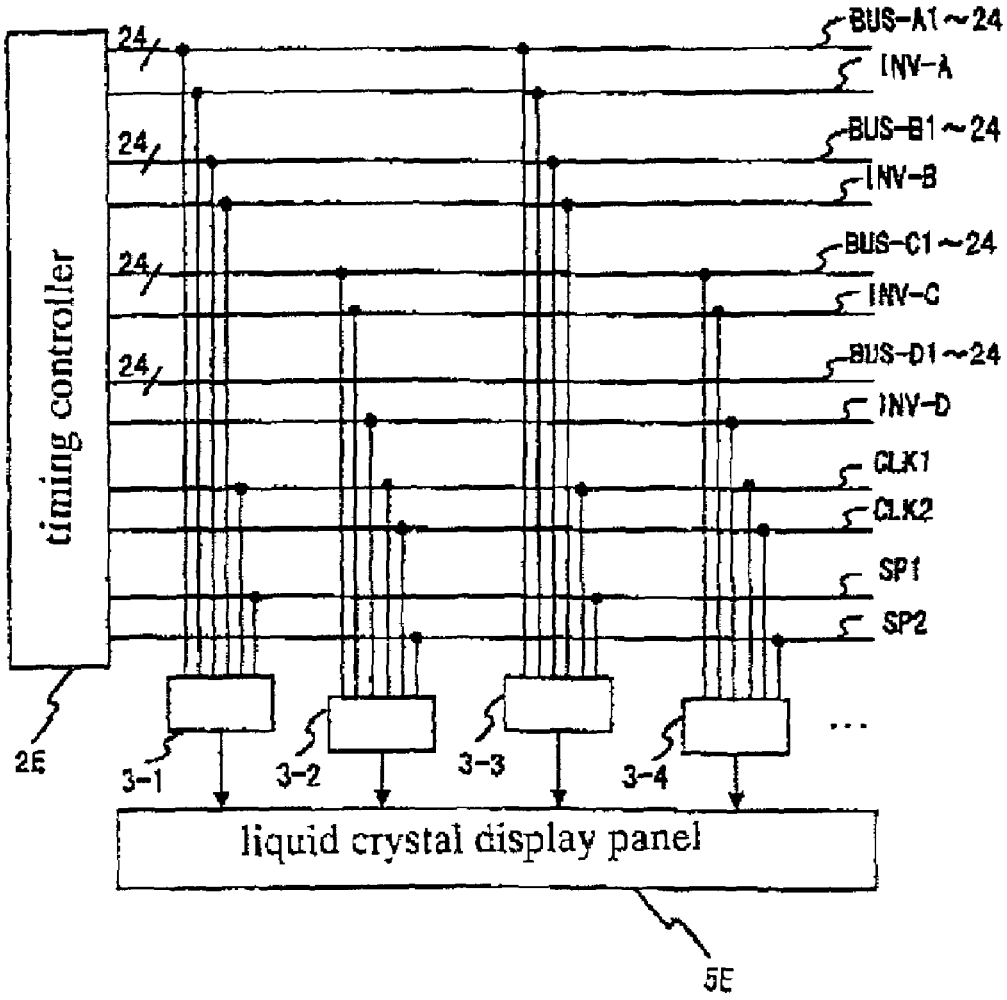

FIG. 31 is a block diagram illustrative of a schematic configuration of the driver circuit for the liquid crystal display in the fifth embodiment in accordance with the present invention.

Figure 32:
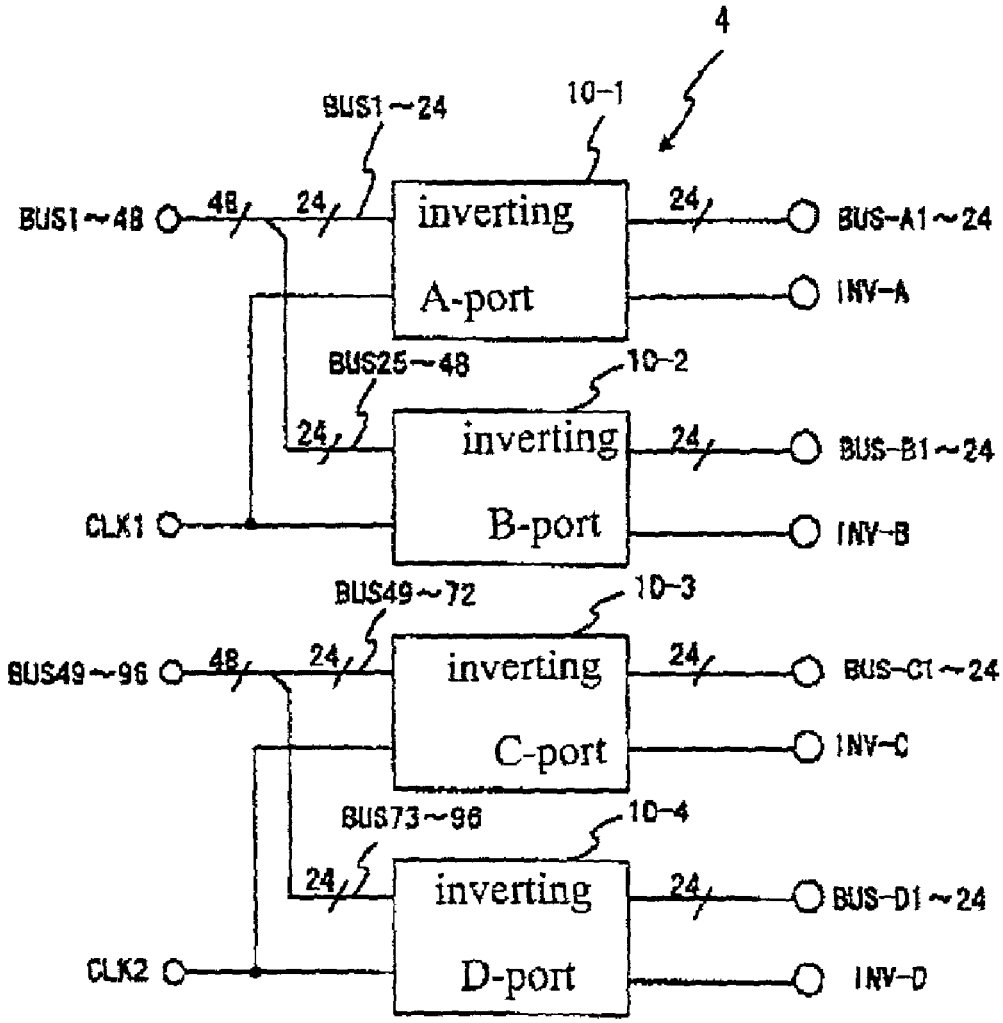

FIG. 32 is a block diagram illustrative of a structure of data output unit of the timing controller shown in FIG. 31.

Figure 33:
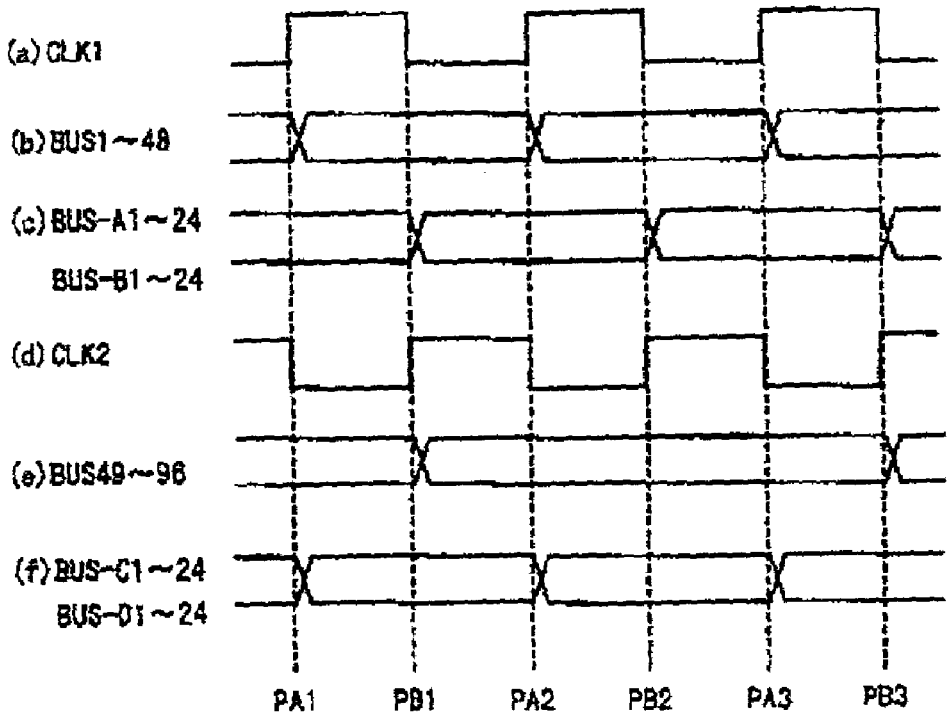

FIG. 33 is a timing chart illustrative of waveforms of the first and second clock signals CLK1 and CLK2, the bus data BUS1–48, the bus data BU49–96, the first bus data BUS-A1–A24, the second bus data BUS-B1–B24, the third bus data BUS-C1–C24, and the fourth bus data BUS-D1–D24.

Figure 34:
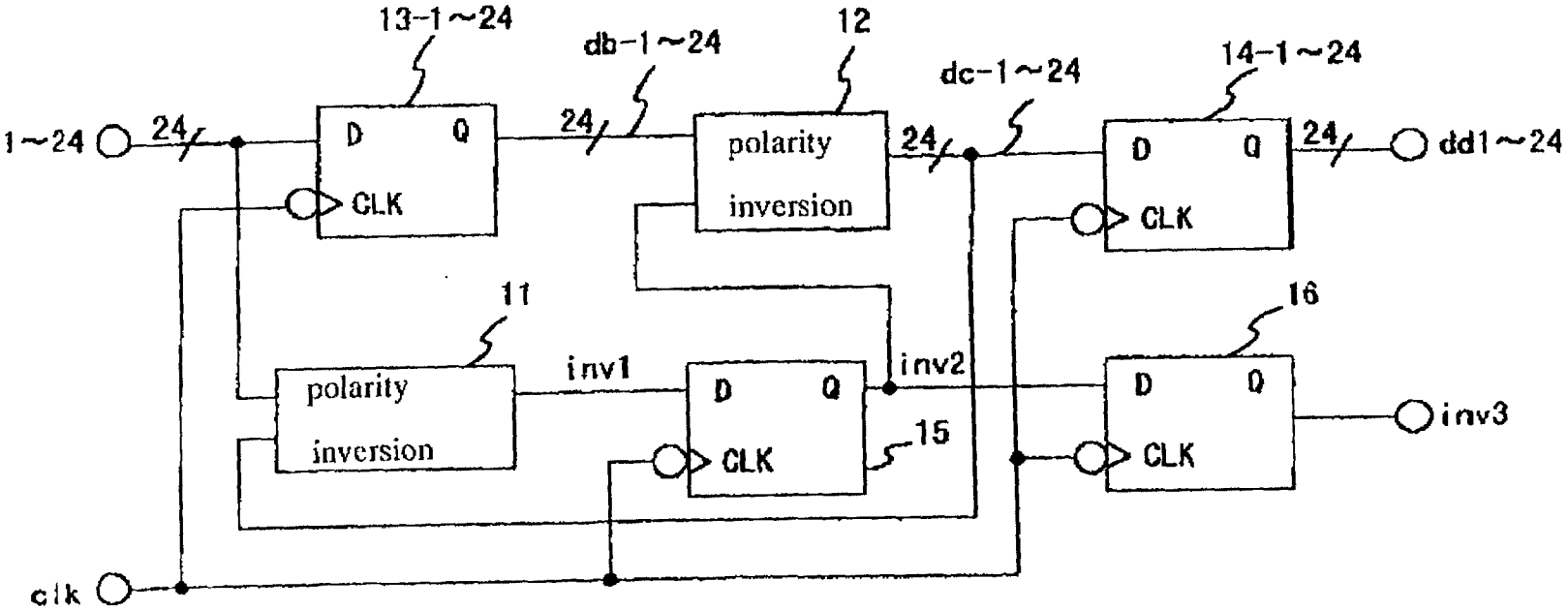

FIG. 34 is a block diagram illustrative of an example of the internal configuration of each of the data polarity inversion determination generation units shown in FIG. 32.

Figure 35:
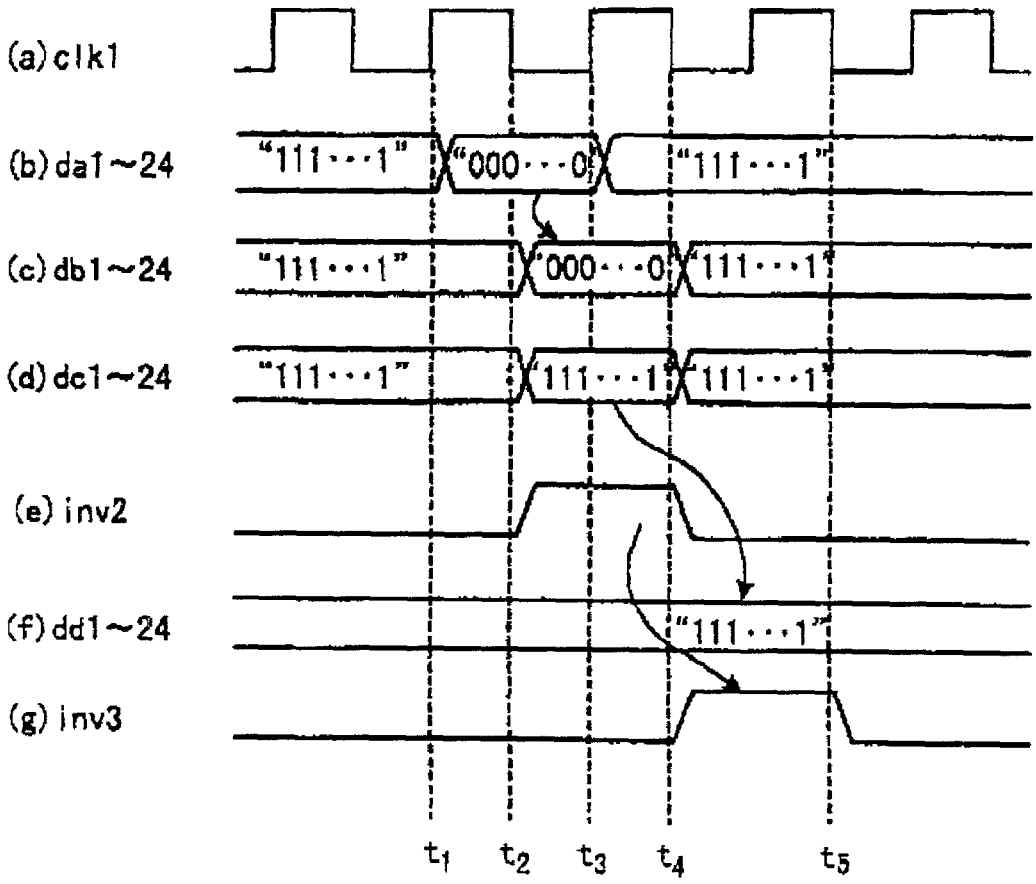

FIG. 35 is a timing chart illustrative of waveforms of the clock signal "clk", the data "da-1-24", the data "db-1-24", the data "dc-1-24" and the data "dd-1-24", and the data polarity inversion signals "inv2" and "inv3" shown in FIG. 34.

Figure 36:
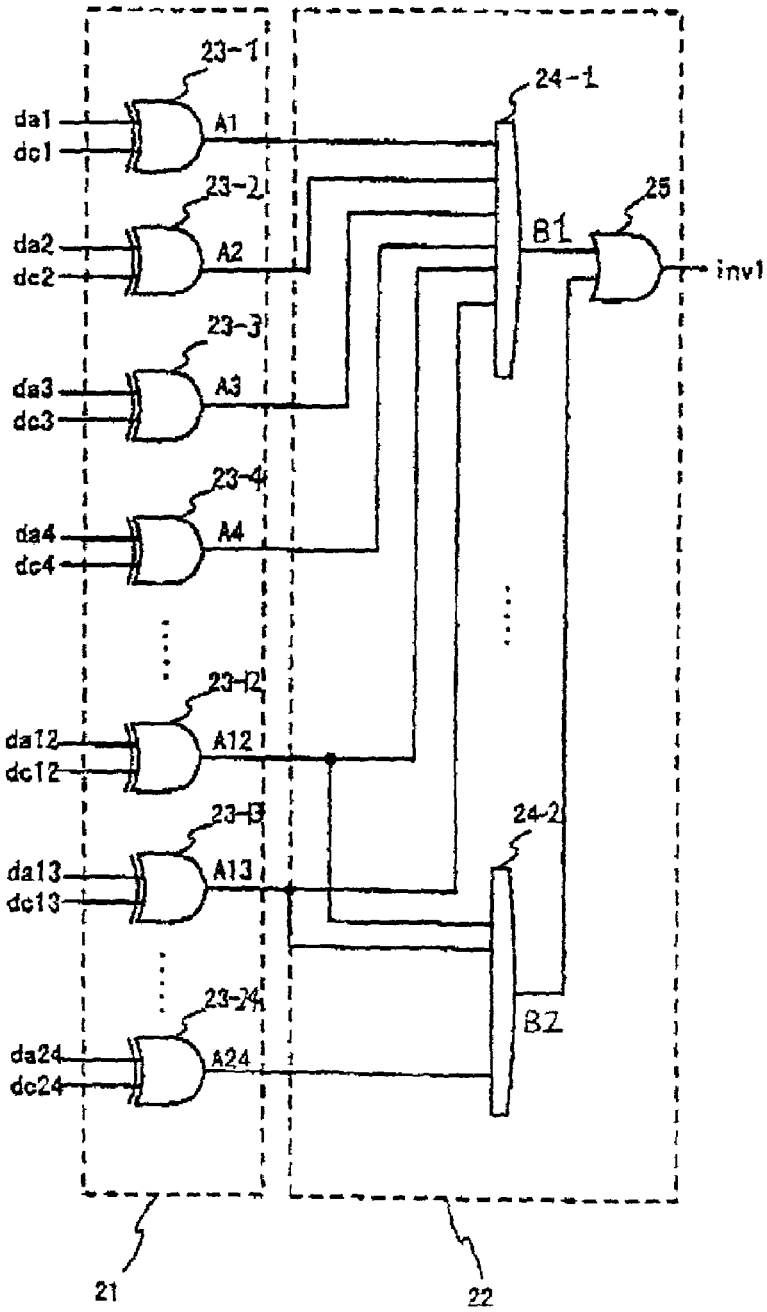

FIG. 36 is a circuit diagram illustrative of a first data polarity inversion determination circuit 11 shown in FIG. 35.

FIG. 37 is a table showing operations of the polarity variation detecting circuit 21 shown in FIG. 36.

FIGS. 38A through 38D are tables showing operations of the data output unit 4 of FIG. 32 provided in the timing controller 2E of FIG. 31.

Figure 39:
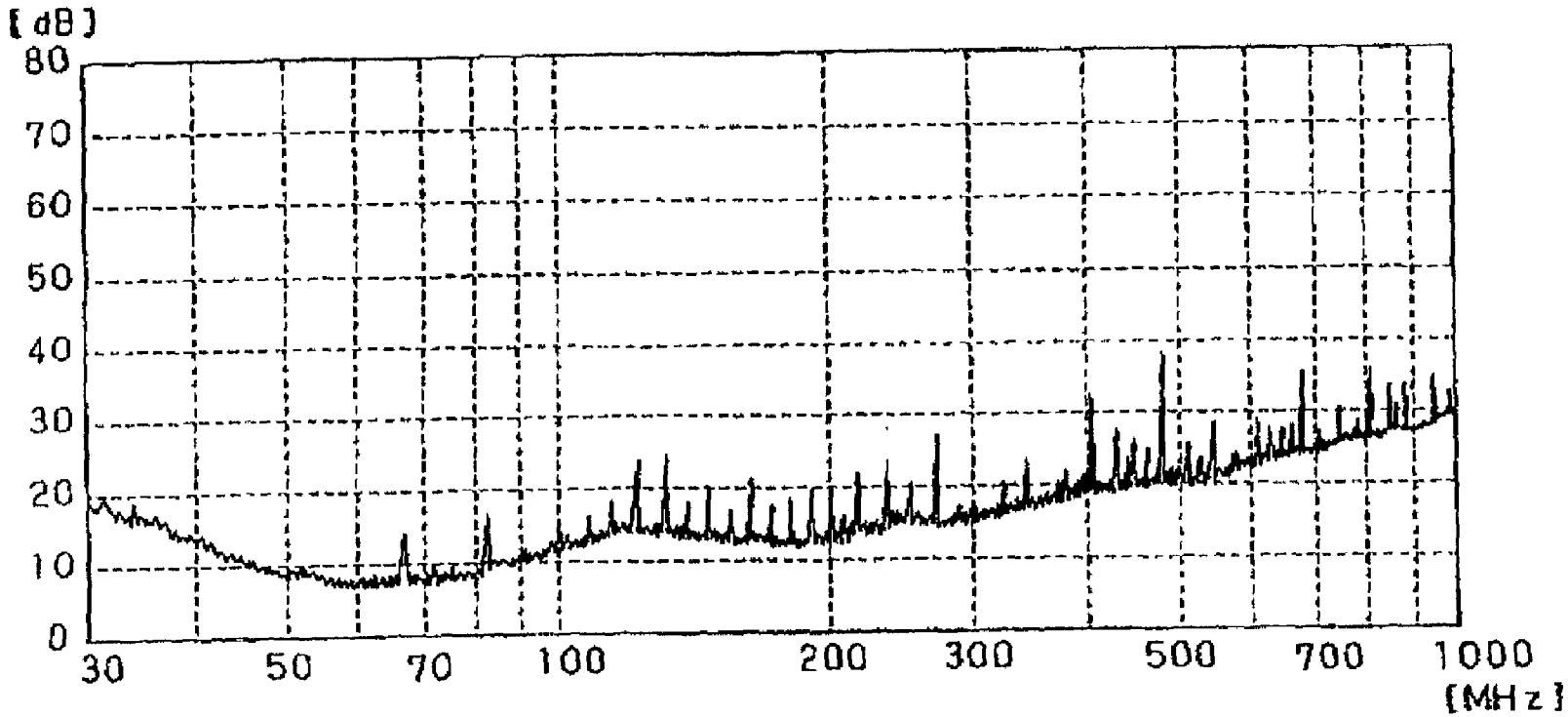

FIG. 39 is a diagram illustrative of noises from the driver circuit over the frequency in the measurement for the electromagnetic interference characteristic in accordance with the novel liquid crystal display device including the timing controller with the data polarity inversion function in accordance with the present invention.

Figure 40:
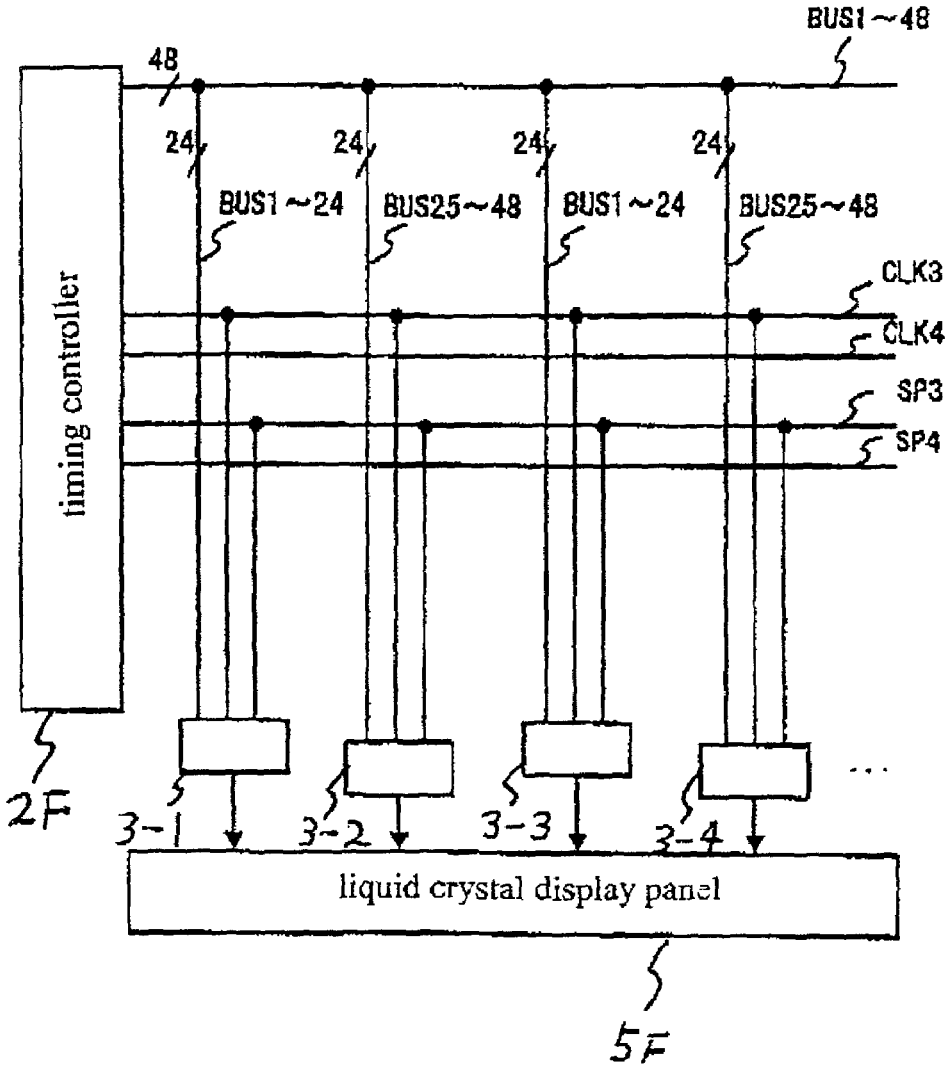

FIG. 40 is a block diagram illustrative of a conventional schematic configuration of the driver circuit for the liquid crystal display in the comparative example.

Figure 41:
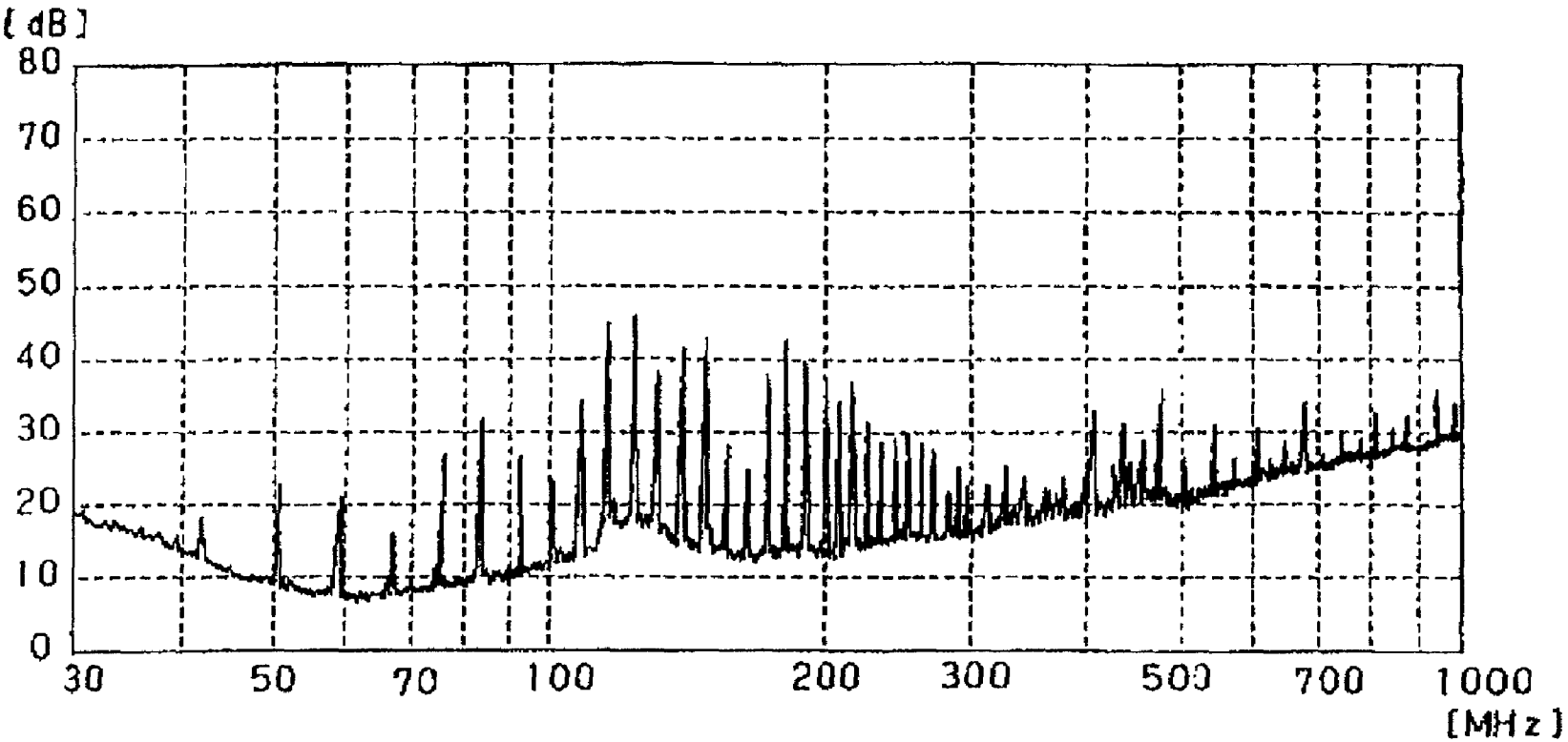

FIG. 41 is a diagram illustrative of noises from the driver circuit over the frequency in the measurement for the electromagnetic interference characteristic in accordance with the conventional liquid crystal display device including the timing controller with the data polarity inversion function in accordance with the comparative example.

DETAILED DESCRIPTION OF EXEMPLARY EMBODIMENTS

A first aspect of the present invention is a method of driving a liquid crystal display device having a plurality of bus lines for transmitting image data. The method comprises: branching original image data having an original data rate into branched plural-systems image data comprising plural systems having a converted data rate which is equal to either the original data rate or a half of the original data rate; supplying a source driver circuit with the branched plural-systems image data in synchronization with at least one clock signal having a clock frequency which is a quarter of the original data rate; and allowing the source driver to further branch the branched plural-systems image data into gray-scale voltage signals.

It is possible that the number of the systems of the branched plural-systems image data is 2J, where J is a positive integer number.

It is also possible that the number of the systems of the branched plural-systems image data is 4J, where J is a positive integer number.

It is also possible that the converted data rate is equal to the original data rate.

It is also possible that the converted data rate is equal to a half of the original data rate.

It is also possible that the at least a clock signal comprises two clock signals different in phase by a half cycle from each other, and rising edges of the two clock signals serve as triggers to input the image data into the source driver.

It is also possible that the at least a clock signal comprises two clock signals different in phase by a half cycle from each other, and falling edges of the two clock signals serve as triggers to input the image data into the source driver.

It is also possible that the at least a clock signal comprises a single clock signal, and both rising edges and falling edges of the single clock signal serve as triggers to input the image data into the source driver.

A second aspect of the present invention is a circuitry for driving a liquid crystal display device. The circuit comprises: a timing controller for generating image data and at least one clock signal; a plurality of data bus lines for transmitting the image data and at least one clock signal; and a plurality of source driver circuits for incorporating the image data in synchronization with the at least one clock signal and converting the image data into gray-scale voltage signals, wherein the timing controller includes: a branching unit for branching original image data having an original data rate into branched plural-systems image data comprising plural systems having a converted data rate which is equal to either the original data rate or a half of the original data rate.

It is also possible that the number of the systems of the branched plural-systems image data is 2J, where J is a positive integer number.

It is also possible that the number of the systems of the branched plural-systems image data is 4J, where J is a positive integer number.

It is also possible that the converted data rate is equal to the original data rate.

It is also possible that the converted data rate is equal to a half of the original data rate, It is also possible that the at least a clock signal comprises two clock signals different in phase by a half cycle from each other, and rising edges of the two clock signals serve as triggers to input the image data into the source driver.

It is also possible that the at least a clock signal comprises two clock signals different in phase by a half cycle tram each other, and falling edges of the two clock signals serve as triggers to input the image data into the source driver.

It is also possible that the at least a clock signal comprises a single clock signal, and both rising edges and falling edges of the single clock signal serve as triggers to input the image data into the source driver.

It is also possible that the timing controller further includes: a data polarity inversion determination unit for verifying whether or not a majority of bits of the branched plural-systems image data is changed in polarity; and a data polarity inversion unit for inverting all bits of the branched plural-systems image data in polarity if it is verified that the majority of bits of the branched plural-systems image data is changed in polarity.

It is also possible that plural pairs of the data polarity inversion determination unit and the data polarity inversion unit are provided, and the number of the pairs is identical with the number of the systems of the branched plural-systems image data.

It is also possible that the data polarity inversion determination circuit further includes: a polarity change detecting unit for detecting polarity change in bit unit of the polarity-inverted image data from the branched plural-systems image data; and a majority determination circuit for determining whether or not the majority of bits of the polarity-inverted image data is different in polarity from the branched plural-systems image data.

It is also possible that the timing controller further includes: a first latch circuit for latching the branched plural-systems image data in synchronization with the at least one clock signal and outputting the branched plural-systems image data as first output data; a first data polarity inversion determination circuit for inverting all bits of the branched plural-systems image data in polarity if a first polarity inversion signal has a predetermined level which indicates polarity inversion, and the first data polarity inversion determination circuit also outputting polarity-inverted image data; a second data polarity inversion determination circuit for comparing the polarity-inverted image data and the branched plural-systems image data to verify whether or not a majority of bits of the polarity-inverted image data is different in polarity from the branched plural-systems image data, and the second data polarity inversion determination circuit also outputting a second polarity inversion signal which has a predetermined level which indicates polarity inversion, if the majority of bits of the polarity-inverted image data is different in polarity from the branched plural-systems image data; and a second latch circuit for latching the second polarity inversion signal in synchronization with the at least one clock signal and supplying the first polarity inversion signal to the first data polarity inversion determination circuit.

It is also possible that the timing controller furthermore includes: a third latch circuit for latching the polarity-inverted image data in synchronization with the at least one clock signal and supplying the polarity-inverted image data to the source driver; a fourth latch circuit for latching the first polarity inversion signal in synchronization with the at least one clock signal and supplying the first polarity inversion signal to the source driver.

It is also possible that plural sets of the first and second data polarity inversion determination circuits and the first to fourth latch circuits are provided, and the number of the pairs is identical with the number of the systems of the branched plural-systems image data.

It is also possible that the second data polarity inversion determination circuit further includes a polarity change detecting circuit for detecting polarity change in bit unit of the polarity-inverted image data from the branched plural-systems image data; and a majority determination circuit for determining whether or not the majority of bits of the polarity-inverted image data is different in polarity from the branched plural-systems image data.

A third aspect of the present invention is a timing controller comprising: a serial-to-parallel converting unit for converting original image data having an original data rate into converted plural-systems image data comprising plural systems having a converted data rate which is equal to either the original data rate or a half of the original data rate; and a clock generator for generating at least a clock signal.

It is also possible that the number of the systems of the converted plural-systems image data is 2J, where J is a positive integer number.

It is also possible that the number of the systems of the converted plural-systems image data is 4J, where J is a positive integer number.

It is also possible that the converted data rate is equal to the original data rate.

It is also possible that the converted data rate is equal to a half of the original data rate.

It is also possible that the at least a clock signal comprises two clock signals different in phase by a half cycle from each other, and rising edges of the two clock signals serve as triggers to input the image data into the source driver.

It is also possible that the at least a clock signal comprises two clock signals different in phase by a half cycle from each other, and falling edges of the two clock signals serve as triggers to input the image data into the source driver.

It is also possible that the at least a clock signal comprises a single clock signal, and both rising edges and falling edges of the single clock signal serve as triggers to input the image data into the source driver.

It is also possible that the serial-to-parallel converting unit further includes a data polarity inversion determination unit for verifying whether or not a majority of bits of the converted plural-systems image data is changed in polarity; and a data polarity inversion unit for inverting all bits of the converted plural-systems image data in polarity if it is verified that the majority of bits of the converted plural-systems image data is changed in polarity.

It is also possible that plural pairs of the data polarity inversion determination unit and the data polarity inversion unit are provided, and the number of the pairs is identical with the number of the systems of the converted plural-systems image data.

It is also possible that the data polarity inversion determination circuit further includes: a polarity change detecting circuit for detecting polarity change in bit unit of the polarity-inverted image data from the converted plural-systems image data; and a majority determination circuit for determining whether or not the majority of bits of the polarity-inverted image data is different in polarity from the converted plural-systems image data.

It is also possible that the serial-to-parallel converting unit further includes: a first latch circuit for latching the converted plural-systems image data in synchronization with the at least one clock signal and outputting the converted plural-systems image data as first output data; a first data polarity inversion determination circuit for inverting all bits of the converted plural-systems image data in polarity if a first polarity inversion signal has a predetermined level which indicates polarity inversion, and the first data polarity inversion determination circuit also outputting polarity-inverted image data; a second data polarity inversion determination circuit for comparing the polarity-inverted image data and the converted plural-systems image data to verify whether or not a majority of bits of the polarity-inverted image data is different in polarity from the converted plural-systems image data, and the second data polarity inversion determination circuit also outputting a second polarity inversion signal which has a predetermined level which indicates polarity inversion, if the majority of bits of the polarity-inverted image data is different in polarity from the converted plural-systems image data; and a second latch circuit for latching the second polarity inversion signal in synchronization with the at least one clock signal and supplying the first polarity inversion signal to the first data polarity inversion determination circuit.

It is also possible that the serial-to-parallel converting unit furthermore includes: a third latch circuit for latching the polarity-inverted image data in synchronization with the at least one clock signal and supplying the polarity-inverted image data to the source driver; a fourth latch circuit for latching the first polarity inversion signal in synchronization with the at least one clock signal and supplying the first polarity inversion signal to the source driver.

It is also possible that plural sets of the first and second data polarity inversion determination circuits and the first to fourth latch circuits are provided, and the number of the pairs is identical with the number of the systems of the converted plural-systems image data.

It is also possible that the second data polarity inversion determination circuit further includes: a polarity change detecting circuit for detecting polarity change in bit unit of the polarity-inverted image data from the converted plural-systems image data; and a majority determination circuit for determining whether or not the majority of bits of the polarity-inverted image data is different in polarity from the converted plural-systems image data.

Figure 1:
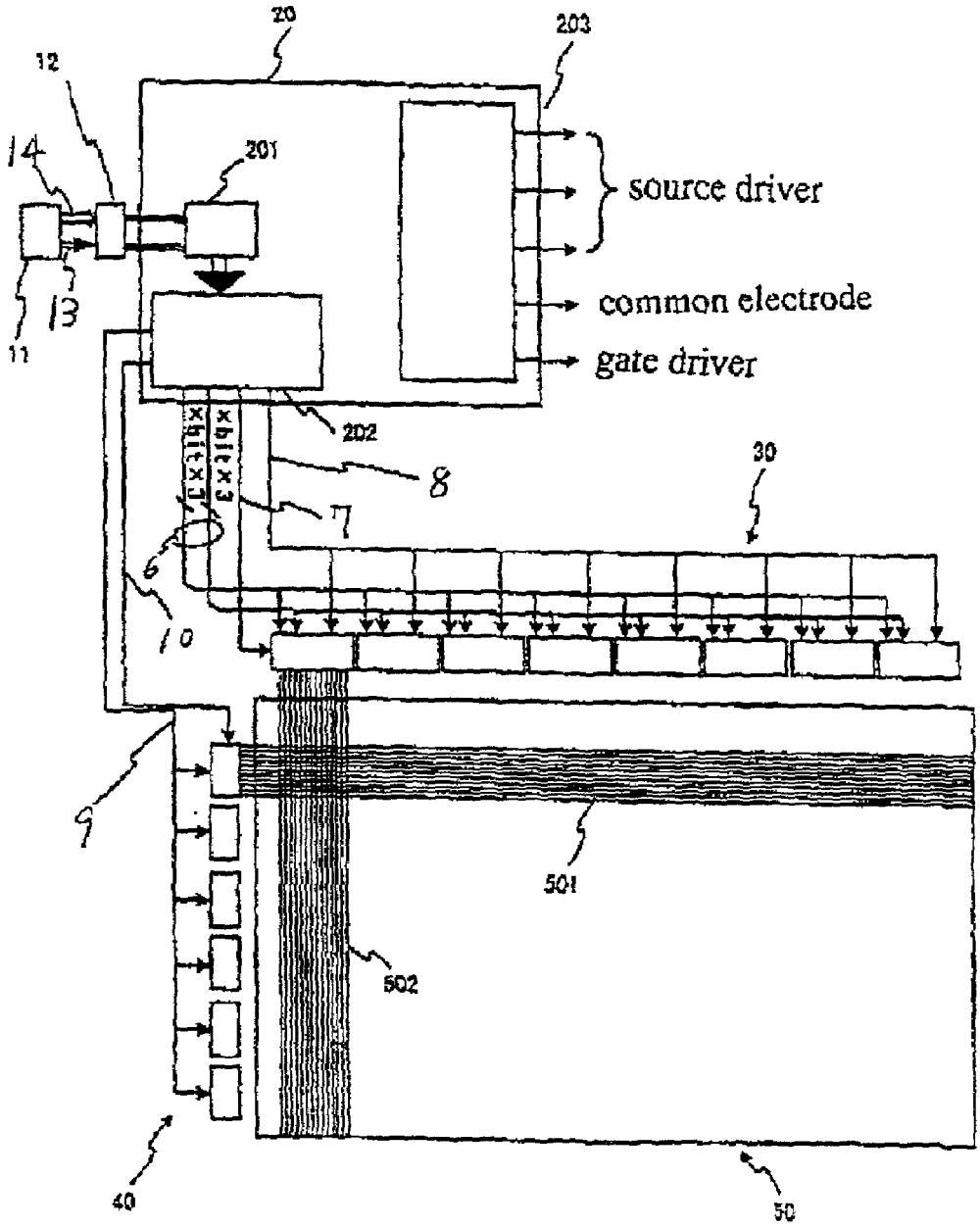
FIG. 1 prior art
FIG. 1 is a block diagram illustrative of a first conventional driver circuit for driving a liquid crystal display.
Figure 2:
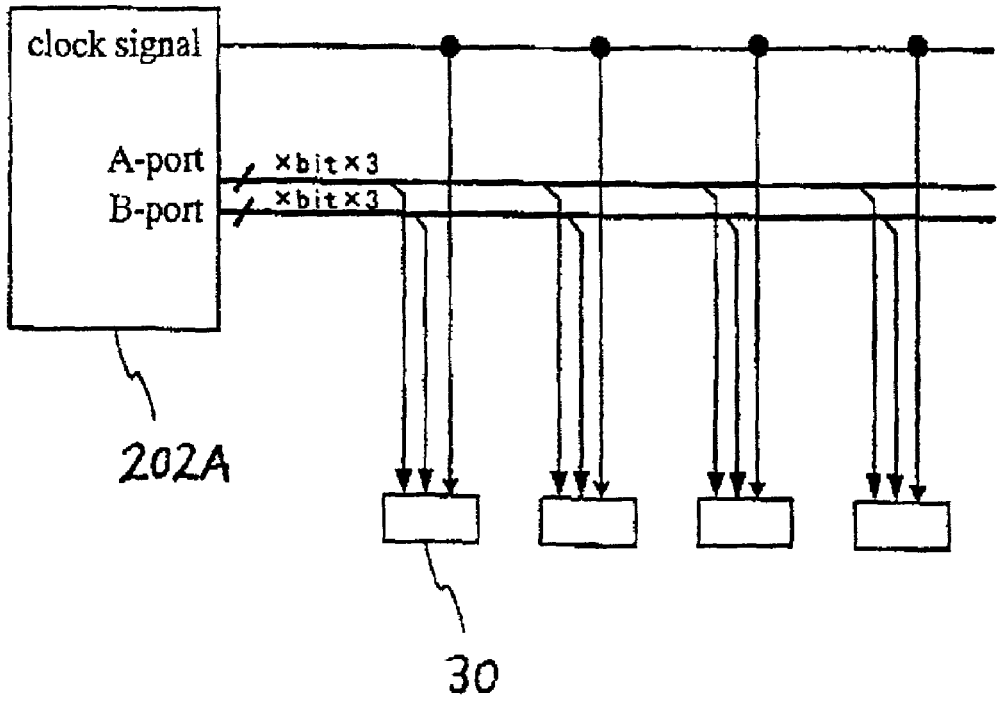
FIG. 2 prior art
FIG. 2 is a fragmentary block diagram illustrative of a first conventional circuit configuration including a timing controller and source drivers, wherein the circuit configuration is included in the circuit configuration of FIG. 1.
Figure 3:
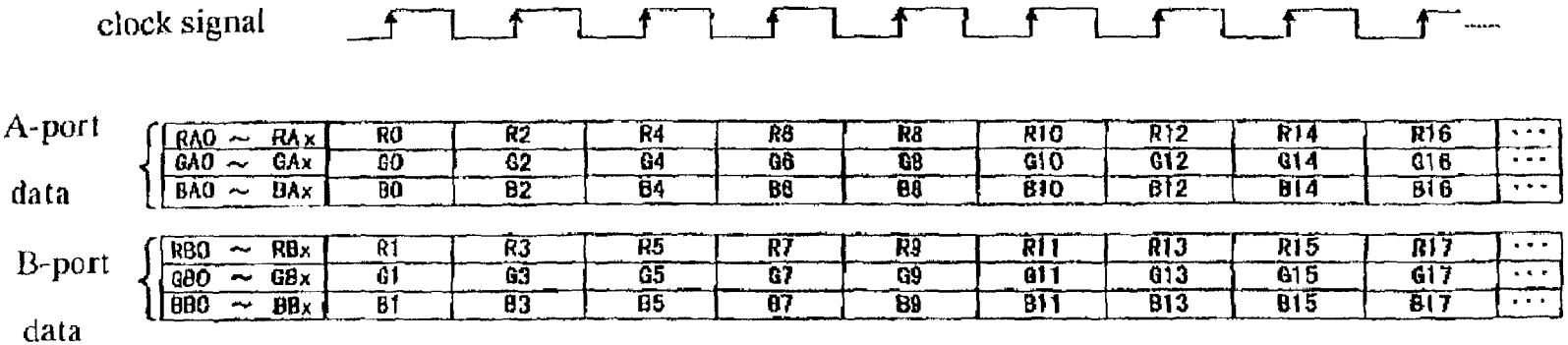
FIG. 3 prior art
FIG. 3 is a view illustrative of contents of image data to be supplied in synchronization with a clock signal from the timing controller to the source drivers 30 in FIG. 2.
Figure 4:
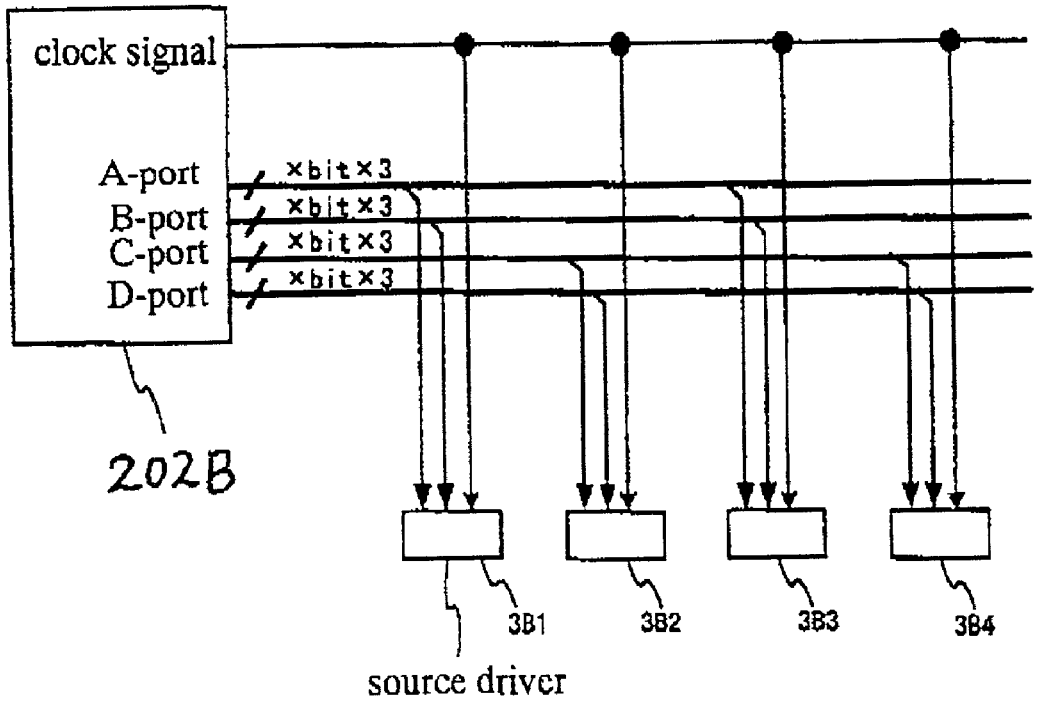
FIG. 4 prior art
FIG. 4 is a fragmentary block diagram illustrative of a second conventional circuit configuration including a timing controller and source drivers, wherein the circuit configuration is included in the circuit configuration of FIG. 1.
Figure 5:
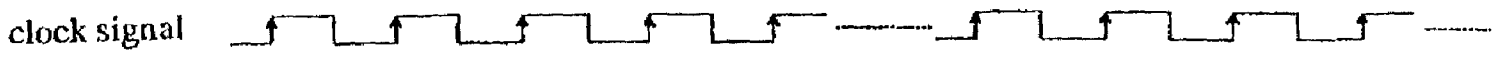
FIG. 5 prior art
FIG. 5 is a view illustrative of contents of image data to be supplied in synchronization with a clock signal from the timing controller to the source drivers in FIG. 4.
Figure 6:
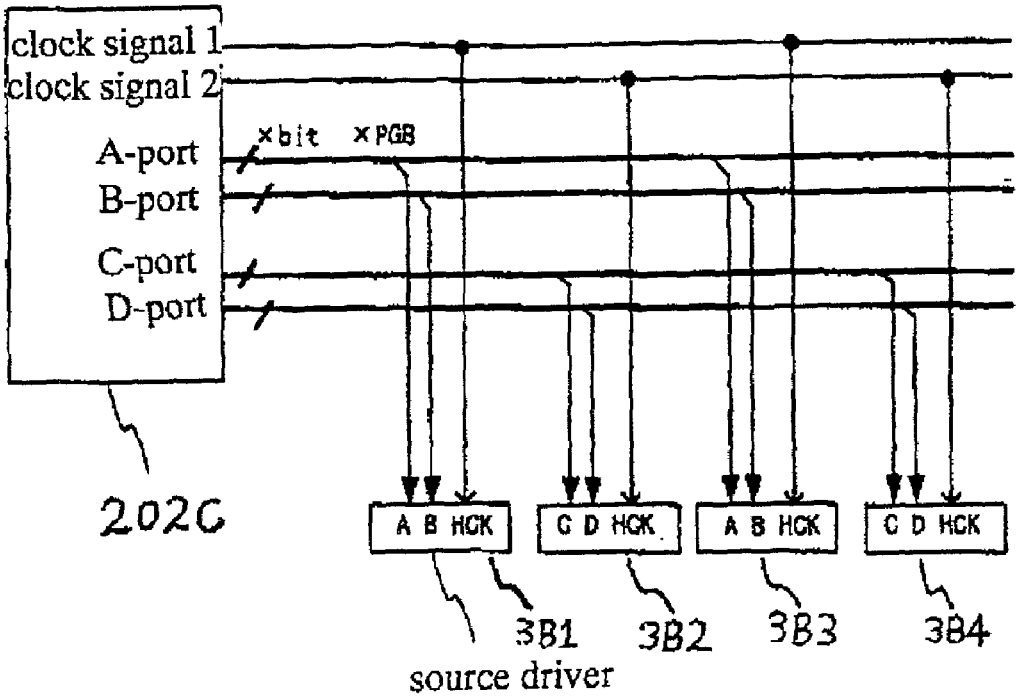
FIG. 6 prior art
FIG. 6 is a fragmentary block diagram illustrative of a third conventional circuit configuration including a timing controller and source drivers, wherein the circuit configuration is included in the circuit configuration of FIG. 1.
Figure 7:
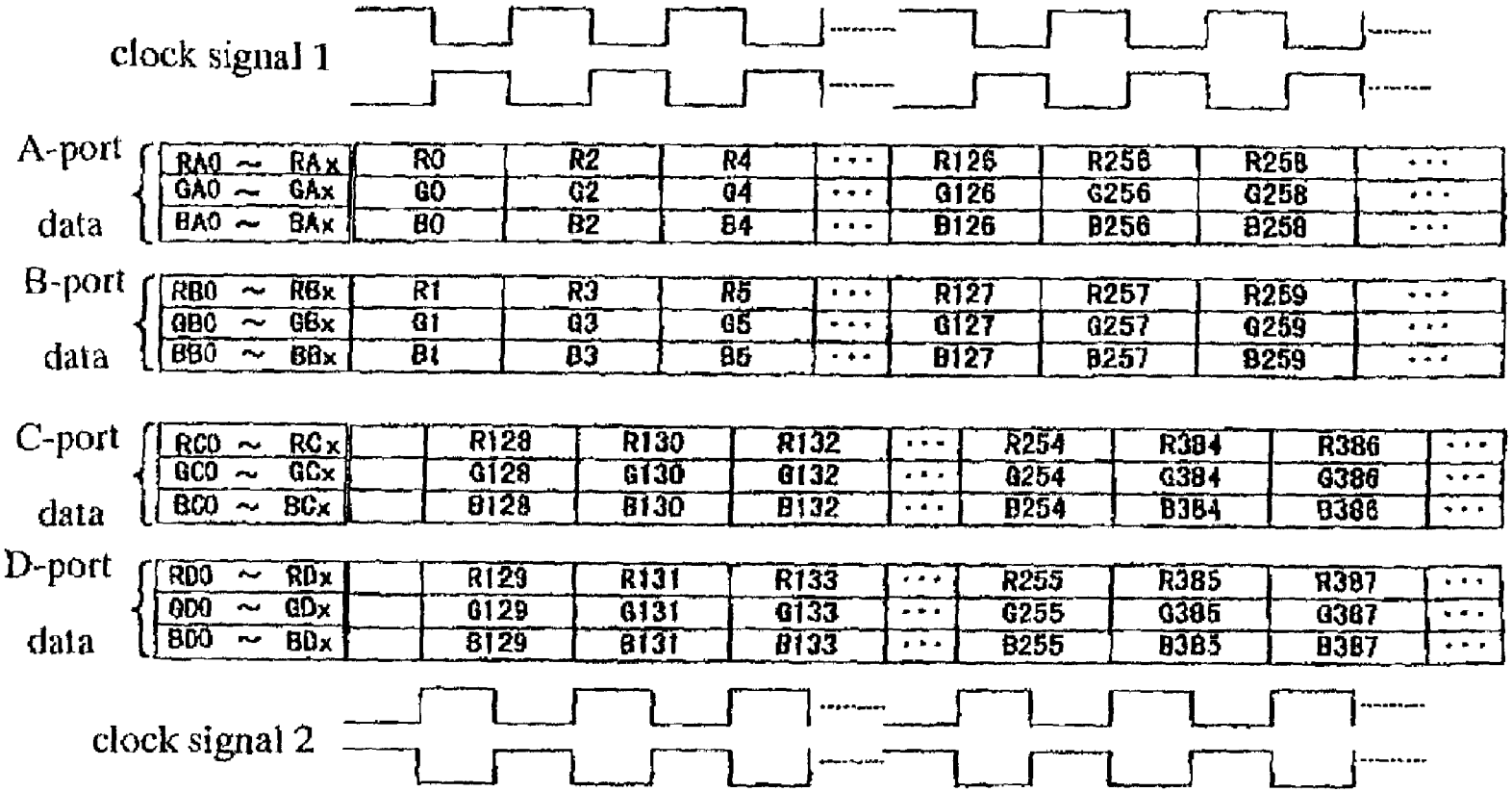
FIG. 7 prior art
FIG. 7 is a view illustrative of contents of image data to be supplied in synchronization with a clock signal from the timing controller to the source drivers in FIG. 6.
Figure 8:
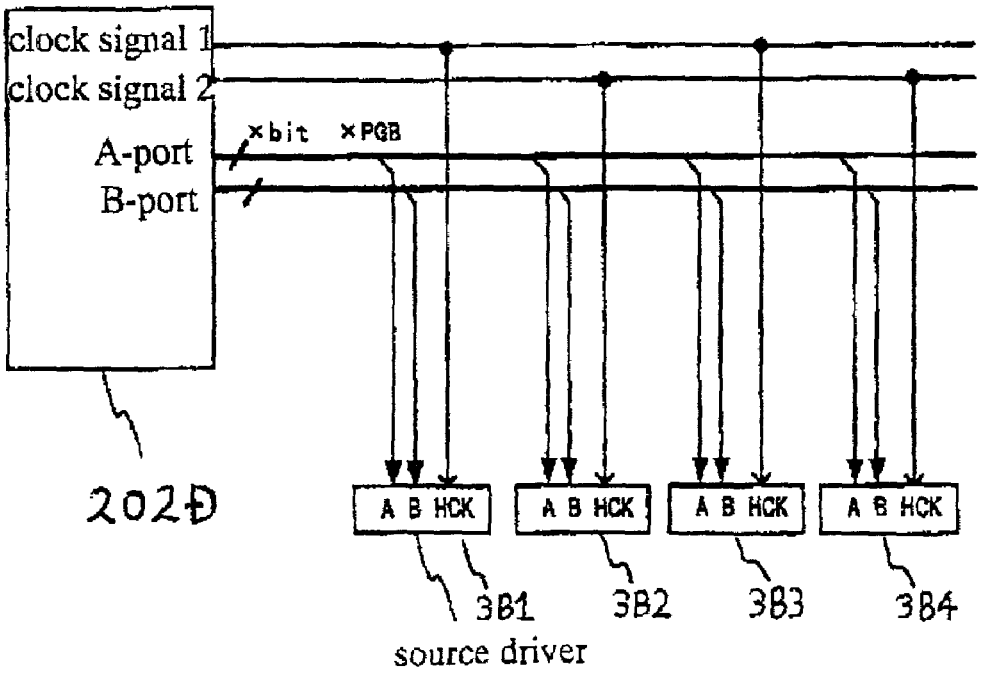
FIG. 8 prior art
FIG. 8 is a fragmentary block diagram illustrative of a fourth conventional circuit configuration including a timing controller and source drivers, wherein the circuit configuration is included in the circuit configuration of FIG. 1.
Figure 9:
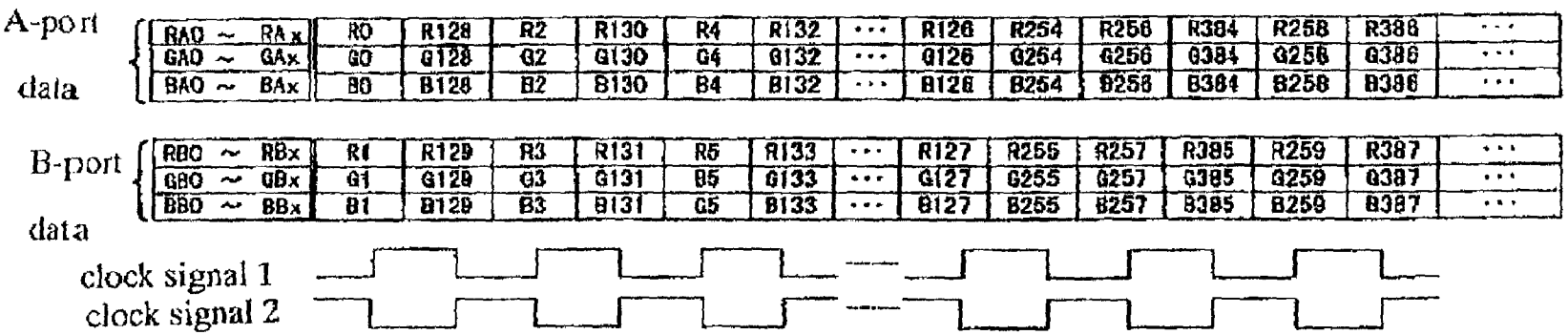
FIG. 9 prior art
FIG. 9 is a view illustrative of contents of image data to be supplied in synchronization with a clock signal from the timing controller to the source drivers in FIG. 8.
Figure 10:
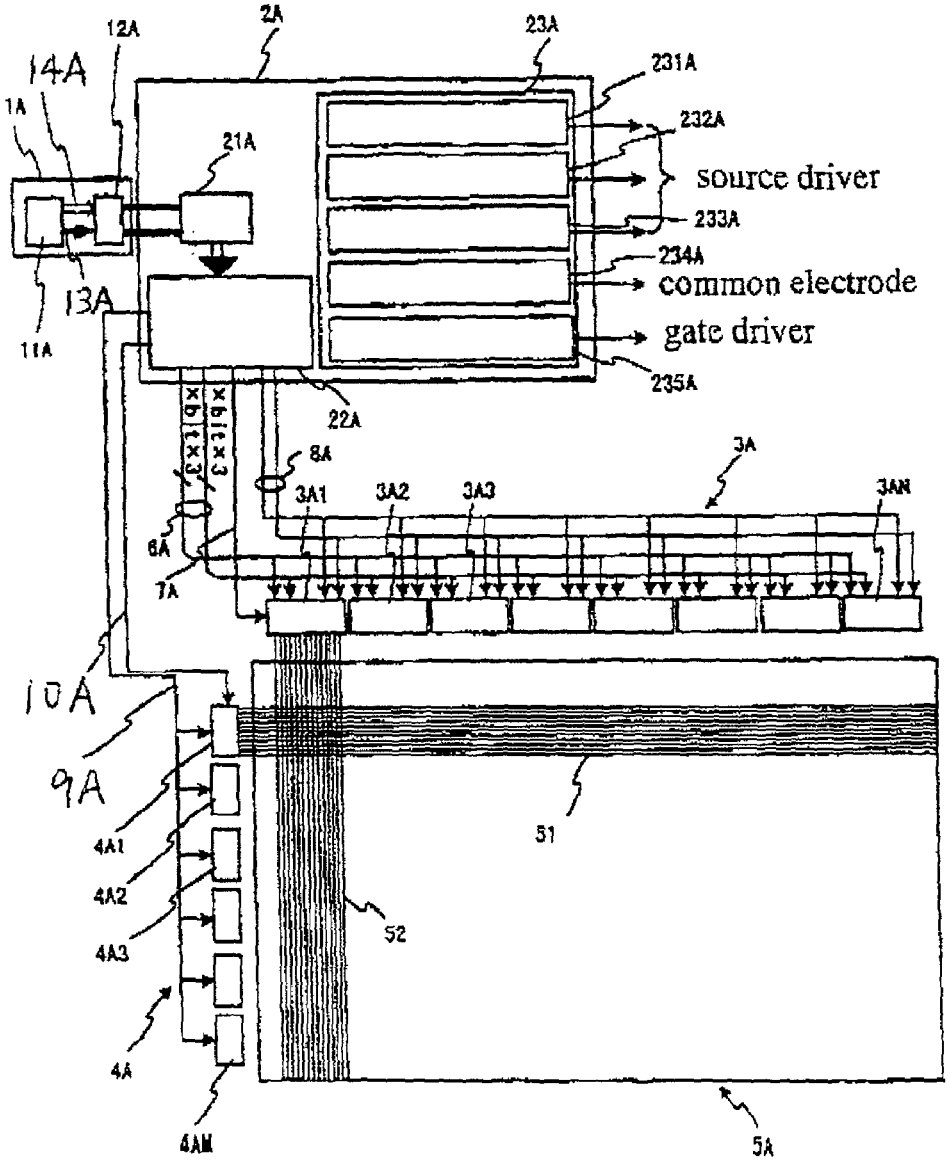
FIG. 10 is a block diagram illustrative of a novel driver circuit for driving a liquid crystal display in a first embodiment in accordance with the present invention.

First Embodiment:

A first embodiment according to the present invention will be described in detail with reference to the drawings. FIG. 10 is a block diagram illustrative of a novel driver circuit for driving a liquid crystal display in a first embodiment in accordance with the present invention. The liquid crystal display device includes a display panel and a driver circuit having the following circuit configuration.

The display panel 5A has a two-dimensional array of pixels, each of which includes a pixel electrode and a thin film transistor. The display panel 5A also has a plurality of gate signal lines 51 extending in a row direction and a plurality of source signal lines 52 extending in a column direction. The thin film transistor has a gate electrode connected to the gate signal line 51, a source electrode connected to the source signal line 52 and a drain electrode connected to the pixel electrode.

The display panel 5A includes a glass substrate, a plurality of source lines extending in parallel to a row direction, a plurality of gate lines extending in parallel to a column direction, a matrix array of pixel electrodes at crossing points of the source lines and the gate lines, a matrix array of thin film transistors, a common electrode and liquid crystal cells between the pixel electrodes and the common electrode. Each of the thin film transistors has a source connected to the source line, a gate electrode connected to the gate line, and a drain connected to the pixel electrode. The gate line is driven to place the thin film transistor into ON-state, whereby the gray-scale scale voltage generated by the source driver 3A and transmitted on the source line 52 is supplied through the thin film transistor to the pixel electrode, so that the pixel electrode has the gray-scale voltage. The common electrode is fixed in potential at a predetermined level, for example, a ground level. A potential difference between the pixel electrode and the common electrode depends on the gray-scale voltage.

The driver circuit includes a row alignment of plural source drivers 3A and a column alignment of plural gate drivers 4A. The number of the source drivers 3A is "N", whilst the number of the gate drivers 4A is "M". Each of the source drivers 3A is connected to a plurality of the source signal lines 52 for driving the source signal lines 52. Each of the gate drivers 4A is connected to a plurality of the gate signal lines 51 for driving the gate signal lines 51.

The driver circuit is connected to a computer which includes a circuit 1A including a graphic controller 11A and a transmitter 12A. The driver circuit also includes an interface board 2A. On the interface board 2A, a receiver unit 21A, a timing control unit 22A and a power supply circuit 23A are provided. The timing control unit 22A supplies each of the plural source drivers 3A with image data 6A, a start signal 7A and clock signals 8A. The timing control unit 22A also supplies each of the gate drivers 4A with a clock signal 9A and a frame start signal 10A.

The graphic controller 11A outputs control signals 13A and image data 14A, both of which are then transmitted through the transmitter 12A to the receiver unit 21A. The control signals 13A include timing control signals. The timing control signals may for example, be a clock signal, a horizontal synchronous signal, and a vertical synchronous signal.

The receiver unit 21A receives the timing control signals and the image data from the graphic controller 11A. The timing control signals and the image data are then supplied to the timing control unit 22A. The image data 14A and the timing control signals 13A are supplied in parallel-transmission from the graphic controller 11A to the transmitter 12A. The transmitter 12A performs a parallel-to-serial conversion of the image data 14A and the timing control signals 13A, so that the image data 14A and the timing control signals 13A are supplied in serial-transmission from the transmitter 12A to the receiver unit 21A. The serial data including the image data and the timing control signals may be transmitted in any available transmission system such as a low voltage differential signaling (VDS), a transmission minimized differential signaling (TMDS), a gigabit video interface (GVIF) and a low voltage differential signaling display interface (LDI).

The receiver unit 21A performs a serial-to-parallel conversion of the image data and the timing control signals, so that the image data and the timing control signals are supplied in parallel-transmission from the receiver unit 21A to the timing control unit 22A. The timing control unit 22A generates the image data 6A, the start signal 7A, the clock signals 8A, the clock signal 9A and the frame start signal 10A. The image data 6A, the start signal 7A and the clock signals 8A are supplied to each of the source drivers 3A. The clock signal 9A and the frame start signal 10A are supplied to each of the gate drivers 4A.

The power supply circuit 23A is integrated in the interface board 2A. The power supply circuit 23A includes a source voltage generating circuit 231A for generating a source driver driving voltage to the source driver 3A, positive and negative voltage generating circuits 232A and 233A for generating a pixel electrode driving voltage to the pixel electrode, a common electrode voltage generating circuit 234A for generating a common electrode driving voltage to the common electrode, and a gate voltage generating circuit 235A for generating a gate driving voltage to the gate driver circuit 4A.

The source voltage generating circuit 231A generates independent voltages necessary for digital and an analog circuits in the source driver 3A. The source voltage generating circuit 231A has two output lines, from which the independent voltages are supplied to the digital and analog circuits in the source driver 3A.

The positive and negative voltage generating circuits 232A and 233A generate output gray scale reference voltages which are to be supplied to a digital-to-analog converter in the source driver 3A. Each of the positive and negative voltage generating circuits 232A and 233A has plural output lines, from which output gray scale reference voltages with different voltage levels are supplied.

The common electrode voltage generating circuit 234A generates a DC voltage which is to be supplied to the common electrode of the liquid crystal panel 5A. The gate voltage generating circuit 235A generates separate power voltages necessary for a digital circuit, a high voltage logic circuit and a low voltage logic circuit included in the gate driver 4A. The gate voltage generating circuit 235A has three output lines, from which the separate power voltages are supplied to the digital circuit, the high voltage logic circuit and the low voltage logic circuit included in the gate driver 4A.

The functions of the timing controller 22A and the source driver 3A are as follows. The timing controller 22A may be integrated in a semiconductor integrated circuit (LSI) which receives various display timing signals, for example, a clock signal, a display timing signal, a horizontal synchronization signal and a vertical synchronization signal, wherein the display timing signals have been supplied from the graphic controller 11A through the transmitter 12A and the receiver circuit 21A to the timing controller 22A. The timing controller 22A drives the plural source drivers 3A and the plural gate drivers 4A based on the display timing signals and display data.

As shown in FIG. 10, the timing controller 22A may be integrated solely in the semiconductor integrated circuit (LSI). It is, of course, possible as a modification that the timing controller 22A and the receiver circuit 21A are integrated together in the semiconductor integrated circuit (LSI). The following descriptions will be made assuming that the serial-to-parallel converter circuit of the receiver circuit 21A is a part of the configuration of the timing controller The source drivers 3A comprise a row alignment of source drivers 3A1, 3A2, 3A3, - - - , 3AN. Upon input of the start signal 7A, the source drivers 3A1, 3A2, 3A3, - - - , 3AN are serial operations from the source driver 3A1 to the source driver 3AN. Each of the source drivers 3A1, 3A2, 3A3, - - - , 3AN outputs image data concurrently to the source lines which number is equal to pixel number/N, wherein the pixel number is the number of the pixels on each line. Each of the source drivers 3A receives the image data 6A, the start signal 7A, and the clock signal 8A from the timing controller 22A, so that each of the source drivers 3A operates to latch the image data 6A into an internal register thereof at the timing of the clock signal 8A and performs a digital-to-analog conversion of the image data prior to supply of the image signal to the source signal lines 52.

The gate drivers 4A comprise a column alignment of gate drivers 4A1, 4A2, 4A3, - - - 4AM. Upon input of the frame start signal 10A and the gate driver clock signal 9A, the gate drivers 4A1, 4A2, 4A3, - - - 4AM are serial operations from the gate driver 4A1 to the gate driver 4AM. Each of the gate drivers 4A1, 4A2, 4A3, - - - 4AM outputs scanning signals which are to be applied to the gate lines, wherein the number of the scanning signals is equal to line number /M.

The voltage corresponding to the image data for each pixel is applied to the source line which is connected through the thin film transistor to the pixel electrode of the target pixel. The scanning signal is applied to the gate line which is connected to the gate of the thin film transistor, whereby the thin film transistor is placed into the ON-state, and the voltage corresponding to the image data is applied to the pixel electrode of the target pixel. This write operation is cared out in serial operation in the row direction from the left side to the right side in the drawing in the unit of the source drivers, and further the scanning operation in the unit of the serial operation is then carried out in the column direction from the top to the bottom in the drawing in the unit of the gate lines. Each of the pixel electrodes has the respective potential corresponding to the image data, whereby each pixel has a respective field applied to the liquid crystal, wherein the intensity of the respective field depends on the voltage level corresponding to the image data. The light transmittivity of the liquid crystal depends on the intensity of the respective field, whereby the display can be obtained in accordance with the image data.

Figure 11:
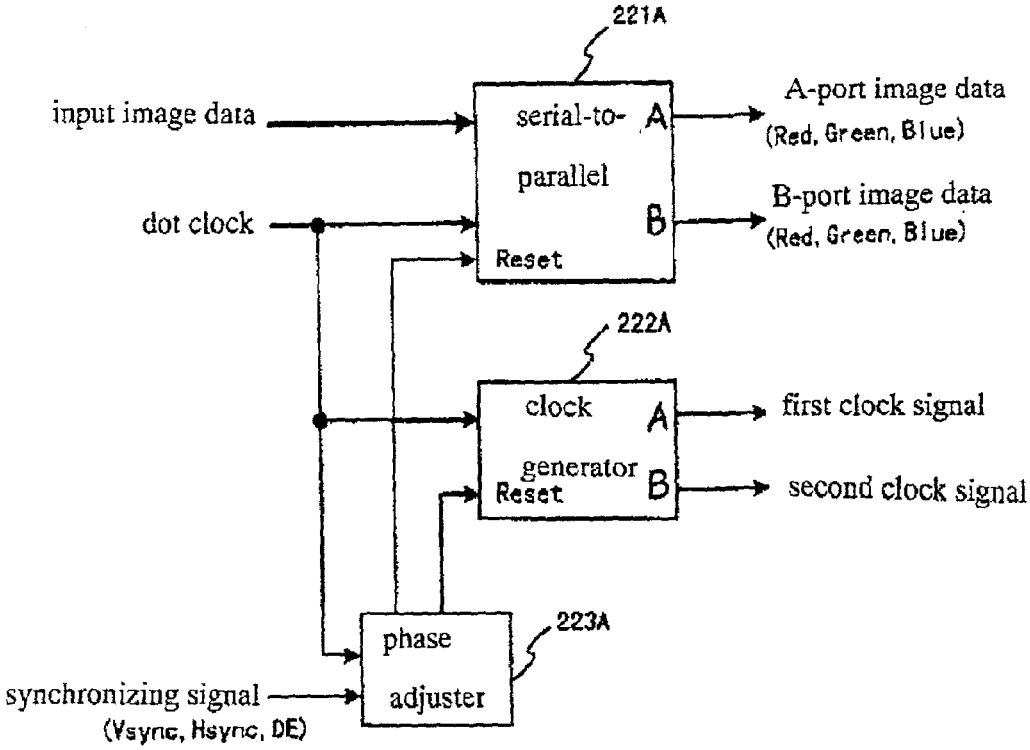
FIG. 11 is a block diagram illustrative of the timing controller shown in FIG. 10.

Operations of the above-described timing controller 22A and each of the source drivers 3A will be described in detail as follows. FIG. 11 is a block diagram illustrative of the timing controller shown in FIG. 10.

The timing controller 22A may comprise a serial-to-parallel converter block 221A, a clock signal generator circuit 222A, and a phase adjuster circuit 223A. The serial-to-parallel converter block 221A receives an input of the image data and an input of a dot-clock signal of a data rate of the image data. The phase adjuster circuit 223A receives an input of the dot-clock signal and an input of synchronization signals Vsync, Hsync, and DE. The clock signal generator circuit 222A is electrically coupled to the phase adjuster circuit 223A for receiving an input of a reset signal from the phase adjuster circuit 223A. The serial-to-parallel converter block 221A is also electrically coupled to the phase adjuster circuit 223A for receiving an input of a reset signal from the phase adjuster circuit 223A.

The serial-to-parallel converter block 221A receives the image data which includes three primary color signal data, for example, red, green and blue color data, each of which comprises 8-bits signals. The serial-to-parallel converter block 221A receives the dot-clock signal of the data rate of the image data. The serial-to-parallel converter block 221 A receives the reset signal of a single line unit from the phase adjuster circuit 223A. The serial-to-parallel converter block 221A isolates the received image data into odd number data and even number data. The serial-to-parallel converter block 221A has two parallel output ports, for example, A-port and B-port. The even number data and odd number data are outputted from the A-port and B-port respectively. The odd number data include the three primary color signal data, for example, red, green and blue color data. The even number data also include the three primary color signal data, for example, red, green and blue color data.

The clock signal generator circuit 222A receives the dot-clock signal of the data rate of the image data. The clock signal generator circuit 222A also receives the reset signal from the phase adjuster circuit 223A. The clock signal generator circuit 222A generates first and second clock signals from two parallel ports, for example, A-port and B-port. The first and second clock signals are opposite in phase.

Figure 12:
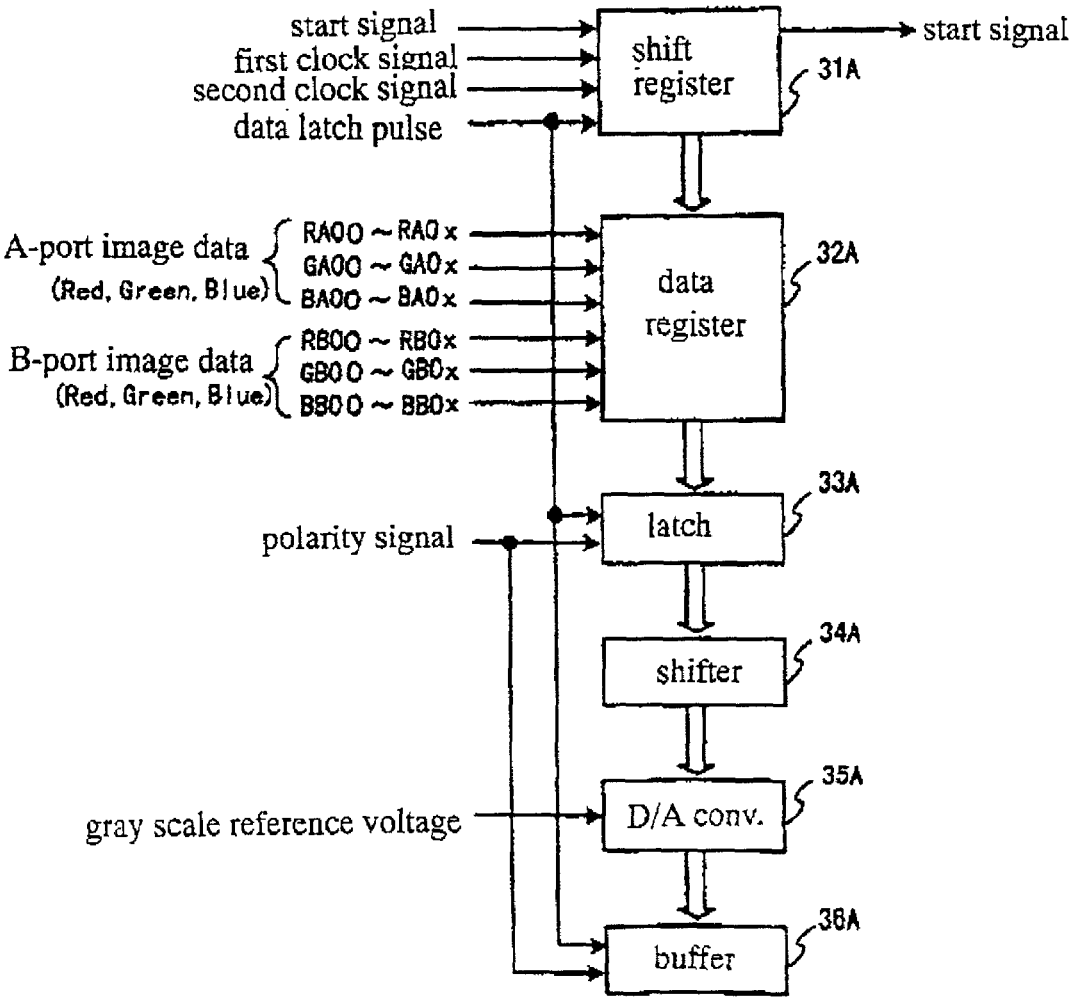
FIG. 12 is a block diagram illustrative of an internal configuration of each of the source drivers shown in FIG. 10.
Figure 13:
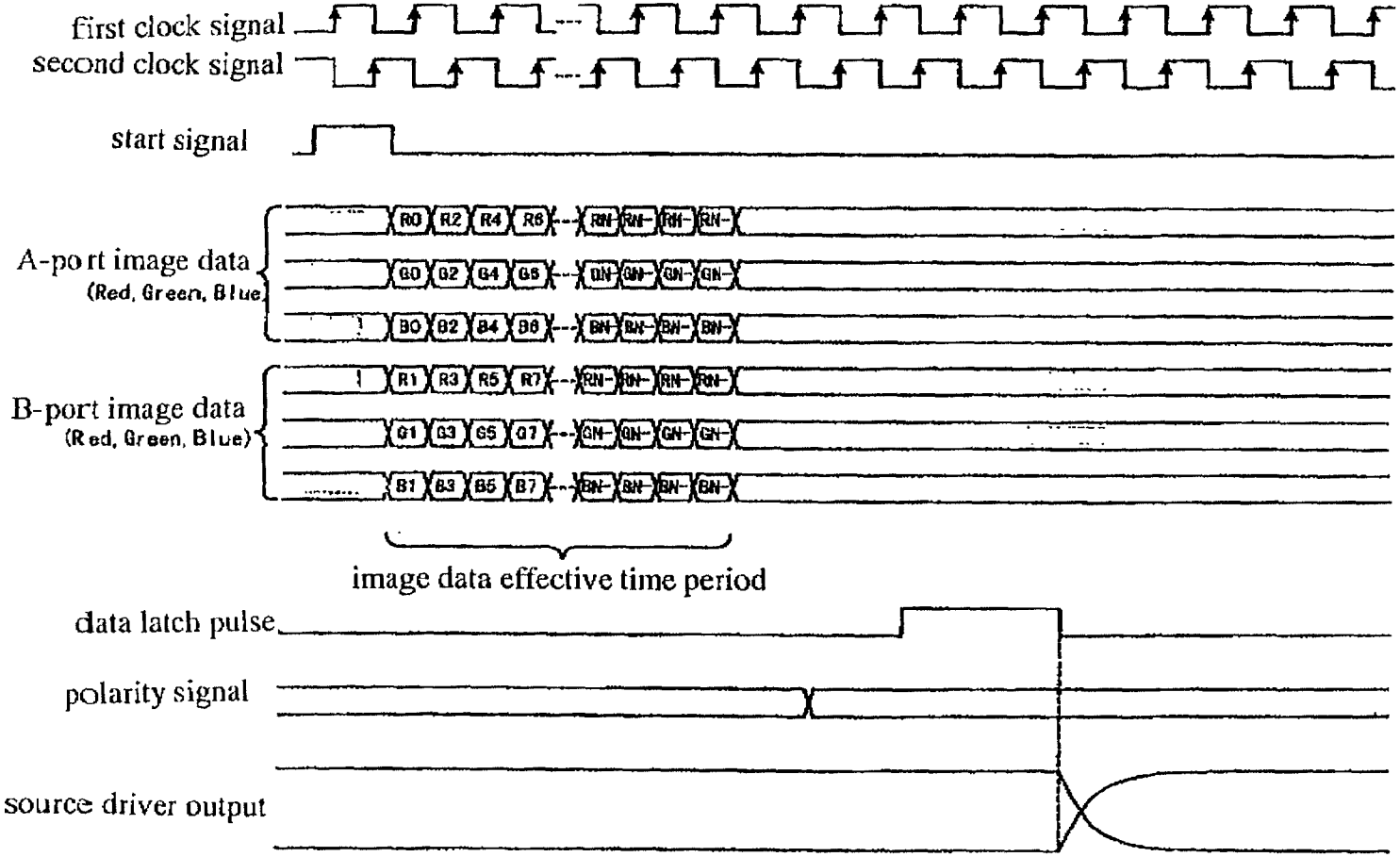
FIG. 13 is a timing chart illustrative of waveforms of various signals to describe operations of the each source driver shown in FIG. 12.

FIG. 12 is a block diagram illustrative of an internal configuration of each of the source drivers shown in FIG. 10. FIG. 13 is a timing chart illustrative of waveforms of various signals to describe operations of the each source driver shown in FIG. 12. FIG. 13 illustrates a waveform of A-port image data for three primary colors outputted from the A-port, a waveform of B-port image data for three primary colors outputted from the B-port, and waveforms of first and second clock signals which are opposite to each other in phase of a half cyclic frequency which corresponds to the data rate of the image data. FIG. 13 further illustrates a waveform of a data latch pulse signal, a polarity signal, and a source driver output signal which is to be applied to the source line.

The A-port image data are the even number data, whilst the B-port image data are the odd number data. For each of the A-port image data and the B-port image data, "R0", "R1", "R2" - - - "RN" represent the image data for the red color. "G0", "G1", "G2" - - - "GN" represent the image data for the green color. "B0", "B1", "B2" - - - "BN" represent the image data for the blue color. The A-port image data comprise the red color image data in sequence of even numbers, the green color image data in sequence of even numbers, and the blue color image data in sequence of even numbers. The B-port image data comprise the red color image data in sequence of odd numbers, the green color image data in sequence of odd numbers, and the blue color image data in sequence of odd numbers. Each of the red, green and blue colors image data sets comprises the same number bits as the number of the source lines. If the number of the source lines is 1280 and the number of the gate lines is 1024, then the red color data comprise "R0", - - - "R1279", the green color data comprise "G0", - - - "G1279", and the blue color data comprise "B0", - - - "B1279".

In this embodiment, the two system data, for example, the A-port image data and the B-port image data are respectively inputted into the two parallel ports, for example, the A-port and the B-port. It is, however, possible as a modification that if the image data comprise four system data, for example, the A-port image data, the B-port image data, the C-port image data and the D-port image data, then the A-port image data and the C-port image data are inputted into the A-port, and the B-port image data and the D-port image data are inputted into the B-port.

With reference to FIG. 12, each of the source drivers 3A comprises a shift register 31A, a data register 32A, a data latch 33A, a level shifter 34A, a digital-to-analog converter 35A, and an output buffer 36A. The shift register 31A receives parallel inputs of the start signal, the first and second clock signals, and the data latch pulse signal. The shift register 31A has multiple stages. The start signal is sequentially inputted into the multiple stages in the shift register 31A, wherein each of the stages outputs a shifted signal upon input of the start signal, whereby the multiple stages sequentially output the shifted signals upon sequential inputs of the start signal.

The data register 32A receives parallel inputs of the A-port image data for the three primary colors and further parallel inputs of the B-port image data for the three primary colors. The shifted signals are also supplied from the multiple stages in the shift register 31A into the data register 32A sequentially, so that the received A-port and B-port image data are stored sequentially into registers in the data register 32A.

The data latch 33A receives the input of the data latch pulse and another input of the polarity signal. The data latch 33A operates to latch the data stored in the data register 32A in a single line unit.

The level shifter 34A performs level shifts to the output data from the data latch. The digital-to-analog converter 35A receives an input of the output gray scale reference voltage. The digital-to-analog converter 35A also receives the level-shifted digital data from the level shifter 34A, and the digital-to-analog converter 35A performs the digital-to-analog conversion of the level-shifted digital data into the analog image signals.

The output buffer 36A receives the input of the data latch pulse and another input of the polarity signal. The output buffer 36A also receives the analog image signals from the digital-to-analog converter 35A, and then supplies the analog image signals to the source lines.

The following descriptions will be made in more detail with reference again to FIGS. 10, 11, 12 and 13.

The serial-to-parallel converter block 221A temporally stores the inputted image data into integrated memory not shown, and then the serial-to-parallel converter block 221A reads out the image data at ½ data rate and then isolates the image data into two-system data sets, for example, even number data set of the A-port image data and odd number data set of the B-port image data. The A-port image data and the B-port image data are time-compressed, so that each set of the A-port image data and the B-port image data include an image data active time period and an image data inactive time period. In the image data active time period, the A-port image data and the B-port image data are present. In the image data inactive time period, the A-port image data and the B-port image data are absent. The A-port image data and the B-port image data are supplied from the timing controller 22A to the source drivers 3A. The image data active time period corresponds to the image data for a single source line.

The clock generator circuit 222A receives the first and second clock signals based on the dot-clock signal. The clock generator circuit 222A outputs the first and second clock signals and the start signal in synchronization with the above outputs of the A-port image data and the B-port image data from the A-port and B-port of the serial-to-parallel converter block 221A. The first and second clock signals and the start signal are supplied to the source drivers 3A. The first and second clock signals have a frequency which is equal to a half of the data rate of the A-port image data and the B-port image data. The start signal is positioned at a top position of the image data.

The shift register 31 A comprises multiple stages of flip-flop circuits, wherein the number of the stages is the number of the source lines connected to each source driver. The shift register 31A sequentially shifts the start signal on the multiple stages in accordance with the first and second clock signals, whereby the multiple stages of the shift register 31A sequentially generate shifted timing signals which are in synchronization with the first and second clock signals. The shifted timing signal rises and falls in synchronization with rising and falling edges of the clock signal. The timing signals are sequentially outputted from the multiple stages of the shift register 31A. After the start signal reaches the final stage of the shift register 31A, then the start signal is shifted to the shift register of the next stage driver in synchronization with the next clock signal and subsequently the above operations will be further repeated.

The data register 32A has a plurality of 8-bits registers, wherein the number of the 8-bits registers is equal to multiplication of the pixel number by 8. The data register 32A receives parallel inputs of the A-port image data for the three primary colors and further parallel inputs of the B-port image data for the three primary colors. The shifted timing signals are also supplied from the multiple stages in the shift register 31A into the data register 32A sequentially, so that the received A-port and B-port image data are stored sequentially into corresponding 8-bits registers for every inputs of the timing signals.

The data latch 33A receives the input of the data latch pulse and another input of the polarity signal. The data latch pulse is inputted into the data latch 33A after the image data for a single line is set into the data register of the source driver. The data latch 33A operates to latch the data stored in the data register 32A upon input of the data latch pulse.

After the data latch 33A latches the data, then the level shifter 34A performs level shifts to the output data from the data latch. The digital-to-analog converter 35A receives an input of the output gray scale reference voltage as a power. The digital-to-analog converter 35A also receives the level-shifted digital data from the level shifter 34A, and the digital-to-analog converter 35A performs the digital-to-analog conversion of the level-shifted digital data into the analog image signals as the gray scale voltage.

The output buffer 36A supplies the gray-scale voltage to the source line in synchronization with the data latch pulse. At this time, upon receipt of the data latch pulse, the shifter register is reset for the next data register. In order to avoid application of the gray-scale voltage to the pixel electrode at the fixed polarity, based on the polarity signal, the polarity bit of the data to the data latch is changed for every frame, whereby for every frame, the polarity of the gray-scale voltage is changed.

The operations of the shift register 31A and the data register 32A are continued with the next start signal of the follower source driver. Each of the sequential operations from the data latch 33A in the single line unit to the output buffer 36A are carried out for the all source drivers concurrently. The display operation for the single source line is also carried out for the all source drivers concurrently.

In the above descriptions, the first and second clock signals are used so that the rising edges are trigger edges. It is also possible that only the single clock signal is generated so that the rising and falling edges are used as trigger edges.

Figure 14A:
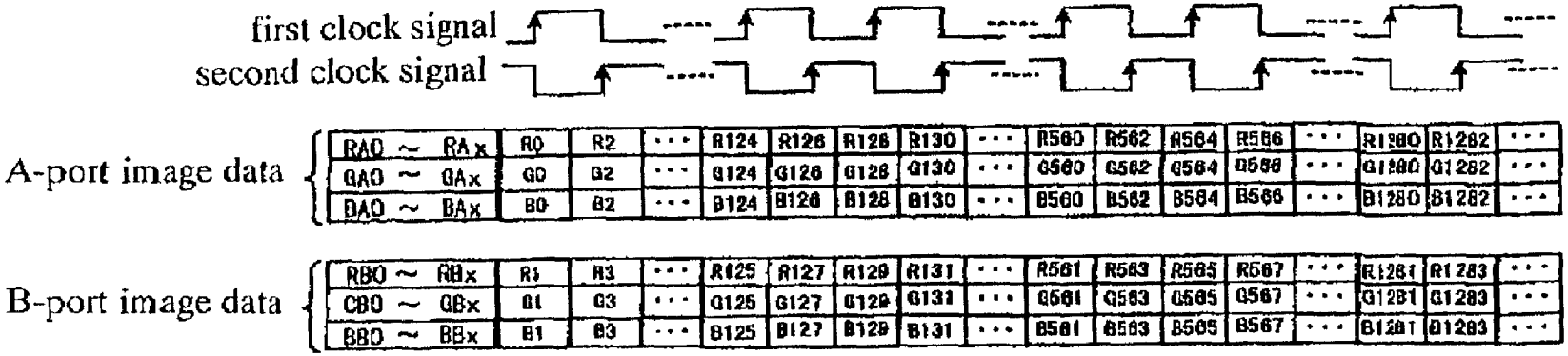
FIG. 14A is a timing chart showing first and second clock signals and A-port image data and B-port image data, wherein the rising edges of the first and second clock signals are used as trigger edges.

FIG. 14A is a timing chart showing first and second clock signals and A-port image data and B-port image data, wherein the rising edges of the first and second clock signals are used as trigger edges.

The A-port image data comprise the even number image data which further include the primary three color image data, for example, red, green and blue colors. "RA0" - - - "RAx" represent the red color data of plural bits which are to be inputted into the A-port. "GA0" - - - "GAx" represent the green color data of plural bits which are to be inputted into the A-port. "BA0" - - - "BAx" represent the blue color data of plural bits which are to be inputted into the A-port.

The B-port image data comprise the odd number image data which further include the primary three color image data, for example, red, green and blue colors. "RB0" - - - "RBx" represent the red color data of plural bits which are to be inputted into the B-port. "GB0" - - - "GBx" represent the green color data of plural bits which are to be inputted into the B-port. "BB0" - - - "BBx" represent the blue color data of plural bits which are to be inputted into the B-port.

"R0", - - - "R1283", "G0", - - - "G1283", and "B0", - - - "B1283" are the same as shown in FIG. 13.

Figure 14B:
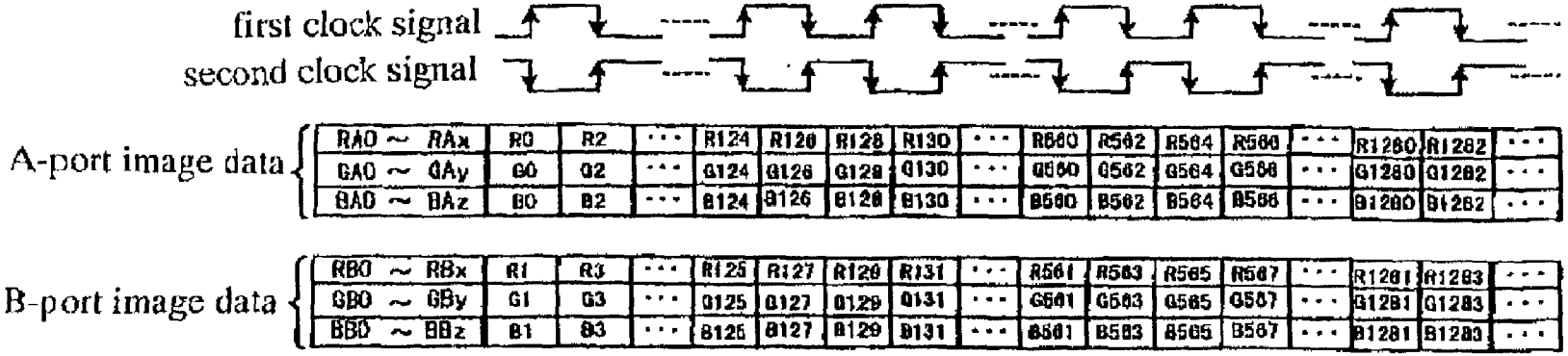
FIG. 14B is a timing chart showing first and second clock signals and A-port image data and B-port image data, wherein the rising and falling edges of the first and second clock signals are used as trigger edges.

FIG. 14B is a timing chart showing first and second clock signals and A-port image data and B-port image data, wherein the rising and falling edges of the first and second clock signals are used as trigger edges.

In this embodiment, the two clock signals, for example, the first and second clock signals are used to reduce fan-out of the clock generator for allowing the circuit to exhibit high speed performance. It is, however, possible that the single clock signal may be used for the reasons as described above.

The A-port image data comprise the even number image data which further include the primary three color image data, for example, red, green and blue colors. "RA0" - - - "RAx" represent the red color data of plural bits which are to be inputted into the A-port. "GA0" - - - "GAy" represent the green color data of plural bits which are to be inputted into the A-port. "BA0" - - - "BAz" represent the blue color data of plural bits which are to be inputted into the A-port.

The B-port image data comprise the odd number image data which further include the primary three color image data, for example, red, green and blue colors. "RB0" - - - "RBx" represent the red color data of plural bits which are to be inputted into the B-port. "GB0" - - - "GBy" represent the green color data of plural bits which are to be inputted into the B-port. "BB0" - - - "BBz" represent the blue color data of plural bits which are to be inputted into the B-port.

"R0" - - - "R1283", "G0", - - - "G1283", and "B0", - - - "B1283" are the same as shown in FIG. 13.

In accordance with this embodiment, the image data to be supplied to the source drivers comprise two system image data, for example, even number image data and odd number image data. The clock signals are used for providing the timings of the input of the image data into the source driver. The clock signals have a cyclic frequency which is equal to a half of the data rate of the two system image data. The clock signals with the reduced cyclic frequency is used and the necessary time margin can be ensured, whereby the reduction of the electromagnetic interference and the ultra high definition liquid crystal display can be obtained.

In this embodiment, the image data comprise two-system image data having the data rate which is a half of the data rate of the image data. The clock signals have the cyclic frequency which is equal to a quarter of the data rate of the image data or equal to a half of the of the half data rate of the two system image data. The two-system image data with the clock signals reduced in the cyclic frequency are supplied to the source drivers, so that the source drivers operate to incorporate the two-system image data at the timings of at least one of the rising and falling edges of the clock signals.

In general, the image data comprise plural-system image data of "2J"-systems having the data rate "I/2" which is a half of the data rate "I" of the image data, where J is a positive integer. The clock signals have the cyclic frequency "I/4" which is equal to a quarter of the data rate "I" of the image data or equal to a half of the of the half data rate "I/2" of the plural-system image data of the "2J"-systems. The plural-system image data with the clock signals reduced in the cyclic frequency are supplied to the source drivers, so that the source drivers operate to incorporate the plural-system image data at the timings of at least one of the rising and falling edges of the clock signals. The single-system or plural-system clock signals with the reduced cyclic frequency are used and the necessary time margin can be ensured, whereby the reduction of the electromagnetic interference and the ultra high definition liquid crystal display can he obtained.

Figure 15:
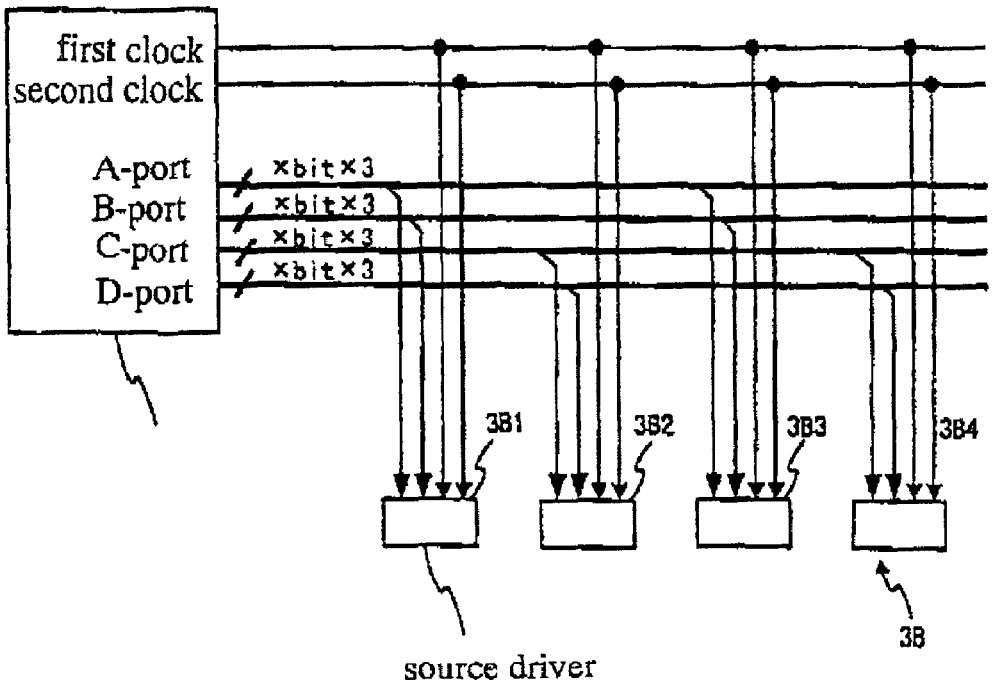
FIG. 15 is a fragmentary block diagram illustrative of a novel circuit configuration including a timing controller and source drivers in a second embodiment in accordance with the present invention.
Figure 16:
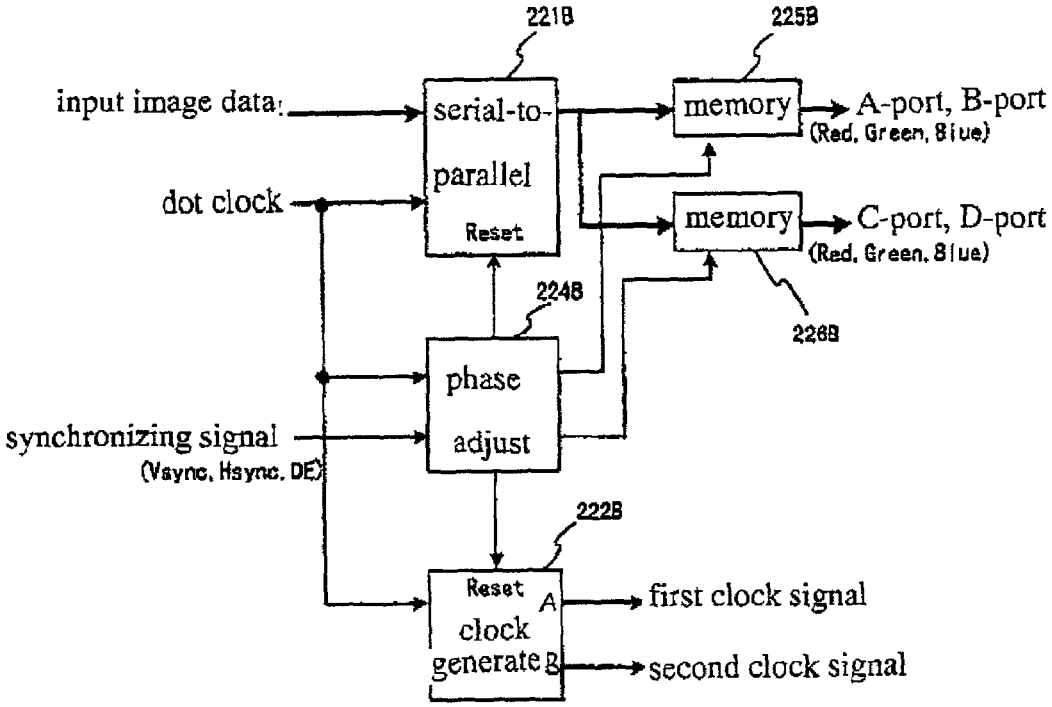
FIG. 16 is a block diagram illustrative of the timing controller shown in FIG. 15.
Figure 17:
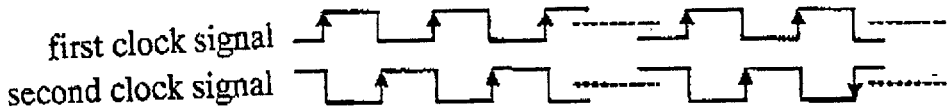
FIG. 17 is a timing chart illustrative of contents of image data to be supplied in synchronization with first and second clock signals from the timing controller to the source drivers in FIG. 15.
Figure 18:
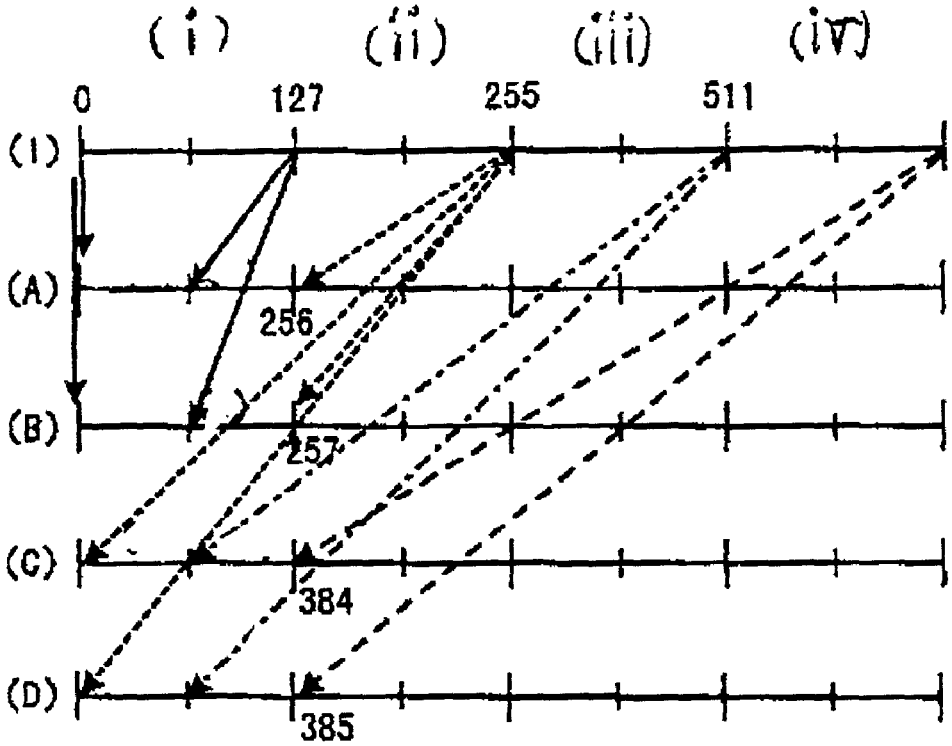
FIG. 18 is a diagram illustrative of data structures of A-port data, B-port data, C-port data and D-port data shown in FIG. 16.

Second Embodiment:

A second embodiment according to the present invention will be described in detail with reference to the drawings. FIG. 15 is a fragmentary block diagram illustrative of a novel circuit configuration including a timing controller and source drivers in a second embodiment in accordance with the present invention. FIG. 16 is a block diagram illustrative of the timing controller shown in FIG. 15. FIG. 17 is a timing chart illustrative of contents of image data to be supplied in synchronization with first and second clock signals from the timing controller to the source drivers in FIG. 15. FIG. 18 is a diagram illustrative of data structures of A-port data, B-port data, C-port data1 and D-port data shown in FIG. 16.

In this second embodiment, the image data are converted into four-system image data. The first and second clock signals have a cyclic frequency which is equal to a half of the data rate of the four-system image data. The source drivers incorporate the four-system image data at the timings of the first and second clock signals.

The timing controller 22-B has a first clock port "CLOCK-1", from which a first source driver clock signal is supplied to all of source drivers 3B1, 3B2, 3B3, - - - . The timing controller 22-B has a second clock port "CLOCK-2", from which a second source driver clock signal is supplied to the all source drivers 3B1, 3B2, 3B3, - - - . The second source driver clock signal is delayed by a half cycle from the first source driver clock signal, so that the second source driver clock signal is opposite in phase to the first source driver clock signal.

The timing controller 22-B also has a first data port "PORT-A", from which A-port image data are supplied to the source drivers 3B1, 3B3, - - - on the odd number stage. The timing controller 22-B also has a second data port "PORT-B", from which B-port image data are supplied to the source drivers 3B1, 3B3, - - - on the odd number stage. The timing controller 22-B also has a third data port "PORT-C", from which C-port image data are supplied to the source drivers 3B2, 3B4, - - - on the even number stage. The timing controller 22-B also has a fourth data port "PORT-D", from which D-port image data are supplied to the source drivers 3B2, 3B4, - - - on the even number stage.

As described above, the image data are converted into four-system image data, for example, the A-port image data, the B-port image data, the C-port image data and the D-port image data. The A-port image data and the B-port image data are supplied to odd number source drivers 3B1, 3B3, - - - on odd number stages. The C-port image data and the D-port image data are supplied to even number source drivers 3B2, 3B4, - - - on even number stages, Adjacent two of the source drivers incorporate the two-system image data, for example, the even number and odd number image data.

As shown in FIG. 16, the timing controller 22B may comprise a serial-to-parallel converter block 221B, a clock signal generator circuit 222B, a phase adjuster/memory controller circuit 224B, a first memory 225B1 and a second memory 226B. The serial-to-parallel converter block 221B receives an input of the image data and an input of a dot-clock signal of a data rate of the image data. The phase adjuster/memory controller circuit 224B receives an input of the dot-clock signal and an input of synchronization signals Vsync, Hsync, and DE. The clock signal generator circuit 222B is electrically coupled to the phase adjuster/memory controller circuit 224B for receiving an input of a reset signal from the phase adjuster/memory controller circuit 224B. The serial-to-parallel converter block 221B is also electrically coupled to the phase adjuster/memory controller circuit 22413 for receiving an input of a reset signal from the phase adjuster/memory controller circuit 224B. The clock signal generator circuit 222B receives the dot-clock signal and generates the first and second clock signals.

The first memory 225B is electrically coupled to the serial-to-parallel converter block 221B for receiving the A-port image data and the B-port image data from the serial-to-parallel converter block 221B, so that the first memory 225B stores the A-port image data and the B-port image data, wherein each of the A-port image data and the B-port image data include three primary color image data for red, green and blue. The first memory 225B is electrically coupled to the phase adjuster/memory controller circuit 224B for receiving a first memory control signal from the phase adjuster/memory controller circuit 224B.

The second memory 226B is electrically coupled to the serial-to-parallel converter block 221B for receiving the C-port image data and the D-port image data from the serial-to-parallel converter block 221B, so that the second memory 226B stores the C-port image data and the D-port image data, wherein each of the C-port image data and the D-port image data include three primary color image data for red, green and blue. The second memory 226B is electrically coupled to the phase adjuster/memory controller circuit 224B for receiving a second memory control signal from the phase adjuster/memory controller circuit 224B.

Namely, the A-port image data and the B-port image data are read out from the first memory 225B and supplied to the source drivers as the two-system image data which comprise the A-port image data and the B-port image data. The C-port image data and the D-port image data are read out from the second memory 226B and supplied to the source drivers as the other two-system image data which comprise the C-port image data and the D-port image data.

The clock signal generator circuit 222B receives the dot-clock signal of the data rate of the image data. The clock signal generator circuit 222B also receives the reset signal from the phase adjuster/memory controller circuit 224B. The clock signal generator circuit 222B generates the first and second clock signals from two parallel ports, for example, A-port and B-port. The first and second clock signals are opposite in phase.

As shown in FIG. 17, the four system image data include first odd-and-even two system image data for the adjacent two source drivers 3B1 and 3B2 and second odd-and-even two system image data for the following adjacent two source drivers 3B3 and 3B4 on the follower stages to the source drivers 3B1 and 3B2.

The A-port image data comprise the even number image data, which are supplied to the source drivers on the even number stages, wherein the even number image data further include the primary three color image data, for example, red, green and blue colors. "RA0" - - - "RAx" represent the red color data of plural bits which are to be inputted into the A-port. "GA0" - - - "GAx" represent the green color data of plural bits which are to be inputted into the A-port. "BA0" - - - "BAx" represent the blue color data of plural bits which are to be inputted into the A-port.

The B-port image data comprise the even number image data, which are supplied to the source drivers on the even number stages, wherein the even number image data further include the primary throe color image data, for example, red, green and blue colors. "RB0" - - - "RBx" represent the red color data of plural bits which are to he inputted into the B-port. "GB0" - - - "GBx" represent the green color data of plural bits which are to be inputted into the B-port. "BB03" - - - "BBx" represent the blue color data of plural bits which are to be inputted into the B-port.

The C-port image data comprise the odd number image data, which are supplied to the source drivers on the odd number stages, wherein the odd number image data further include the primary three color image data, for example, red, green and blue colors. "RC0" - - - "RCx" represent the red color data of plural bits which are to be inputted into the C-port. "GC0" - - - "G Cx" represent the green color data of plural bits which are to be inputted into the C-port. "BC0" - - - "BCx" represent the blue color data of plural bits which are to be inputted into the C-port.

The D-port image data comprise the odd number image data, which are supplied to the source drivers on the odd number stages, wherein the odd number image data further include the primary three color image data, for example, red, green and blue colors. "RD0" - - - "RDx" represent the red color data of plural bits which are to be inputted into the D-port. "GD0" - - - "GDBx" represent the green color data of plural bits which are to be inputted into the D-port. "BD0" - - - "BDx" represent the blue color data of plural bits which are to be inputted into the D-port.

With reference to FIG. 18, four data (i), (ii), (iii) and (iv) of the image data with the data rate "I" are converted into the data (i) as the even number data for the A-port, the data (ii) as the odd number data for the B-port, the data (iii) as the even number data for the C-port, and the data (iv) as the odd number data for the D-port.

In accordance with this embodiment, the image data to be supplied to the source drivers comprise four system image data. The clock signals are used for providing the timings of the input of the image data into the source driver. The clock signals have a cyclic frequency which is equal to a half of the data rate of the four system image data. The clock signals with the reduced cyclic frequency is used and the necessary time margin can be ensured, whereby the reduction of the electromagnetic interference and the ultra high definition liquid crystal display can be obtained.

In this embodiment, the image data comprise four-system image data having the data rate which is a half of the data rate of the image data. The clock signals have the cyclic frequency which is equal to a quarter of the data rate of the image data or equal to a half of the of the half data rate of the four system image data. The four-system image data with the clock signals reduced in the cyclic frequency are supplied to the source drivers, so that the source drivers operate to incorporate the four-system image data at the timings of at least one of the rising and falling edges of the clock signals.

In general, the image data comprise plural-system image data of "4J"-systems having the data rate "I/2" which is a half of the data rate "I" of the image data, where J is a positive integer. The clock signals have the cyclic frequency "I/4" which is equal to a quarter of the data rate "I" of the image data or equal to a half of the of the half data rate "I/2" of the plural-system image data of the "4J"-systems. The plural-system image data with the clock signals reduced in the cyclic frequency are supplied to the source drivers, so that the source drivers operate to incorporate the plural-system image data at the timings of at least one of the rising and falling edges of the clock signals. The single-system or plural-system clock signals with the reduced cyclic frequency are used and the necessary time margin can be ensured, whereby the reduction of the electromagnetic interference and the ultra high definition liquid crystal display can be obtained.

Figure 19:
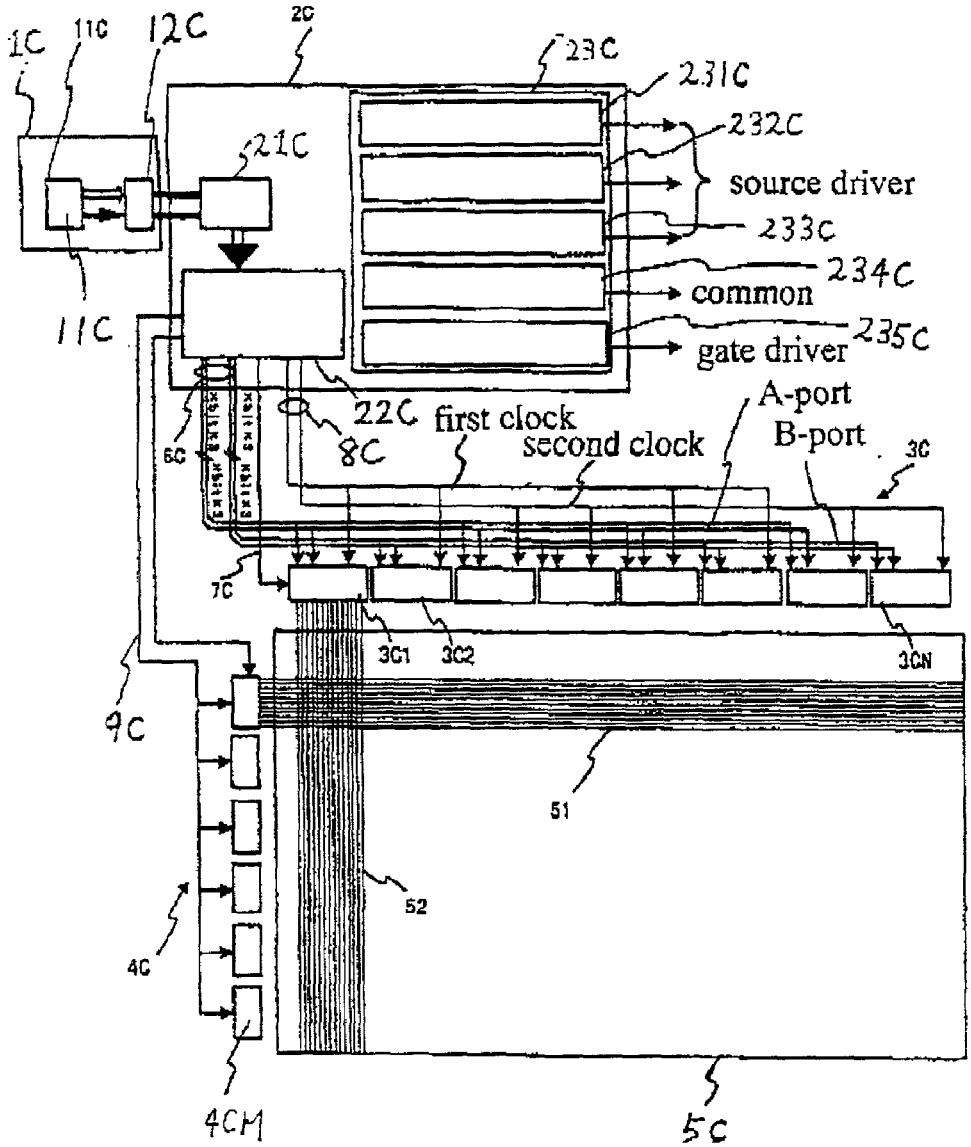
FIG. 19 is a block diagram illustrative of a novel driver circuit for driving a liquid crystal display in a third embodiment in accordance with the present invention.

Third Embodiment:

A third embodiment according to the present invention will be described in detail with reference to the drawings, FIG. 19 is a block diagram illustrative of a novel driver circuit for driving a liquid crystal display in a third embodiment in accordance with the present invention. The liquid crystal display device includes a display panel and a driver circuit having the following circuit configuration. In this third embodiment, the image data are converted into four-system image data. The first and second clock signals have a cyclic frequency which is equal to a half of the data rate of the four-system image data. The source drivers incorporate the four-system image data at the timings of the first and second clock signals.

The display panel 5C has a two-dimensional array of pixels, each of which includes a pixel electrode and a thin film transistor. The display panel 5C also has a plurality of gate signal lines 51 extending in a row direction and a plurality of source signal lines 52 extending in a column direction. The thin film transistor has a gate electrode connected to the gate signal line 51, a source electrode connected to the source signal line 52 and a drain electrode connected to the pixel electrode.

The display panel SC includes a glass substrate, a plurality of source lines extending in parallel to a row direction, a plurality of gate lines extending in parallel to a column direction, a matrix array of pixel electrodes at crossing points of the source lines and the gate lines, a matrix array of thin film transistors, a common electrode and liquid crystal cells between the pixel electrodes and the common electrode. Each of the thin film transistors has a drain connected to the source line, a gate electrode connected to the gate line, and a source connected to the pixel electrode. The gate line is driven to place the thin firm transistor into ON-state, whereby the gray scale voltage generated by the source driver 3C and transmitted on the source line 52 is supplied through the thin film transistor to the pixel electrode, so that the pixel electrode has the gray scale voltage. The common electrode is fixed in potential at a predetermined level, for example, a ground level. A potential difference between the pixel electrode and the common electrode depends on the gray scale voltage.

The driver circuit includes a row alignment of plural source drivers 3C and a column alignment of plural gate drivers 4C. The number of the source drivers 3C is "N", whilst the number of the gate drivers 4C is "M". Each of the source drivers 3C is connected to a plurality of the source signal lines 52 for driving the source signal lines 52. Each of the gate drivers 4C is connected to a plurality of the gate signal lines 51 for driving the gate signal lines 51.

The driver circuit is connected to a computer which includes a circuit 1C including a graphic controller 11C and a transmitter 12C. The driver circuit also includes an interface board 2C. On the interface board 2C, a receiver unit 21C, a timing control circuit 22C and a power supply circuit 23C are provided. The timing control circuit 22C supplies each of the plural source drivers 3C with image data 60C, a start signal 7C and clock signals 8C. The timing control circuit 22C also supplies each of the gate drivers 4C with a clock signal 9C and a frame start signal 10C.

The graphic controller 11C outputs control signals 13C and image data 14C, both of which are then transmitted through the transmitter 12C to the receiver unit 21C. The control signals 13C include timing control signals. The timing control signals may for example, be a clock signal, a horizontal synchronous signal, and a vertical synchronous signal.

The receiver unit 21C receives the timing control signals and the image data from the graphic controller 11C. The timing control signals and the image data are then supplied to the timing control circuit 22C. The image data 14C and the timing control signals 13C are supplied in parallel-transmission from the graphic controller 11C to the transmitter 12C. The transmitter 12C performs a parallel-to-serial conversion of the image data 14C and the timing control signals 13C, so that the image data 14C and the timing control signals 13C are supplied in serial-transmission from the transmitter 12C to the receiver unit 210. The serial data including the image data and the timing control signals may be transmitted in any available transmission system such as a low voltage differential signaling (LVDS), a transmission minimized differential signaling (TMDS), a gigabit video interface (GVIF) and a low voltage differential signaling display interface (LDI).

The receiver unit 21C performs a serial-to-parallel conversion of the image data and the timing control signals, so that the image data and the timing control signals are supplied in parallel-transmission from the receiver unit 21C to the timing control circuit 22C. The timing control circuit 22C generates the image data 6C, the start signal 7C, the clock signals 8C, the clock signal 9C and the frame start signal 10C. The image data 6C, the start signal 7C and the clock signals 8C are supplied to each of the source drivers 3C. The clock signal 9C and the frame start signal 10C arc supplied to each of the gate drivers 4C.

The power supply circuit 23C is integrated in the interface board 2C. The power supply circuit 23C includes a source voltage generating circuit 231C for generating a source driver driving voltage to the source driver 3C, positive and negative voltage generating circuits 232C and 233C for generating a pixel electrode driving voltage to the pixel electrode, a common electrode voltage generating circuit 234C for generating a common electrode driving voltage to the common electrode, and a gate voltage generating circuit 235C for generating a gate driving voltage to the gate driver circuit 4C.

The source voltage generating circuit 231C generates independent voltages necessary for digital and an analog circuits in the source driver 3C. The source voltage generating circuit 231C has two output lines, from which the independent voltages are supplied to the digital and analog circuits in the source driver 3C.

The positive and negative voltage generating circuits 232C and 233C generate output gray scale reference voltages which are to be supplied to a digital-to-analog converter in the source driver 3C. Each of the positive and negative voltage generating circuits 232C and 233C has plural output lines, from which output gray scale reference voltages with different voltage levels are supplied.

The common electrode voltage generating circuit 234C generates a DC voltage which is to be supplied to the common electrode of the liquid crystal panel 5C. The gate voltage generating circuit 235C generates separate power voltages necessary for a digital circuit, a high voltage logic circuit and a low voltage logic circuit included in the gate driver 4C. The gate voltage generating circuit 235C has three output lines, from which the separate power voltages are supplied to the digital circuit, the high voltage logic circuit and the low voltage logic circuit included in the gate driver 4C.

The functions of the timing controller 22C and the source driver 3C are as follows. The timing controller 22C may be integrated in a semiconductor integrated circuit (LSI) which receive various display timing signals, for example, a clock signal, a display timing signal, a horizontal synchronization signal, and a vertical synchronization signal, wherein the display timing signals have been supplied from the graphic controller 11C through the transmitter 12C and the receiver circuit 21C to the timing controller 22C. The timing controller 22C drives the plural source drivers 3C and the plural gate drivers 4C based on the display timing signals and display data.

As shown in FIG. 19, the timing controller 22C may be integrated solely in the semiconductor integrated circuit (LSI). It is, of course, possible as a modification that the timing controller 22C and the receiver circuit 21C are integrated together in the semiconductor integrated circuit (LSI). The following descriptions will be made assuming that the serial-to-parallel converter circuit of the receiver circuit 21C is a part of the configuration of the timing controller.

The source drivers 3C comprise a row alignment of source drivers 3C1, 3C2, 3C3, - - - , 3CN. Upon input of the start signal 7C, the source drivers 3*d*, 3C2, 3C3, - - - , 3CN are serial operations from the source driver 3C1 to the source driver 3CN. Each of the source drivers 3C1, 3C2, 3C3, - - - , 3CN outputs image data concurrently to the source lines which number is equal to pixel number/N, wherein the pixel number is the number of the pixels on each line. Each of the source drivers 3C receives the image data 6C, the start signal 7C1 and the clock signal 8C from the timing controller 22C, so that each of the source drivers 3C operates to latch the image data 6C into an internal register thereof at the timing of the clock signal 8C and performs a digital-to-analog conversion of the image data prior to supply of the image signal to the source signal lines 52.

The gate drivers 4C comprise a column alignment of gate drivers 4C1, 4C, 4C3, - - - 4CM. Upon input of the frame start signal 10C and the gate driver clock signal 9C, the gate drivers 4C1, 4C2, 4C3, - - - 4CM are serial operations from the gate driver 4C1 to the gate diver 4CM. Each of the gate drivers 4C1, 4C2, 4C3 - - - 4CM outputs scanning signals which are to be applied to the gate lines, wherein the number of the scanning signals is equal to line number /M.

The voltage corresponding to the image, data for each pixel is applied to the source line which is connected through the thin film transistor to the pixel electrode of the target pixel. The scanning signal is applied to the gate line which is connected to the gate of the thin film transistor, whereby the thin film transistor is placed into the ON-state, and the voltage corresponding to the image data is applied to the pixel electrode of the target pixel. This write operation is carried out in serial operation in the row direction from the left side to the right side in the drawing in the unit of the source drivers, and further the scanning operation in the unit of the serial operation is then carried out in the column direction from the top to the bottom in the drawing in the unit of the gate lines. Each of the pixel electrodes has the respective potential corresponding to the image data, whereby each pixel has a respective field applied to the liquid crystal, wherein the intensity of the respective field depends on the voltage level corresponding to the image data. The light transmittivity of the liquid crystal depends on the intensity of the respective field, whereby the display can be obtained in accordance with the image data.

Figure 20:
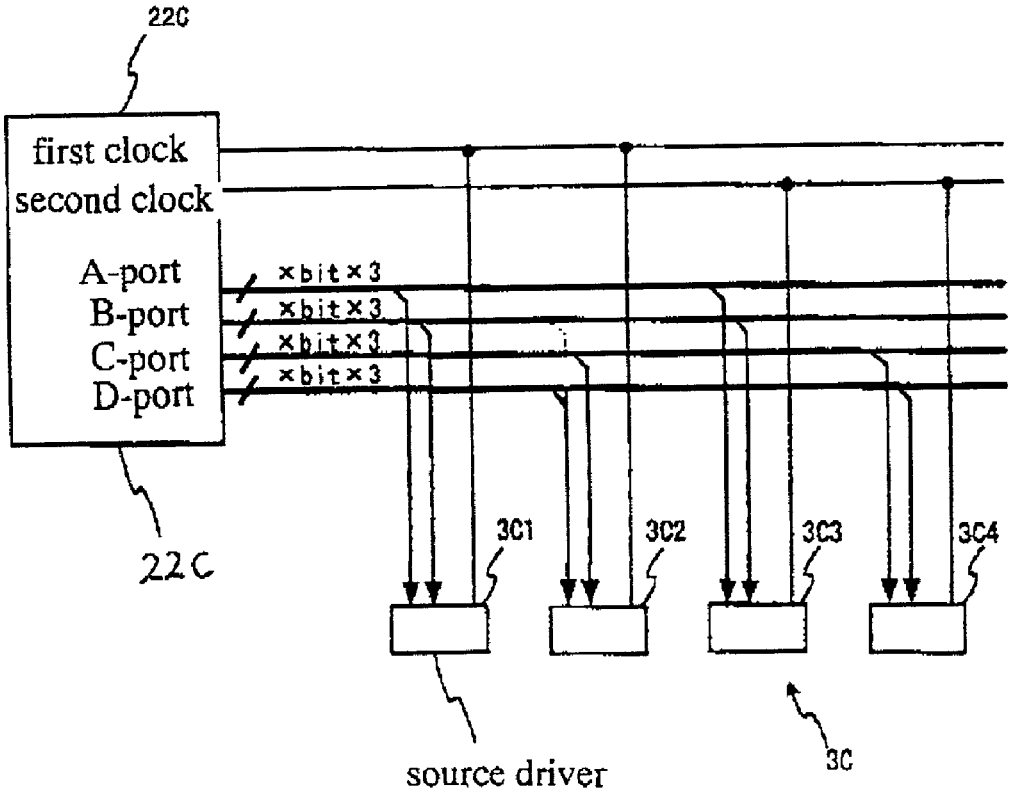
FIG. 20 is a fragmentary block diagram illustrative of a novel circuit configuration including a timing controller and source drivers in a third embodiment in accordance with the present invention.

FIG. 20 is a fragmentary block diagram illustrative of a novel circuit configuration including a timing controller and source drivers in a third embodiment in accordance with the present invention.

The timing controller 22-C has a first clock port "CLOCK-1", from which a first source driver clock signal is supplied to every first and second ones of source drivers 3C1, 3C2, 3C3 and 3C4, - - - in a cyclic unit of adjacent four source drivers 3C1, 3C2, 3C3 and 3C4. The timing controller 22-C has a second clock port "CLOCK-2", from which a second source driver clock signal is supplied to every third and fourth ones of source drivers 3C1, 3C2, 3C3, - - - in the cyclic unit of adjacent four source drivers 3C1, 3C2, 3C3 and 3C4. The second source driver clock signal is delayed by a half cycle from the first source driver clock signal, so that the second source driver clock signal is opposite in phase to the first source driver clock signal.

The timing controller 22-C also has a first data port "PORT-A", from which A-port image data are supplied to the source driver 3C1, 3C3, - - - on the odd number stage. The timing controller 22-C also has a second data port "PORT-B", from which B-port image data are supplied to the source drivers 3C1, 3C3, - - - on the odd number stage. The timing controller 22-C also has a third data port "PORT-C", from which C-port image data are supplied to the source drivers 3C2, 3C4, - - - on the even number stage. The timing controller 22-C also has a fourth data port "PORT-D", from which D-port image data are supplied to the source drivers 3C2, 3C4 - - - on the even number stage.

Figure 21:
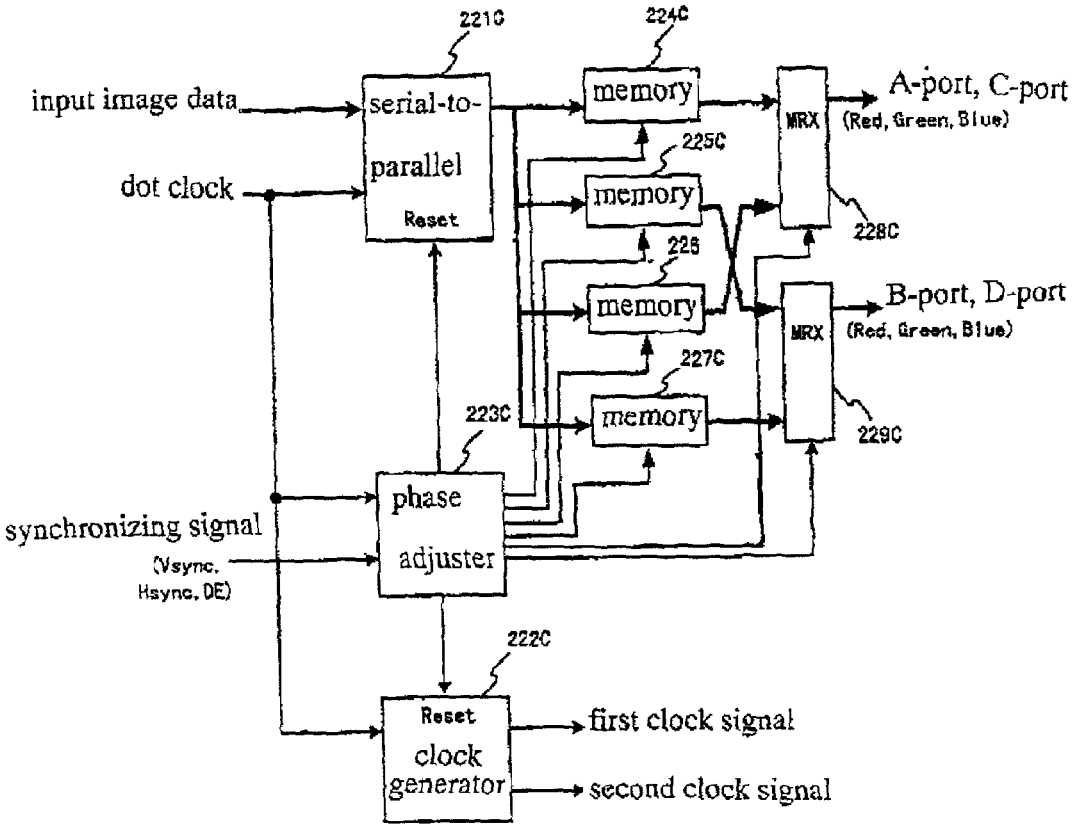
FIG. 21 is a block diagram illustrative of the timing controller shown in FIG. 20.

As described above, the image data are converted into four-system image data, for example, the A-port image data, the B-port image data, the C-port image data and the D-port image data. The A-port image data and the B-port image data are supplied to odd number source drivers 3C1, 3C3, - - - on odd number stages. The C-port image data and the D-port image data are supplied to even number source drivers 3C2, 3C4, - - - on even number stages. Adjacent two of the source drivers incorporate the four system image data, for example, the even number and odd number image data. FIG. 21 is a block diagram illustrative of the timing controller shown in FIG. 20.

As shown in FIG, 21, the timing controller 22C may comprise a serial-to-parallel converter block 221C, a clock signal generator circuit 222C, a phase adjuster/memory controller circuit 223C, a first memory 224C, a second memory 225C, a third memory 226C, a fourth memory 227C, a first multiplexer 228C and a second multiplexer 229D.

The serial-to-parallel converter block 221C receives an input of the image data and an input of a dot-clock signal of a data rate of the image data. The phase adjuster/memory controller circuit 223C receives an input of the dot-clock signal and an input of synchronization signals Vsync, Hsync, and DE. The clock signal generator circuit 222C is electrically coupled to the phase adjuster/memory controller circuit 223C for receiving an input of a reset signal from the phase adjuster/memory controller circuit 223C. The serial-to-parallel converter block 221C is also electrically coupled to the phase adjuster/memory controller circuit 223C for receiving an input of a reset signal from the phase adjuster/memory controller circuit 223C. The clock signal generator circuit 222C receives the dot-clock signal and generates the first and second clock signals.

The first memory 224C is electrically coupled to the serial-to-parallel converter block 221C for receiving the A-port image data from the serial-to-parallel converter block 221C, so that the first memory 224C stores the A-port image data, wherein the A-port image data include three primary color image data for red, green and blue. The first memory 224C is electrically coupled to the phase adjuster/memory controller circuit 223C for receiving a first memory control signal from the phase adjuster/memory controller circuit 223C.

The second memory 225C is electrically coupled to the serial-to-parallel converter block 221C for receiving the B-port image data from the serial-to-parallel converter block 221C, so that the second memory 225C stores the B-port image data, wherein the B-port image data include three primary color image data for red, green and blue. The second memory 225C is, electrically coupled to the phase adjuster/memory controller circuit 223C for receiving a second memory control signal from the phase adjuster/memory controller circuit 223C.

The third memory 226C is electrically coupled to the serial-to-parallel converter block 221 C for receiving the C-port image data from the serial-to-parallel converter block 221C, so that the third memory 226C stores the C-port image data, wherein the C-port image data include three primary color image data for red, green and blue. The third memory 226C is electrically coupled to the phase adjuster/memory controller circuit 223C for receiving a third memory control signal from the phase adjuster/memory controller circuit 223C.

The fourth memory 227C is electrically coupled to the serial-to-parallel converter block 221C for receiving the D-port image data from the serial-to-parallel converter block 221C, so that the fourth memory 227C stores the D-port image data, wherein the D-port image data include three primary color image data for red, green and blue, The fourth memory 227C is electrically coupled to the phase adjuster/memory controller circuit 223C for receiving a fourth memory control signal from the phase adjuster/memory controller circuit 223C.

The first multiplexer 228C is electrically coupled to the phase adjuster/memory controller circuit 223C for receiving a first multiplexer control signal from the phase adjuster/memory controller circuit 223C. The first multiplexer 228C is electrically coupled to the first memory 224C and the third memory 226C for receiving the A-port image data and the C-port image data from the first memory 224C and the third memory 226C respectively, so that the first multiplexer 228C performs a time-division multiplexing operation of the A-port image data and the C-port image data under the control in accordance with the first multiplexer control signal.

The second multiplexer 229C is electrically coupled to the phase adjuster/memory controller circuit 223C for receiving a second multiplexer control signal from the phase adjuster/memory controller circuit 223C. The second multiplexer 229C is electrically coupled to the second memory 225C and the fourth memory 227C for receiving the B-port image data and the D-port image data from the second memory 225C and the fourth memory 227C respectively, so that the second multiplexer 229C performs another time-division multiplexing operation of the B-port image data and the D-port image data under the control in accordance with the second multiplexer control signal.

Figure 24:
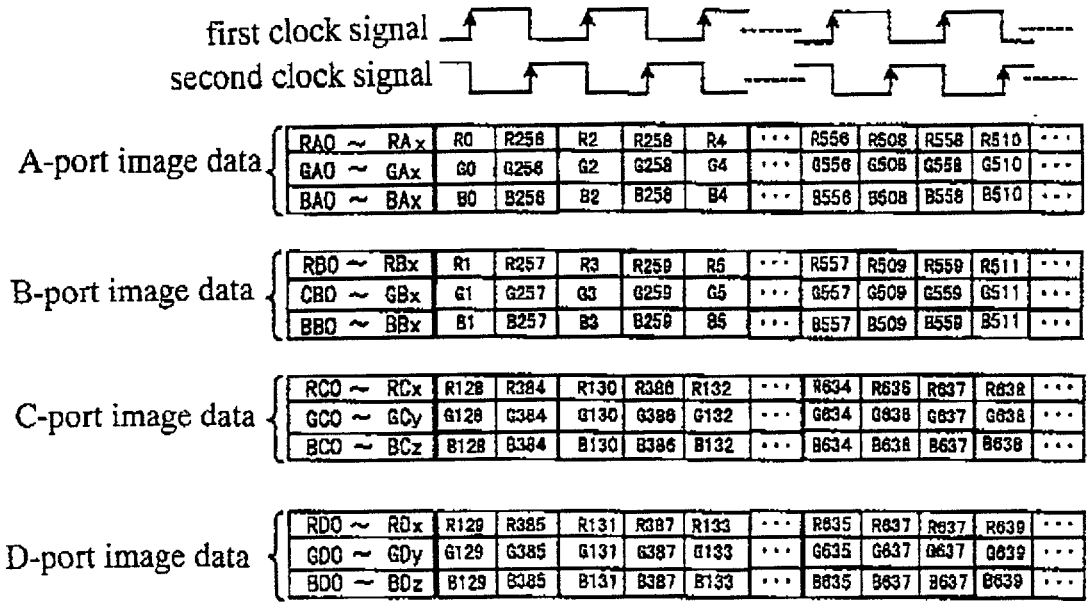
FIG. 24 is a timing chart showing first and second clock signals and A-port image data, B-port image data, C-port image data, and D-port image data, wherein the rising edges of the first and second clock signals are used as trigger edges.

The above structures including the first and second multiplexers 228C and 229C prepares a data array as shown in FIG. 24, wherein the first half data and the second half data are multiplexed in a unit of a value obtained by division to the number of the source lines by the number of the source drivers.

Namely, the A-port image data and the C-port image data multiplexed with each other are read out from the first multiplexer 228C and supplied to the source drivers as the two-system image data which comprise the multiplexed A-port and C-port image data. The B-port image data and the D-port image data multiplexed with each other are read out from the second multiplexer 229C and supplied to the source drivers as the two-system image data which comprise the multiplexed B-port and D-port image data.

The clock signal generator circuit 222C receives the dot-clock signal of the data rate of the image data. The clock signal generator circuit 222C also receives the reset signal from the phase adjuster/memory controller circuit 223C. The clock signal generator circuit 222C generates the first and second clock signals from two parallel ports, for example, A-port and B-port. The first and second clock signals are opposite in phase.

Figure 22:
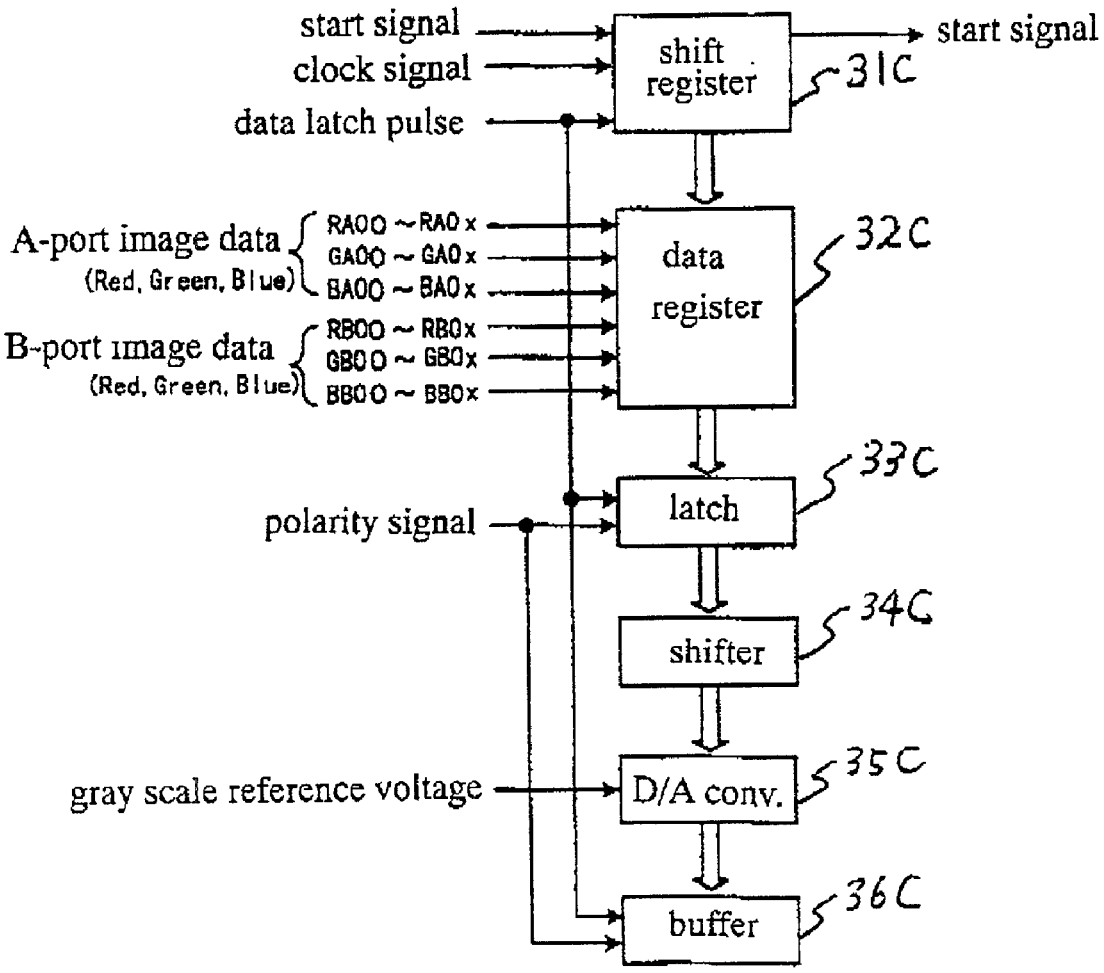
FIG. 22 is a block diagram illustrative of an internal configuration of each of the source drivers shown in FIG. 19.
Figure 23:
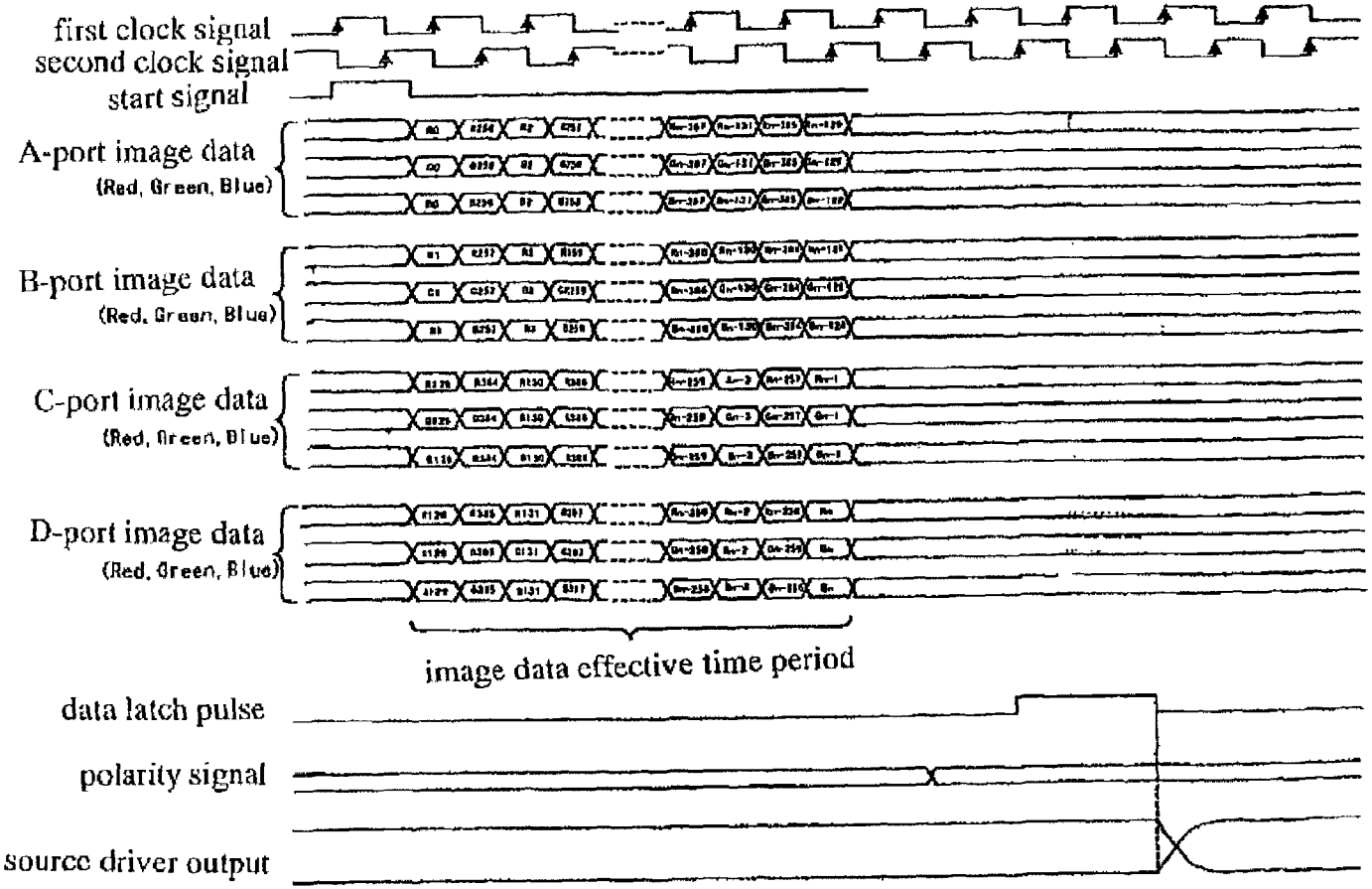
FIG. 23 is a timing chart illustrative of waveforms of various signals to describe operations of the each source driver shown in FIG. 22.

FIG. 22 is a block diagram illustrative of an internal configuration of each of the source drivers shown in FIG. 19. FIG. 23 is a timing chart illustrative of waveforms of various signals to describe operations of the each source driver shown in FIG. 22. FIG. 23 illustrates a waveform of A-port image data for three primary colors outputted from the A-port, a waveform of B-port image data for three primary colors outputted from the B-port , a waveform of C-port image data for three primary colors outputted from the C-port, a waveform of D-port image data for three primary colors outputted from the D-port, and waveforms of first and second clock signals which are opposite to each other in phase of a half cyclic frequency which corresponds to the data rate of the image data. FIG. 23 further illustrates a waveform of a data patch pulse signal, a polarity signal and a source driver output signal which is to be applied to the source line.

The A-port image data are the multiplexed image data. The B-port image data are the multiplexed image data. The C-port image data are the multiplexed image data. The D-port image data are the multiplexed image data. For each of the A-port image data, the B-port image data, "R0", the C-port image data and the D-port image data, "R0", "R0", "R1", "R2" - - - "RN" represent the image data for the red color. "G0", "G1", "G2" - - - "GN" represent the image data for the green color. "B0", "B1", "B2" - - - "BN" represent the image data for the blue color.

The A-port image data comprise the red color image data in every second sequence of even numbers with multiplexing between the first half data and the second half data in data array, the green color image data in every second sequence of even numbers with multiplexing between the first half data and the second half data in data array, and the blue color image data in every second sequence of even numbers with multiplexing between the first half data and the second half data in data array.

The B-port image data comprise the red color image data in every second sequence of odd numbers with multiplexing between the first half data and the second half data in data array, the green color image data in every second sequence of odd numbers with multiplexing between the first half data and the second half data in data array, and the blue color image data in every second sequence of odd numbers with multiplexing between the first half data and the second half data in data array.

The C-port image data comprise the red color image data in every second sequence of even numbers with multiplexing between the first half data and the second half data in data array, the green color image data in every second sequence of even numbers with multiplexing between the first half data and the second half data in data array, and the blue color image data in every second sequence of even numbers with multiplexing between the first half data and the second half data in data array.

The D-port image data comprise the red color image data in every second sequence of odd numbers with multiplexing between the first half data and the second half data in data array, the green color image data in every second sequence of odd numbers with multiplexing between the first half data and the second half data in data array, and the blue color image data in every second sequence of odd numbers with multiplexing between the first half data and the second half data in data array.

With reference to FIG. 22, each of the source drivers 3C comprises a shift register 31C, a data register 32C, a data latch 33C, a level shifter 34C, a digital-to-analog converter 35C, and an output buffer 36G. The shift register 31C receives parallel inputs of the start signal, the first or second clock signal and the data latch pulse signal. The shift register 31C has multiple stages. The start signal is sequentially inputted into the multiple stages in the shift register 31C, wherein each of the stages outputs a shifted signal upon input of the start signal, whereby the multiple stages sequentially output the shifted signals upon sequential inputs of the start signal.

The data register 32C receives parallel inputs of the A-port or C-port image data for the three primary colors and further parallel inputs of the B-port or D-port image data for the three primary colors. The shifted signals are also supplied from the multiple stages in the shift register 31C into the data register 32C sequentially, so that the received A-port and B-port image data or the C-port and D-port image data are stored sequentially into the first registers in the data register 32C.

The data latch 33C receives the input of the data latch pulse and another input of the polarity signal. The data latch 33C operates to latch the data stored in the data register 32C in a single line unit.

The level shifter 34C performs level shifts to the output data from the data latch. The digital-to-analog converter 35C receives an input of the output gray scale reference voltage. The digital-to-analog converter 35C also receives the level-shifted digital data from the level shifter 34C, and the digital-to-analog converter 35C performs the digital-to-analog conversion of the level-shifted digital data into the analog image signals.

The output buffer 36C receives the input of the data latch pulse and another input of the polarity signal. The output buffer 36C also receives the analog image signals from the digital-to-analog converter 35C, and then supplies the analog image signals to the source lines.

FIG. 24 is a timing chart showing first and second clock signals and A-port image data, B-port image data, C-port image data, and D-port image data, wherein the rising edges of the first and second clock signals are used as trigger edges.

The A-port image data comprise the multiplexed even number image data which further include the primary three color image data, for example, red, green and blue colors. "RA0" - - - "RAx" represent the red color data of plural bits which are to be inputted into the A-port. "GA0" - - - "GAx" represent the green color data of plural bits which are to be inputted into the A-port. "BA0" - - - "BAx" represent the blue color data of plural bits which are to be inputted into the A-port.

The B-port image data comprise the multiplexed odd number image data which further include the primary three color image data, for example, red, green and blue colors. "RB0" - - - "RBx" represent the red color data of plural bits which are to be inputted into the B-port. "GB0" - - - "GBx" represent the green color data of plural bits which are to be inputted into the B-port. "BB0" - - - "BBx" represent the blue color data of plural bits which are to be inputted into the B-port.

The C-port image data comprise the multiplexed even number image data which further include the primary three color image data, for example, red, green and blue colors. "RC0" - - - "RCx" represent the red color data of plural bits which are to be inputted into the C-port. "GC0" - - - "GCy" represent the green color data of plural bits which are to he inputted into the C-port. "BC0" - - - "BCz" represent the blue color data of plural bits which are to be inputted into the C-port.

The D-port image data comprise the multiplexed odd number image data which further include the primary three color image data, for example, red, green and blue colors. "RD0" - - - "RDx" represent the red color data of plural bits which are to be inputted into the D-port. "GD0" - - - "GDy" represent the green color data of plural bits which are to be inputted into the D-port "BD0" - - - "BDz" represent the blue color data of plural bits which are to be inputted into the D-port.

In accordance with this embodiment, the image data to be supplied to the source drivers comprise multiplexed four system image data. The clock signals are used for providing the timings of the input of the image data into the source driver. The clock signals have a cyclic frequency which is equal to a half of the data rate of the four system image data. The clock signals with the reduced cyclic frequency is used and the necessary time margin can be ensured, whereby the reduction of the electromagnetic interference and the ultra high definition liquid crystal display can be obtained. The process for multiplexing the image data to be supplied to the source drivers allows further time-compression.

In this embodiment, the image data comprise multiplexed four-system image data having the data rate which is a half of the data rate of the image data. The clock signals have the cyclic frequency which is equal to a quarter of the data rate of the image data or equal to a half of the of the half data rate of the four system image data. The four-system image data with the clock signals reduced in the cyclic frequency are supplied to the source drivers, so that the source drivers operate to incorporate the multiplexed four-system image data at the timings of at least one of the rising and falling edges of the clock signals.

In general, the image data comprise multiplexed plural-system image data of "4J"-systems having the data rate "I/2" which is a half of the data rate "I" of the image data, where J is a positive integer. The clock signals have the cyclic frequency "I/4" which is equal to a quarter of the data rate "I" of the image data or equal to a half of the of the half data rate "I/2" of the multiplexed plural-system image data of the "4J"-systems. The multiplexed plural-system image data with the clock signals reduced in the cyclic frequency are supplied to the source drivers, so that the source drivers operate to incorporate the multiplexed plural-system image data at the timings of at least one of the rising and falling edges of the clock signals. The single-system or plural-system clock signals with the reduced cyclic frequency are used and the necessary time margin can be ensured, whereby the reduction of the electromagnetic interference and the ultra high definition liquid crystal display can be obtained. The process for multiplexing the image data to be supplied to the source drivers allows further time-compression.

Fourth Embodiment:

A fourth embodiment according to the present invention will be described in detail with reference to the drawings. FIG. 25 is a block diagram illustrative of a novel driver circuit for driving a liquid crystal display in a fourth embodiment in accordance with the present invention. The liquid crystal display device includes a display panel and a driver circuit having the following circuit configuration. In this fourth embodiment, the image data are converted into four-system image data. The first and second clock signals have a cyclic frequency which is equal to a half of the data rate of the four-system image data. The source drivers incorporate the four-system image data at the timings of the first and second clock signals.

The display panel 5D has a two-dimensional array of pixels, each of which includes a pixel electrode and a thin film transistor. The display panel 5D also has a plurality of gate signal lines 51 extending in a row direction and a plurality of source signal lines 52 extending in a column direction. The thin film transistor has a gate electrode connected to the gate signal line 51, a source electrode connected to the source signal line 52 and a drain electrode connected to the pixel electrode.

The display panel 5D includes a glass substrate, a plurality of source lines extending in parallel to a row direction, a plurality of gate lines extending in parallel to a column direction, a matrix array of pixel electrodes at crossing points of the source lines and the gate lines, a matrix array of thin film transistors, a common electrode and liquid crystal cells between the pixel electrodes and the common electrode. Each of the thin film transistors has a drain connected to the source line, a gate electrode connected to the gate line, and a source connected to the pixel electrode. The gate line is driven to place the thin film transistor into ON-state, whereby the gray scale voltage generated by the source driver 3D and transmitted on the source line 52 is supplied through the thin film transistor to the pixel electrode, so that the pixel electrode has the gray scale voltage. The common electrode is fixed in potential at a predetermined level, for example, a ground level. A potential difference between the pixel electrode and the common electrode depends on the gray scale voltage.

The driver circuit includes a row alignment of plural source drivers 3D and a column alignment of plural gate drivers 4D. The number of the source drivers 3D is "N", whilst the number of the gate drivers 4D is "M". Each of the source drivers 3D is connected to a plurality of the source signal lines 52 for driving the source signal lines 52. Each of the gate drivers 4D is connected to a plurality of the gate signal lines 51 for driving the gate signal lines 51.

The driver circuit is connected to a computer which includes a circuit 11D including a graphic controller 11D and a transmitter 12D. The driver circuit also includes an interface board 2D. On the interface board 2D, a receiver unit 21D, a tinning control circuit 22D and a power supply circuit 23D are provided. The timing control circuit 22D supplies each of the plural source drivers 3D with image data 6D, a start signal 7D) and clock signals 8D. The timing control circuit 22D also supplies each of the gate drivers 40 with a clock signal 9D and a frame start signal 10D.

The graphic controller 11D outputs control signals 13D and image data 14D, both of which are then transmitted through the transmitter 12D to the receiver unit 21D). The control signals 13D include timing control signals The timing control signals may for example, he a clock signal, a horizontal synchronous signal, and a vertical synchronous signal.

The receiver unit 21D receives the timing control signals and the image data from the graphic controller 11D). The timing control signals and the image data are then supplied to the timing control circuit 22D. The image data 14D and the timing control signals 13D are supplied in parallel-transmission from the graphic controller 11D to the transmitter 12D. The transmitter 12D performs a parallel-to-serial conversion of the image data 14D and the timing control signals 13D, so that the image data 14D and the timing control signals 13D are supplied in serial-transmission from the transmitter 12D to the receiver unit 21D. The serial data including the image data and the timing control signals may be transmitted in any available transmission system such as a low voltage differential signaling (LVDS), a transmission minimized differential signaling (TMDS), a gigabit video interface (GVIF) and a low voltage differential signaling display interface (LDI).

The receiver unit 21D performs a serial-to-parallel conversion of the image data and the timing control signals, so that the image data and the timing control signals are supplied in parallel-transmission from the receiver unit 21D to the timing control circuit 22D. The timing control circuit 22D generates the image data 6D, the start signal 7D, the clock signals 8D, the clock signal 9D and the frame start signal 10D. The image data 6D, the start signal 7D and the clock signals 8D are supplied to each of the source drivers 31. The clock signal 9D and the frame start signal 10D are supplied to each of the gate drivers 4D.

The power supply circuit 23D is integrated in the interface board 2D. The power supply circuit 23D includes a source voltage generating circuit 231D for generating a source driver driving voltage to the source driver 3D, positive and negative voltage generating circuits 232D and 233D for generating a pixel electrode driving voltage to the pixel electrode, a common electrode voltage generating circuit 234D for generating a common electrode driving voltage to the common electrode, and a gate voltage generating circuit 235D for generating a gate driving voltage to the gate driver circuit 4D.

The source voltage generating circuit 231D generates independent voltages necessary for digital and an analog circuits in the source driver 3D. The source voltage generating circuit 231D has two output lines, from which the independent voltages are supplied to the digital and analog circuits in the source driver 3D.

The positive and negative voltage generating circuits 232D and 233D generate output gray scale reference voltages which are to be supplied to a digital-to-analog converter in the source driver 3D. Each of the positive and negative voltage generating circuits 232D and 233D has plural output lines, from which output gray scale reference voltages with different voltage levels are supplied.

The common electrode voltage generating circuit 234D generates a DC voltage which is to be supplied to the common electrode of the liquid crystal panel 5D. She gate voltage generating circuit 235D generates separate power voltages necessary for a digital circuit, a high voltage logic circuit and a low voltage logic circuit included in the gate driver 4D. The gate voltage generating circuit 235D has three output lines, from which the separate power voltages are supplied to the digital circuit, the high voltage logic circuit and the low voltage logic circuit included in the gate driver 4D.

The functions of the timing controller 22D and the source driver 3D are as follows. The timing controller 22D may be integrated in a semiconductor integrated circuit (LSI) which receive various display timing signals, for example, a clock signal, a display timing signal, a horizontal synchronization signal, and a vertical synchronization signal, wherein the display timing signals have been supplied from the graphic controller 11D through the transmitter 12D and the receiver circuit 21D to the timing controller 22D. The timing controller 22D drives the plural source drivers 3D and the plural gate drivers 4D based on the display timing signals and display data.

As shown in FIG. 25, the timing controller 22D may be integrated solely in the semiconductor integrated circuit (LSI). It is, of course, possible as a modification that the timing controller 22D and the receiver circuit 21D are integrated together in the semiconductor integrated circuit (LSI). The following descriptions will be made assuming that the serial-to-parallel converter circuit of the receiver circuit 21D is a part of the configuration of the timing controller.

The source drivers 3D comprise a row alignment of source drivers 3D1, 3D2, 3D3, - - - , 3DN. Upon input of the start signal 7D, the source drivers 3D1, 3D2, 3D3, - - - , 3DN are serial operations from the source driver 3D1 to the source driver 3DN. Each of the source drivers 3D1, 3D2, 3D3, - - - , 3DN outputs image data concurrently to the source lines which number is equal to pixel number/N, wherein the pixel number is the number of the pixels on each line. Each of the source drivers 3D receives the image data 6D, the start signal 7D, and the clock signal 8D from the timing controller 22D, so that each of the source drivers 3D operates to latch the image data 6D into an internal register thereof at the timing of the clock signal 8D and performs a digital-to-analog conversion of the image data prior to supply of the image signal to the source signal lines 52.

The gate drivers 4D comprise a column alignment of gate drivers 4D1, 4D2, 4D3, - - - 4DM. Upon input of the frame start signal 10D and the gate driver clock signal 4D1 the gate drivers 4D1, 492, 4D3, - - - 4DM are serial operations from the gate driver 4D1 to the gate driver 4DM. Each of the gate drivers 4D1, 4D2, 4D3, - - - 4DM outputs scanning signals which are to be applied to the gate lines, wherein the number of the scanning signals is equal to line number /M.

The voltage corresponding to the image data for each pixel is applied to the source line which is connected through the thin film transistor to the pixel electrode of the target pixel. The scanning signal is applied to the gate line which is connected to the gate of the thin film transistor, whereby the thin film transistor is placed into the ON-state, and the voltage corresponding to the image data is applied to the pixel electrode of the target pixel. This write operation is carried out in serial operation in the row direction from the left side to the right side in the drawing in the unit of the source drivers, and further the scanning operation in the unit of the serial operation is then carried out in the column direction from the top to the bottom in the drawing in the unit of the gate lines. Each of the pixel electrodes has the respective potential corresponding to the image data, whereby each pixel has a respective field applied to the liquid crystal, wherein the intensity of the respective field depends on the voltage level corresponding to the image data. The light transmittivity of the liquid crystal depends on the intensity of the respective field, whereby the display can be obtained in accordance with the image data.

Figure 26:
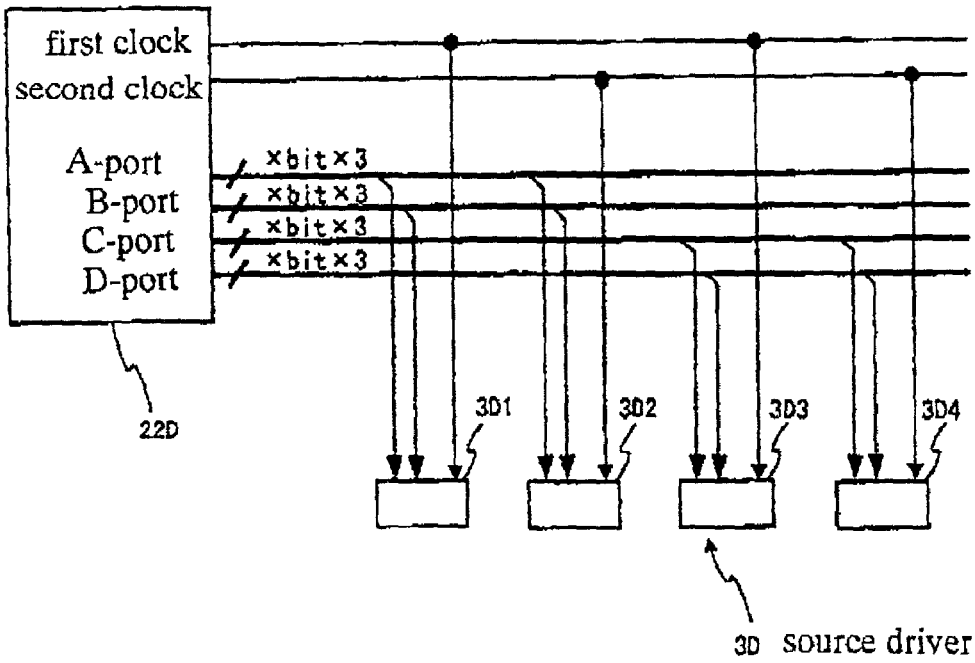
FIG. 26 is a fragmentary block diagram illustrative of a novel circuit configuration including a timing controller and source drivers in a fourth embodiment in accordance with the present invention.

FIG. 26 is a fragmentary block diagram illustrative of a novel circuit configuration including a timing controller and source drivers in a fourth embodiment in accordance with the present invention.

The timing controller 22D has a first clock port "CLOCK-1", from which a first source driver clock signal is supplied to odd number source drivers 3D1, 3D3, - - - on the odd number stages. The timing controller 22D has a second clock port "CLOCK-2", from which a second source driver clock signal is supplied to even number source drivers 3D2, 3D4, - - - on the even number stages. The second source driver clock signal is delayed by a half cycle from the first source driver clock signal, so that the second source driver clock signal is opposite in phase to the first source driver clock signal.

The timing controller 22D also has a first data port "PORT-A", from which A-port image data are supplied to the every first and second ones of source drivers 3D1, 3D2 - - - on the every first and second stages in a cyclic unit of adjacent four source drivers 3D1, 3D2, 3D3 and 3D4. The timing controller 22D also has a second data port "PORT-B", from which B-port image data are supplied to the every first and second ones of source drivers 3D1, 3D2 - - - on the every first and second stages in the cyclic unit of adjacent four source drivers 3D1, 3D2, 3D3 and 3D4. The timing controller 22D also has a third data port "PORT-C", from which C-port image data are supplied to the every third and fourth ones of source drivers 3D3, 3D4 - - - on the every third and fourth stages in the cyclic unit of adjacent four source drivers 3D1, 3D2, 3D3 and 3D4. The timing controller 22D also has a fourth data port "PORT-D", from which D-port image data are supplied to the every third and fourth ones of source drivers 3D3, 3D4 - - - on the every third and fourth stages in the cyclic unit of adjacent four source drivers 3D1, 3D2, 3D3 and 3D4.

Figure 27:
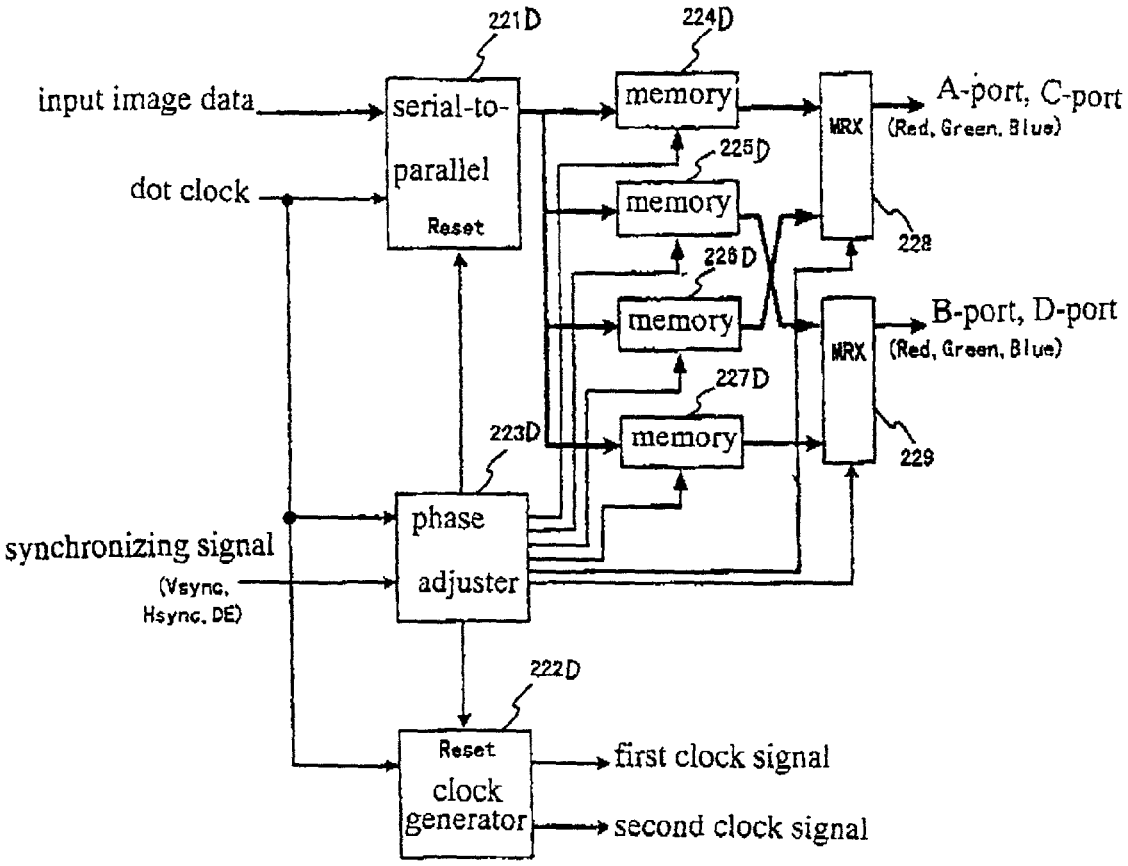
FIG. 27 is a block diagram illustrative of the timing controller shown in FIG. 26.

As described above, the image data are converted into four-system image data, for example, the A-port image data, the B-port image data, the C-port image data and the D-port image data. The A-port image data and the B-port image data are supplied to the every first and second ones of source drivers 3D1, 3D2 - - - on the every first and second stages in the cyclic unit of adjacent four source drivers 3D1, 3D2, 3D3 and 3D4. The C-port image data and the D-port image data are supplied to the every third and fourth ones of source drivers 3D3, 3D4 - - - on the every third and fourth stages in the cyclic unit of adjacent four source drivers 3D1, 3D2, 3D3 and 3D4. FIG. 27 is a block diagram illustrative of the timing controller shown in FIG. 26.

As shown in FIG. 27, the timing controller 22D may comprise a serial-to-parallel converter block 221D, a clock signal generator circuit 222D, a phase adjuster/memory controller circuit 223D, a first memory 224D, a second memory 225D, a third memory 226D, a fourth memory 227D , a first multiplexer 228D and a second multiplexer 229D.

The serial-to-parallel converter block 221D receives an input of the image data and an input of a dot-clock signal of a data rate of the image data. The phase adjuster/memory controller circuit 223D receives an input of the dot-clock signal and an input of synchronization signals Vsync, Hsync, and DE. The clock signal generator circuit 222D is electrically coupled to the phase adjuster/memory controller circuit 223D for receiving an input of a reset signal from the phase adjuster/memory controller circuit 223D. The serial-to-parallel converter block 221D is also electrically coupled to the phase adjuster/memory controller circuit 223D for receiving an input of a reset signal from the phase adjuster/memory controller circuit 223D. The clock signal generator circuit 222D receives the dot-clock signal and generates the first and second clock signals.

The first memory 224D is electrically coupled to the serial-to-parallel converter block 221D for receiving the A-port image data from the serial-to-parallel converter block 221D, so that the first memory 224D Stores the A-port image data, wherein the A-port image data include three primary color image data for red, green and blue. The first memory 224D is electrically coupled to the phase adjuster/memory controller circuit 223D for receiving a first memory control signal from the phase adjuster/memory controller circuit 223D.

The second memory 225D is electrically coupled to the serial-to-parallel converter block 221D for receiving the B-port image data from the serial-to-parallel converter block 221D, so that the second memory 225D stores the B-port image data, wherein the B-port image data include three primary color image data for red, green and blue. The second memory 225D is electrically coupled to the phase adjuster/memory controller circuit 223D for receiving a second memory control signal from the phase adjuster/memory controller circuit 223D.

The third memory 226D is electrically coupled to the serial-to-parallel converter block 221D for receiving the C-port image data from the serial-to-parallel converter block 221D, so that the third memory 226D stores the C-port image data, wherein the C-port image data include three primary color image data for red, green and blue. The third memory 226D is electrically coupled to the phase adjuster/memory controller circuit 223D for receiving a third memory control signal from the phase adjuster/memory controller circuit 223D.

The fourth memory 227D is electrically coupled to the serial-to-parallel converter block 221D for receiving the D-port image data from the serial-to-parallel converter block 221D, so that the fourth memory 227D stores the D-port image data, wherein the D-port image data include three primary color image data for red, green and blue. The fourth memory 227D is electrically coupled to the phase adjuster/memory controller circuit 223D for receiving a fourth memory control signal from the phase adjuster/memory controller circuit 223D.

The first multiplexer 228D is electrically coupled to the phase adjuster/memory controller circuit 223D for receiving a first multiplexer control signal from the phase adjuster/memory controller circuit 223D. The first multiplexer 228D is electrically coupled to the first memory 224D and the third memory 226D for receiving the A-port image data and the C-port image data from the first memory 224D and the third memory 226D respectively, so that the first multiplexer 228D performs a time-division multiplexing operation of the A-port image data and the C-port image data under the control in accordance with the first multiplexer control signal.

The second multiplexer 229D is electrically coupled to the phase adjuster/memory controller circuit 223D for receiving a second multiplexer control signal from the phase adjuster/memory controller circuit 223D. The second multiplexer 229D is electrically coupled to the second memory 225D and the fourth memory 227D for receiving the B-port image data and the D-port image data from the second memory 225D and the fourth memory 227D respectively, so that the second multiplexer 229D performs another time-division multiplexing operation of the B-port image data and the D-port image data under the control in accordance with the second multiplexer control signal.

The above structures including the first and second multiplexers 228D and 229D prepares a data array as shown in FIGS. 29 and 30, wherein the first half data and the second half data are multiplexed in a unit of a value obtained by division to the number of the source lines by the number of the source drivers.

Namely, the A-port image data and the C-port image data multiplexed with each other are read out from the first multiplexer 228D and supplied to the source drivers as the two-system image data which comprise the multiplexed A-port and C-port image data The B-port image data and the B-port image data multiplexed with each other are read out from the second multiplexer 229D and supplied to the source drivers as the two-system image data which comprise the multiplexed B-port and D-port image data.

The clock signal generator circuit 222D receives the dot-clock signal of the data rate of the image data. The clock signal generator circuit 222D also receives the reset signal from the phase adjuster/memory controller circuit 223D. The clock signal generator circuit 222D generates the first and second clock signals from two parallel ports, for example, A-port and B-port. The first and second clock signals are opposite in phase.

Figure 28:
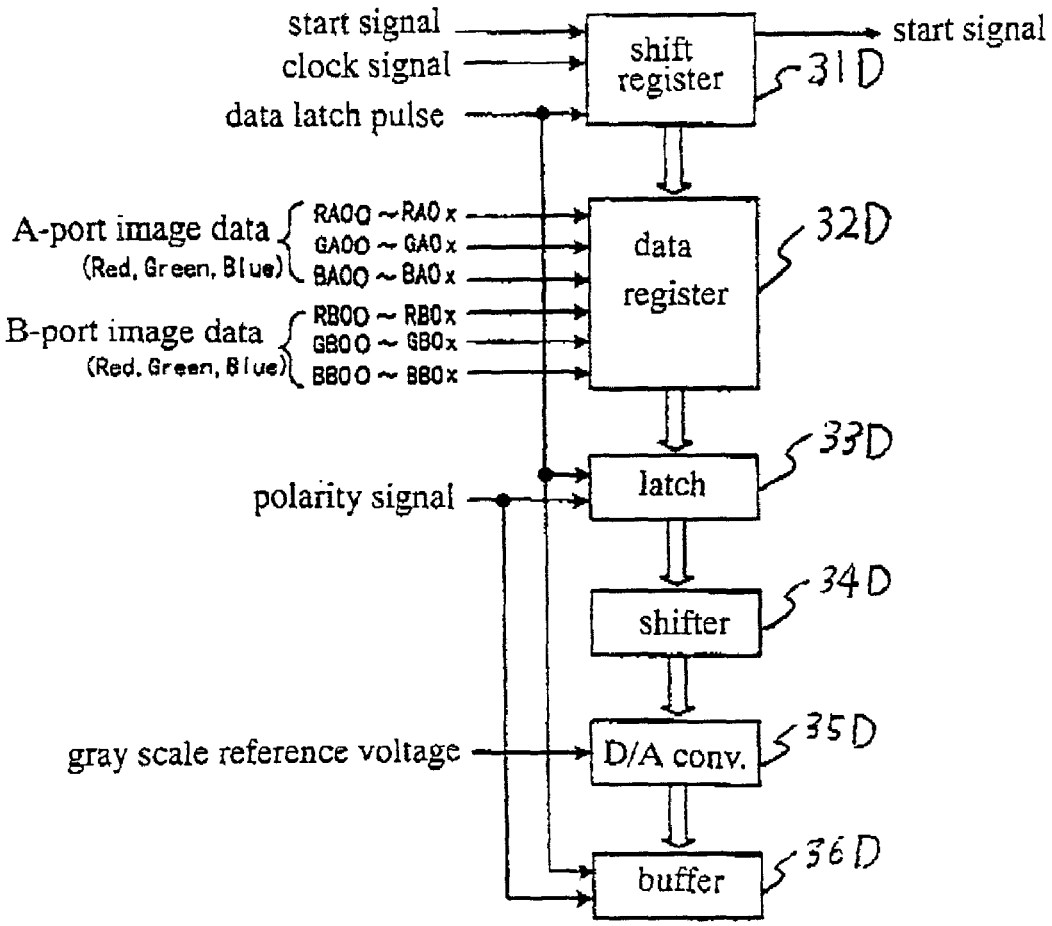

FIG. 28 is a block diagram illustrative of an internal configuration of each of the source drivers shown in FIG. 25. Each of the source drivers 3D comprises a shift register 31D, a data register 32D, a data latch 33D, a level shifter 34D, a digital-to-analog converter 35D, and an output buffer 36D. The shift register 31D receives parallel inputs of the start signal, the first or second clock signal, and the data latch pulse signal. The shift register 31D has multiple stages. The start signal is sequentially inputted into the multiple stages in the shift register 31D, wherein each of the stages outputs a shifted signal upon input of the start signal, whereby the multiple stages sequentially output the shifted signals upon sequential inputs of the start signal.

The data register 32D receives parallel inputs of the A-port or C-port image data for the three primary colors and further parallel inputs of the B-port or D-port image data for the three primary colors. The shifted signals are also supplied from the multiple stages in the shift register 31D into the data register 32D sequentially, so that the received A-port and B-port image data or the C-port and D-port image data are stored sequentially into registers in the data register 32D.

The data latch 33D receives the input of the data latch pulse and another input of the polarity signal. The data latch 33D operates to latch the data stored in the data register 32D in a single line unit.

The level shifter 34D performs level shifts to the output data from the data latch. The digital-to-analog converter 35D receives an input of the output gray scale reference voltage. The digital-to-analog converter 35D also receives the level-shifted digital data from the level shifter 34D, and the digital-to-analog converter 35D performs the digital-to-analog conversion of the level-shifted digital data into the analog image signals.

The output buffer 36D receives the input of the data latch pulse and another input of the polarity signal. The output buffer 36D also receives the analog image signals from the digital-to-analog converter 35D, and then supplies the analog image signals to the source lines.

FIG. 29 is a timing chart showing first and second clock signals and A-port image data, B-port image data, C-port image data, and D-port image data, wherein the rising edges of the first and second clock signals are used as trigger edges.

The A-port image data comprise the, multiplexed even number image data which further include the primary three color image data, for example, red, green and blue colors. "RA0" - - - "RAx" represent the red color data of plural bits which are to be inputted into the A-port. "GA0" - - - "GAx" represent the green color data of plural bits which are to be inputted into the A-port. "BA0" - - - "BAx" represent the blue color data of plural bits which are to be inputted into the A-port.

The B-port image data comprise the multiplexed odd number image data which further include the primary three color image data, for example, red, green and blue colors. "RB0" - - - "RBx" represent the red color data of plural bits which are to be inputted into the B-port. "GB0" - - - "GBx" represent the green color data of plural bits which are to be inputted into the B-port. "BB0" - - - "BBx" represent the blue color data of plural bits which are to be inputted into the B-port.

The C-port image data comprise the multiplexed even number image data which further include the primary three color image data, for example, red, green and blue colors. "RC0" - - - "RCx" represent the red color data of plural bits which are to be inputted into the C-port. "GC0" - - - "GCy" represent the green color data of plural bits which are to be inputted into the C-port. "BC0" - - - "BCz" represent the blue color data of plural bits which are to be inputted into the C-port.

The D-port image data comprise the multiplexed odd number image data which further include the primary three color image data, for example, red, green and blue colors. "RD0" - - - "RDx" represent the red color data of plural bits which are to be inputted into the D-port. "GD0" - - - "GDy" represent the green color data of plural bits which are to be inputted into the D-port. "BD0" - - - "BDz" represent the blue color data of plural bits which are to be inputted into the D-port.

In accordance with this embodiment, the image data to be supplied to the source drivers comprise multiplexed four system image data. The clock signals are used for providing the timings of the input of the image data into the source driver. The clock signals have a cyclic frequency which is equal to a half of the data rate of the four system image data.

The clock signals with the reduced cyclic frequency is used and the necessary time margin can be ensured, whereby the reduction of the electromagnetic interference and the ultra high definition liquid crystal display can be obtained. The process for multiplexing the image data to be supplied to the source drivers allows further time-compression.

In this embodiment, the image data comprise multiplexed four-system image data having the data rate which is a half of the data rate of the image data. The clock signals have the cyclic frequency which is equal to a quarter of the data rate of the image data or equal to a half of the of the half data rate of the four system image data. The four-system image data with the clock signals reduced in the cyclic frequency are supplied to the source drivers, so that the source drivers operate to incorporate the multiplexed four-system image data at the timings of at least one of the rising and falling edges of the clock signals.

In general, the image data comprise multiplexed plural-system image data of "4J"-systems having the data rate "I/2" which is a half of the data rate "I" of the image data, where J is a positive integer. The clock signals have the cyclic frequency "I/4" which is equal to a quarter of the data rate "I" of the image data or equal to a half of the of the half data rate "I/2" of the multiplexed plural-system image data of the "4J"-systems. The multiplexed plural-system image data with the clock signals reduced in the cyclic frequency are supplied to the source drivers, so that the source drivers operate to incorporate the multiplexed plural-system image data at the timings of at least one of the rising and falling edges of the clock signals. The single-system or plural-system clock signals with the reduced cyclic frequency are used and the necessary lime margin can be ensured, whereby the reduction of the electromagnetic interference and the ultra high definition liquid crystal display can be obtained. The process for multiplexing the image data to be supplied to the source drivers allows further time-compression.

Modifications:

Modifications to the above first to fourth embodiments may optionally be possible as follows. In the first to fourth embodiments, the first and second clock signals are used, which are opposite in phase to each other, provided that the rising edges only are used as the trigger edges. Namely, the first and second clock signals are different from each other in phase by 180 degrees. The second clock signal is delayed from the first clock signal by a half cycle. It is, however, possible that, in place of the first and second clock signals. a single clock signal is used, wherein the rising and falling edges are used as double trigger edges.

Alternatively, it is also possible that the two clock signals, for example, the first and second clock signals are used to reduce fan-out of the clock generator for allowing the circuit to exhibit high speed performance. It is, however, possible that the single clock signal may be used for the reasons as described above. FIG. 30 is a timing chart showing first and second clock signals and A-port image data, B-port image data, C-port image data, and D-port image data, wherein the rising and falling edges of the first and second clock signals are used as double trigger edges.

The A-port image data comprise the multiplexed even number image data which further include the primary three color image data, for example, red, green and blue colors. "RA0" - - - "RAx" represent the red color data of plural bits which are to be inputted into the A-port. "GA0" - - - "GAx" represent the green color data of plural bits which are to be inputted into the A-port. "BA0" - - - "BAx" represent the blue color data of plural bits which are to be inputted into the A-port.

The B-port image data comprise the multiplexed odd number image data which further include the primary three color image data, for example, red, green and blue colors. "RB0" - - - "RBx" represent the red color data of plural bits which are to be inputted into the B-port. "GB0" - - - "GBx" represent the green color data of plural bits which are to be inputted into the B-port. "BB0" - - - "BBx" represent the blue color data of plural bits which are to be inputted into the B-port.

The C-port image data comprise the multiplexed even number image data which further include the primary three color image data, for example, red, green and blue colors. "RC0" - - - "RCx" represent the red color data of plural bits which are to be inputted into the C-port. "GC0" - - - "GCy" represent the green color data of plural bits which are to be inputted into the C-port. "BC0" - - - "BCz" represent the blue color data of plural bits which are to be inputted into the C-port.

The D-port image data comprise the multiplexed odd number image data which further include the primary three color image data, for example, red, green and blue colors. "RD0" - - - "RDx" represent the red color data of plural bits which are to be inputted into the D-port. "G0" - - - "GDy" represent the green color data of plural bits which are to be inputted into the D-port. "BD0" - - - "BDz" represent the blue color data of plural bits which are to be inputted into the D-port.

Fifth Embodiment:

A fifth embodiment according to the present invention will be described in detail with reference to the drawings. In accordance with the present invention, the plural-systems, image data are transmitted from the timing controller through bits lines to the source drivers. Radiation of electromagnetic waves from the bus lines appear in transmission of the image data. In this embodiment, a suppression is made to the radiation of electromagnetic waves from the bus lines in transmission of the image data.

In order to suppress the radiation of electromagnetic waves from die bus lines in transmission of the image data, the polarity of the image data being transmitted on the bus lines is, changed or switched in accordance with the bit change rate of the image data. The suppression to the radiation of electromagnetic waves from the bus lines in transmission of the image data further suppresses the electromagnetic interference.

FIG. 31 is a block diagram illustrative of a schematic configuration of the driver circuit for the liquid crystal display in the fifth embodiment in accordance with the present invention. The driver circuit includes a timing controller 2E, source drivers 3-1, 3-2, 3-3 and 3-4, - - - 3-m and a liquid crystal panel 5E. The number of the source drivers 3-1, 3-2, 3-3, 3-4, - - - is M.

The timing controller 2E has a first data output port connected to a first bus data BUS-A1–A24 for transmitting 24-bits image data, a second data output port connected to a second bus data BUS-B1–A24 for transmitting 24-bits image data, a third data output port connected to a third bus data BUS-C1–C24 for transmitting 24-bits image data, and a fourth data output port connected to a fourth bus data BUS-D1–D24 for transmitting 24-bits image data.

The timing controller 2E outputs first and second clock signals CLK1 and CLK2, a first polarity inversion signal INV-A paired with the first bus data BUS-A1–A24, a second polarity inversion signal INV-B paired with the second bus data BUS-B1–B24, a third polarity inversion signal INV-C paired with the third bus data BUS-C1–C24, and a fourth polarity inversion signal INV-D paired with the fourth bus data BUS-D1–D24 as well as outputs first and second control signals SP1 and SP2.

The first bus data BUS-A1–A24 and the first polarity inversion signal INV-A are supplied to the odd number source drivers 3-1, 3-3, - - - on the odd number stages. Th second bus data BUS-B1–B24 and the second polarity inversion signal INV-B are also supplied to the odd number source drivers 3-1, 3-3, - - - on the odd number stages. The first clock signal CLK1 and the first control signal SP1 are also supplied to the odd number source drivers 3-1, 3-3, - - - on the odd number stages.

The third bus data BUS-C1–C24 and the third polarity inversion signal INV-C are supplied to the even number source drivers 3-2, 3-4, - - - on the even number stages. The fourth bus data BUS-D1–D24 and the fourth polarity inversion signal INV-D are also supplied to the even number source drivers 3-2, 3-4, - - - on the even number stages. The second clock signal CLK2 and the second control signal SP2 are also supplied to the even number source drivers 3-2, 3-4, - - - on the even number stages.

Two output ports are allocated to each of the source drivers, so that each of the source drivers operates to drive two pixels with one clock signal with a ½-reduced clock frequency. The source driver 3-1 receives the first clock signal CLK1, and the source driver 3-1 supplies the image data through the first bus data BUS-A1–A24 and the second bus data BUS-B1–B24 to the two pixels in one-clock time period of the first clock signal CLK1. The source driver 3-2 receives the second clock signal CLK2, and the source driver 3-2 supplies the image data through the third bus data BUS-C1–C24 and the fourth bus data BUS-D1–D24 to the two pixels in one-clock time period of the second clock signal CLK2.

The source driver 3-3 receives the first clock signal CLK1, and the source driver 3-3 supplies the image data through the first bus data BUS-A1–A24 and the second bus data BUS-B1–B24 to the two pixels in one-clock time period of the first clock signal CLK1. The source driver 3-4 receives the second clock signal CLK2, and the source driver 3-2 supplies the image data through the third bus data BUS-C1–C24 and the fourth bus data BUS-D1–D24 to the two pixels in one-clock time period of the second clock signal CLK2.

The first bus data BUS-A1–A24 comprises 24-bits, which further comprises three sets of 8-bits for primary colors red, green, and blue. The second bus data BUS-B1–B24 also comprises 24-bits, which further comprises three sets of 8-bits for primary colors red, green, and blue. The third bus data BUS-C1–C24 also comprises 24-bits, which further comprises three sets of 8-bits for primary colors red, green, and blue. The fourth bus data BUS-D1–D24 also comprises 24-bits, which further comprises three sets of 8-bits for primary colors red, green, and blue. A 256-gray-scale display is realized.

Operation of the driver circuit shown in FIG. 31 will be described. The first bus data BUS-A1–A24, the second bus data BUS-B1–B24, the first polarity inversion signal INV-A, and the second polarity inversion signal INV-B are outputted from the timing controller 2E in synchronization with the first clock signal CLK1. The first bus data BUS-A1–A24, the second bus data BUS-B1–B24, the first polarity inversion signal INV-A, and the second polarity inversion signal INV-B are supplied to each of the odd-number source drivers 3-1, 3-3, - - - on the odd-number stages. Further, the first control signal SP1 is supplied to each of the odd-number source drivers 3-1, 3-3, - - - on the odd-number stages. At the timing of the input of the first control signal SP1, each of the odd-number source drivers 3-1, 3-3, - - - latches the first bus data BUS-A1–A24, the second bus data BUS-B1–B24, the first polarity inversion signal INV-A, and the second polarity inversion signal INV-B.

The latched first polarity inversion signal INV-A indicates whether the polarity of the first bus data BUS-A1–A24 is inverted or not. The second polarity inversion signal INV-B indicates whether the polarity of the second bus data BUS-B1–B24 is inverted or not. Each of the odd number source drivers 3-1, 3-3, - - - on the odd number stages inverts the polarity of the first bus data BUS-A1–A24 in accordance with the latched first polarity inversion signal INV-A as well as inverts the polarity of the second bus data BUS-B1–B24 in accordance with the latched second polarity inversion signal INV-B.

The third bus data BUS-C1–C24, the fourth bus data BUS-D1–D24, the third polarity inversion signal INV-C, and the fourth polarity inversion signal INV-D are outputted from the timing controller 2E in synchronization with the second clock signal CLK2. The third bus data BUS-C1–C24, the fourth bus data BUS-D1–D24, the third polarity inversion signal INV-C, and the fourth polarity inversion signal INV-D are supplied to each of the even number source drivers 3-2, 3-4, - - - on the even-number stages. Further, the second control signal SP2 is supplied to each of the even-number source drivers 3-2, 3-4, - - - on the even-number stages. At the timing of the input of the second control signal SP2, each of the even-number source drivers 3-2, 3-4, - - - latches the third bus data BUS-C1–C24, the fourth bus data BUS-D1–D24, the third polarity inversion signal INV-C, and the fourth polarity inversion signal INV-D.

The latched third polarity inversion signal INV-C indicates whether the polarity of the third bus data BUS-C1–C24 is inverted or not. The fourth polarity inversion signal INV-D indicates whether the polarity of the fourth bus data BUS-D1–D24 is inverted or not. Each of the even number source drivers 3-2, 3-4, - - - on the even number stages inverts the polarity of the third bus data BUS-C1–C24 in accordance with the latched first third polarity inversion signal INV-C as well as inverts the polarity of the fourth bus data BUS-D1–D24 in accordance with the latched fourth polarity inversion signal INV-D.

Each of the source drivers 3-1, 3-2, 3-3, 3-4, - - - also receives a respective driving start signal which is not illustrated. Upon receipt of the respective driving start signal, each of the odd-number source drivers 3-1, 3-3, - - - generates a gray-scale voltage based on the first bus data BUS-A1–A24 and the second bus data BUS-B1–B24. Upon receipt of the respective driving start signal, each of the even-number source drivers 3-2, 3-4, - - - generates a gray-scale voltage based on the third bus data BUS-C1–C24 and the fourth bus data BUS-D1–D24. The gray-scale voltages are supplied to the liquid crystal panel 5E, whereby the liquid crystal panel 5E performs the display based on the gray-scale voltages.

FIG. 32 is a block diagram illustrative of a structure of data output unit of the timing controller shown in FIG. 31. A data output unit 4 of the tuning controller 5E includes four ports, for example, A-port, B-port, C-port and D-port. The A-port has an A-port data polarity inversion determination generation unit 10-1 which generates the first bus data BUS-A1–A24 and the first polarity inversion signal INV-A. The B-port has a B-port data polarity inversion determination generation unit 10-2 which generates the second bus data BUS-B1–B24 and the second polarity inversion signal INV-B. The C-port has a C-port data polarity inversion determination generation unit 10-3 which generates the third bus data BUS-C1–C24 and the third polarity inversion signal INV-C. The D-port has a D-port data polarity inversion determination generation unit 10-4 which generates the fourth bus data BUS-D1–D24 and the fourth polarity inversion signal INV-D.

Bus data of 96-bits are divided into bus data BUS1–48 and bus data BU49–96. The bus data BUS1–48 are further divided into bus data BUS1–24 of 24-bits and bus data BUS25–48 of 24-bits. The bus data BU49–96 are further divided into bus data BU49–72 of 24-bits and bus data BUS73–96 of 24-bits.

The bus data BUS1–24 of 24-bits are supplied to the A-port data polarity inversion determination generation unit 10-1. The bus data BUS25–48 of 24-bits are supplied to the B-port data polarity inversion determination generation unit 10-2. The bus data BU49–72 of 24-bits are supplied to the C-port data polarity inversion determination generation unit 10-3. The bus data BUS73–96 of 24-bits are supplied to the D-port data polarity inversion determination generation unit 10-4. The first clock signal CLKI is also supplied to the A-port data polarity inversion determination generation unit 10-1 and the B-port data polarity inversion determination generation unit 10-2. The second clock signal CLK2 is also supplied to the C-port data polarity inversion determination generation unit 10-3 and the D-port data polarity inversion determination generation unit 10-4. The first and second clock signals CLK1 and CLK2 are supplied from the timing controller 2E.

The A-port data polarity inversion determination generation unit 10-1 determines whether the polarity of the bus data BUS1–24 of 24-bits should be inverted or not. If the inversion should be made, the A-port data polarity inversion determination generation unit 10-1 inverts the polarity of the bus data BUS1–24 of 24-bits and outputs the polarity-inverted bus data BUS1–24 of 24-bits together with the high level "H" of the first polarity inversion signal INV-A, which indicates that the bus data BUS1–24 of 24-bits has the inverted polarity. If the inversion should not be made, the A-port data polarity inversion determination generation unit 10-1 does not invert the polarity of the bus data B13S1-24 of 24-bits and outputs the polarity-non-inverted bus data BUS1–24 of 24-bits together with the low level "L" of the first polarity inversion signal INV-A, which indicates that the bus data BUS1–24 of 24-bits has the non-inverted polarity.

The B-port data polarity inversion determination generation unit 10-2 determines whether the polarity of the bus data BUS25–48 of 24-bits should be inverted or not. if the inversion should be made, the B-port data polarity inversion determination generation unit 10-2 inverts the polarity of the bus data BUS25–48 of 24-bits and outputs the polarity-inverted bus data BUJS25-48 of 24-bits together with the high level "H" of the second polarity inversion signal INV-B, which indicates that the bus data BUS25–48 of 24-bits has the inverted polarity. If the inversion should not be made, the B-port data polarity inversion determination generation unit 10-2 does not invert the polarity of the bus data BUS25–48 of 24-bits and outputs the polarity-non-inverted bus data BUS25–48 of 24-bits together with the low level "L" of the second polarity inversion signal INV-B, which indicates that the bus data BUS25–48 of 24-bits has the non-inverted polarity.

The C-port data polarity inversion determination generation unit 10-3 determines whether the polarity of the bus data BU49–72 of 24-bits should be inverted or not. If the inversion should be made, the C-port data polarity inversion determination generation unit 10-3 inverts the polarity of the bus data BU49–72 of 24-bits and outputs the polarity-inverted bus data BU49–72 of 24-bits together with the high level "H" of the third polarity inversion signal INV-C, which indicates that the bus data BU49–72 of 24-bits has the inverted polarity. If the inversion should not be made, the C-port data polarity inversion determination generation unit 10-3 does not invert the polarity of the bus data BU49–72 of 24-bits and outputs the polarity-non-inverted bus data BU49–72 of 24-bits together with the low level "L" of the third polarity inversion signal INV-C, which indicates that the bus data BU49–72 of 24-bits has the non-inverted polarity.

The D-port data polarity inversion determination generation unit 10-4 determines whether the polarity of the bus data BUS73–96 of 24-bits should be inverted or not. If the inversion should be made, the D-port data polarity inversion determination generation unit 10-4 inverts the polarity of the bus data BUS73–96 of 24-bits and outputs the polarity-inverted bus data BUS73–96 of 24-bits together with the high level "H" of the fourth polarity inversion signal INV-D, which indicates that the bus data BUS73–96 of 24-bits has the inverted polarity. If the inversion should not be made, the D-port data polarity inversion determination generation unit 10-4 does not invert the polarity of the bus data BUS73–96 of 24-bits and outputs the polarity-non-inverted bus data BUS73–96 of 24-bits together with the low level "L" of the fourth polarity inversion signal INV-D, which indicates that the bus data BUS73–96 of 24-bits has the non-inverted polarity.

FIG. 33 is a timing chart illustrative of waveforms of the first and second clock signals CLK1 and CLK2, the bus data BUS1–48, the bus data BU49–96, the first bus data BUS-A1–A24, the second bus data BUS-B1–B24, the third bus data BUS-C1–C24, and the fourth bus data BUS-D1–D24. The bus data BUS1–48 changes in synchronization with the rising edges of the first clock signal CLK1 or at timings PA1, PA2, PA3, - - - . The first bus data BUS-A1–A24 and the second bus data BUS-B1–B24 change in synchronization with the falling edges of the first clock signal CLK1 or at timings PB1, PB2, PB3, - - - . The bus data BU549-96 changes in synchronization with the rising edges of the second clock signal CLK2 or at timings PB1, PB2, PB3, - - - . The third bus data BUS-C1–C24 and the fourth bus data BUS-D1–D24 change in synchronization with the falling edges of the second clock signal CLK2 or at timings PA1, PA2, PA3, - - - . The first and second clock signals CLK1 and CLK2 are different in phase from each other by 180 degrees or a half cycle.

The bus data BUS1–96 are divided into four data sets, for example, the first bus data BUS-A1–A24, the second bus data BUS-B1–B24 the third bus data BUS-C1–C24 and the fourth bus data BUS-D1–D24 which are outputted from the A-port, the B-port, the C-port and the D-port respectively as described above. If the four ports, for example, the A-port, the B-port, the C-port and the D-port change the signals and outpost the signals at the same timings, then a large current temporally is necessary for the timing controller 2E.

In order to avoid this disadvantage, the first and second clock signals CLK1 and CLK2 are different in phase from each other by 180 degrees or a half cycle, so that the timing of change of the signals from the A-port and the B-port is different in phase by a half cycle or 180 degrees from the timing of change of the signals from the C-port and the D-port.

FIG. 34 is a block diagram illustrative of an example of the internal configuration of each of the A-port data polarity inversion determination generation unit 10-1, the B-port data polarity inversion determination generation unit 10-2, the C-port data polarity inversion determination generation unit 10-3 and the D-port data polarity inversion determination generation unit 10-4 shown in FIG. 32.

Each of the A-port data polarity inversion determination generation unit 10-1, the B-port data polarity inversion determination generation unit 10-2, the C-port data polarity inversion determination generation unit 10-3 and the D-port data polarity inversion determination generation unit 10-4 may comprise the following uniform internal configuration.

Input data "da-1-24" of 24-bits correspond to each of the bus data BUS1–24, the bus data BUS25–48, the bus data BU49–72 and the bus data BUS73–96. Clock signal "clk" correspond to each of the first and second clock signals CLK1 and CLK2. Output data "dd1-24" of 24-bits correspond to each of the first bus data BUS-A1–A24, the second bus data BUS-B1–B24 the third bus data BUS-C1–C24 and the fourth bus data BUS-D1–D24. An output signal "inv3" corresponds to each of the first polarity inversion signal INV-A, the second polarity inversion signal INV-B, the third polarity inversion signal INV-C and the fourth polarity inversion signal INV-D.

Each of the A-port data polarity inversion determination generation unit 10-1, the B-port data polarity inversion determination generation unit 10-2, the C-port data polarity inversion determination generation unit 10-3 and the D-port data polarity inversion determination generation unit 10-4 includes a first data polarity inversion determination circuit 11, a second data polarity inversion determination circuit 12, D-flip-flop circuits 13-1, 13-2, - - - 13-24, D-flip-flop circuits 14-1, 14-2, - - - 14-24, a D-flip-flop circuit 15 and a D-flip-flop circuit 16.

The clock signal "clk" is inputted into the clock input terminal of each of the D-flip-flop circuits 13-1, 13-2, - - -, 13-24, the D-flip-flop circuits 14-1, 14-2, - - - , 14-24, the D-flip-flop circuit 15, and the D-flip-flop circuit 16. The input data "da-1-24" of 24-bits is inputted into the first data polarity inversion determination circuit 11 and also inputted into D-terminals of the D-flip-flop circuits 13-1, 13-2, - - - , 13-24. The D-flip-flop circuits 13-1, 13-2, - - - , 13-24 latch the input data "da-1-24" of 24-bits in synchronization with the failing edges of the clock signal "clk", and output data "db-1-24" of 24-bits is outputted from Q-terminals of the D-flip-flop circuits 13-1, 13-2, - - - , 13-24.

The first data polarity inversion determination circuit 11 also receives output data "dc-1-24" of 24-bits from the second data polarity inversion determination circuit 12. The first data polarity inversion determination circuit 11 compares the input data "da-1-24" of 24-bits with the output data "dc-1-24" of 24-bits to verify whether the number of bits with different values is not less than 13 or whether the majority of the bits are different in value between the input data "da-1-24" of 24-bits and the output data "dc-1-24" of 24-bits. If the number of bits with different values is not less than 13 or if the majority of the bits are different in value between the input data "da-1-24" of 24-bits and the output data "dc-1-24" of 24-bits, then the first data polarity inversion determination circuit 11 outputs a data polarity inversion signal "inv1" of high level "H". If the number of bits with different values is less than 13 or if the minority of the bits are different in value between the input data "da-1-24" of 24-bits and the output data "dc-1-24" of 24-bits, then the first data polarity inversion determination circuit 11 outputs the data polarity inversion signal "inv1" of low level "L".

The data polarity inversion signal "inv1" is inputted into a D-terminal of the D-flip-flop circuit 15. The D-flip-flop circuit 15 latches the data polarity inversion signal "inv1" in synchronization with the failing edges of the clock signal "clk" and outputs a data polarity inversion signal "inv2".

The data polarity inversion signal "inv2" is inputted into a D-terminal of the D-flip-flop circuit 16. The D-flip-flop circuit 16 latches the data polarity inversion signal "inv2" in synchronization with the falling edges of the clock signal "clk" and outputs a data polarity inversion signal "inv3".

The data polarity inversion signal "inv2" is also inputted into the second data polarity inversion determination circuit 12. The output data "db-1-24" of 24-bits from the first data polarity inversion determination circuit 11 are also inputted into the second data polarity inversion determination circuit 12 during when the data polarity inversion signal "inv2" is in the high level "H". The second data polarity inversion determination circuit 12 inverts the polarity of all bits of the output data "db-1-24" of 24-bits and outputs inverted data "dc-1-24" of 24-bits.

As described above, the inverted data "dc-1-24" of 24-bits are inputted into the first data polarity inversion determination circuit 11. The first data polarity inversion determination circuit 11 compares the input data "da-1-24" of 24-bits with the output data "dc-1-24" of 24-bits to verify whether the number of bits with different values is not less than 13 or whether the majority of the bits are different in value between the input data "da-1-24" of 24-bits and the output data "dc-1-24" of 24-bits. If the number of bits with different values is not less than 13 or if the majority of the bits are different in value between the input data "da-1-24" of 24-bits and the output data "dc-1-24" of 24-bits, then the first data polarity inversion determination circuit 11 outputs a data polarity inversion signal "inv1" of high level "H". If the number of bits with different values is less than 13 or if the minority of the bits are different in value between the input data "da-1-24" of 24-bits and the output data "dc-1-24" of 24-bits, then the first data polarity inversion determination circuit 11 outputs the data polarity inversion signal "inv1" of low level "L".

The inverted data "dc-1-24" of 24-bits is inputted into D-terminals of the D-flip-flop circuits 14-1, 14-2, - - - , 14-24. The D-flip-flop circuits 14-1, 14-2, - - - , 14-24 latch the input data "dc-1-24" of 24-bits in synchronization with the falling edges of the clock signal "clk", and output data "dd-1-24" of 24-bits is outputted from Q-terminals of the D-flip-flop circuits 14-1, 14-2, - - - , 14-24.

FIG. 35 is a timing chart illustrative of waveforms of the clock signal "clk", the data "da-1-24", the data "db-1-24", the data "dc-1-24" the data "dd-1-24", and the data polarity inversion signals "inv2" and "inv3" shown in FIG. 34. Prior to a time "t1", all 24-bits of the input data "da-1-24" are high level "H" or "1". At the time "t1", all 24-bits of the input data "da-1-24" are changed from the high level to the low level "L"or "0" in synchronization with the rising edge of the clock signal "clk". At a time "t3", all 24-bits of the input data "da-1-24" are changed from the low level to the high level "H" or "1" in synchronization with the rising edge of the clock signal "clk".

The input data "da-1-24" is inputted into the D-flip-flop circuits 13-1, 13-2, 13-3, - - - , 13-24. The D-flip-flop circuits 13-1, 13-2, 13-3, - - - , 13-24 output the output data "db-1-24". Prior to a time "t2", all 24-bits of the output data "db-1-24" are high level "H" or "1". At the time "t2", all 24-bits of the output data "db-1-24" are changed from the high level to the low level "L" or "0" in synchronization with the falling edge of the clock signal "clk". At a time "t4", all 24-bits of the output data "db-1-24" are changed from the low level to the high level "H" or "1" in synchronization with the falling edge of the clock signal "clk".

During when the data polarity inversion signal "inv2" is in the high level "H", the data "db-1-24" are inputted into the second data polarity inversion determination circuit 12. All 24-bits of the data "db-1-24" are inverted by the second data polarity inversion determination circuit 12 from the low level "L" or "0" to the high level "H" or "1", and are outputted from the second data polarity inversion determination circuit 12 as the data "dc-1-24" comprising the all 24-bits of high level "H" or "1".

The data "da-1-24" and the data "dc-1-24" are inputted into the first data polarity inversion determination circuit 11. At the timing "t1", all 24-bits of the data "da-1-24" are changed to the low level "L" or "0", whereby the majority of all 24-bits of the data "da-1-24" are different in level from the data "dc-1-24" with all 24-bits of the high level "H" or "1". The first data polarity inversion determination circuit 11 outputs the data polarity inversion signal "inv1" of the high level "H" or "1".

At the timing "t2", the D-flip-flop circuit 15 latches the data polarity inversion signal "inv1" of the high level "H" or "1" and outputs the data polarity inversion signal "inv2" of the high level "H" or "1". At the timing "t3", all 24-bits of the data "da-1-24" are changed into the high level "H" or "1", whereby the minority of the all 24-bits of the data "da-1-24" is different from the data "dc-1-24". The first data polarity inversion determination circuit 11 outputs the data polarity inversion signal "inv1" of the low level "L" or "0". At the Liming "t4", the D-flip-flop circuit 15 latches the data polarity inversion signal "inv1" of the low level "L" or "0" and outputs the data polarity inversion signal "inv2" of the low level "L" or "0".

The data "dc-1-24" are latched by the D-flip-flop circuits 14-1, 14-2, - - - , 14-24 in synchronization with the falling edges of the clock signal "clk", and data "dd- 1-24" outputted from the D-flip-flop circuits 14-1, 14-2, - - - , 14-24. All 24-bits of the data "dd-1-24" outputted from the D-flip-flop circuits 14-1, 14-2, - - - , 14-24 remain high level "H" or "1".

The D-flip-flop circuit 16 outputs the data polarity inversion signal "inv3". The data "da-1-24" are inverted into the high level "H" or "0" and then the data "dd-1-24" outputted from the D-flip-flop circuits 14-1, 14-2, - - - 14-24 during the time period of "t4" and "t5" during which the data polarity inversion signal "inv3" is placed into the high level.

FIG. 36 is a circuit diagram illustrative of a first data polarity inversion determination circuit 11 shown in FIG. 35. The first data polarity inversion determination circuit 11 includes a polarity variation detecting circuit 21 and a majority deciding circuit 22. The polarity variation detecting circuit 21 includes 24 of Exclusive OR circuits 23-1, 23-2, 23-3, 23-4, - - - 23-24. The data "da1-24" of 24-bits and the data "dc1-24" of 24-bits are supplied to the Exclusive OR circuits 23-1, 23-2, 23-3, 23-4, - - - 23-24.

For example, a datum "da1" of 1-bit and a datum "dc1" of 1-bit are inputted into the Exclusive OR circuit 23-1, so that the Exclusive OR circuit 23-1 takes the Exclusive OR of the data "da1" and "dc1" and outputs an output signal A1. A datum "da2" of 1-bit and a datum "dc2" of 1-bit are inputted into the Exclusive OR circuit 23-2, so that the Exclusive OR circuit 23-2 takes the Exclusive OR of the data "da2" and "dc2" and outputs an output signal A2. A datum "da24" of 1-bit and a datum "dc24" of 1-bit are inputted into the Exclusive OR circuit 23-24, so that the Exclusive OR circuit 23-24 takes the Exclusive OR of the data "da24" and "dc24" and outputs an output signal A24.

The majority deciding circuit 22 includes a first AND circuit 24-1, a second AND circuit 24-2, and an OR circuit 25. The first AND circuit 24-1 has 13-inputs receiving the 13 outputs A1, A2, - - - A12 and A13 from the 13 Exclusive OR circuits 23-1, 23-2, - - - 23-13, so that the first AND circuit 24-1 takes the AND of the 13 outputs A1, A2, - - - A12 and A13 and outputs an output signal B1. The second AND circuit 24-2 has 13-inputs receiving the 13 outputs A12, A13, - - - A23 and A24 from the 13 Exclusive OR circuits 23-12, 23-13, - - - 23-24, so that the second AND circuit 24-2 takes the AND of the 13 outputs A12, A13, - - - A23 and A24 and outputs an output signal B2.

The OR circuit 25 has two inputs receiving the output signals B1 and B2 from the first AND circuit 24-1 and the second AND circuit 24-2 respectively. The OR circuit 25 takes the OR of the output signals B1 and B2 and outputs the data polarity inversion signal "inv1".

If the majority of the outputs A1, A2, - - - A23 and A24 from all of the Exclusive OR circuits 23-1, 23-2, - - - 23-24 is high level "H", then the data polarity inversion signal "inv1" is high level "B". If the minority of the outputs A1, A2, - - - A23 and A24 from all of the Exclusive OR circuits 23-1, 23-2, - - - 23-24 is high level "H", then the data polarity inversion signal "inv1" is low level "L".

FIG. 37 is a table showing operations of the polarity variation detecting circuit 21 shown in FIG. 36. "n" represents the bit numbers 1, 2, 3, - - - , 23, and 24 for the input data "da1", "da2", "da3", - - - "da24", and the input data "dc1", "dc2", "dc3", - - - "dc24", as well as for the outputs A1, A2, - - - A23 and A24 from all of the Exclusive OR circuits 23-1, 23-2, - - - 23-24. "dan" represents the binary digit values of the input data "da1", "da2", "da3", - - - "da24". "dan" represents the binary digit values of the input data "dc1", "dc2", "dc3", - - - "dc24". "An" represents the binary digit values of the outputs A1, A2, - - - A23 and A24 from all of the Exclusive OR circuits 23-1, 23-2, - - - 23-24. At the bit numbers 2-5, and 23, the input data "dan" are different in the binary digit value from the input data "dcn", whereby the outputs "An" are high level "H". If the majority of the outputs "An" are high level "H", then the data polarity inversion signal "invl" is high level "H". If the minority of the outputs "An" are high level "H", then the data polarity inversion signal "inv1" is low level "L".

FIGS. 38A through 38D are tables showing operations of the data output unit 4 of FIG. 32 provided in the timing controller 2E of FIG. 31. The data output unit 4 in the timing controller 2E has four output ports, for example, the A-port, the B-port, the C-port and the D-port. The inversions to the polarity of the data are accomplished for the four output ports independently. For convenience, it is assumed that a total bit number of the data inputted into the data polarity inversion determination unit is 24, and the two output ports are provided so that the inversion of the polarity of the data are accomplished for 12-bits unit.

In FIGS. 38A through 38D, "n" represents the bit numbers of the data. "Xn" represents the previous output data prior by one clock to the current data. "Yn" represents the current input data. "Zn" represents the current output data corresponding to the current input data "Yn".

FIGS. 38A through 38D show examples of the data "Xn", "Yn" and "Zn". The polarity of 12-bits of the data "Yn" is different from the data "Xn". FIG. 38A shows that the single data polarity inversion determination generation unit is used to invert the data polarity in 24-bits unit. FIGS. 38B, 38C and 38D show that the two data polarity inversion determination generation units are used to invert the data polarity in 12-bits unit, wherein the 24-bits data are divided into the two sets of the 12-bit data.

In FIG. 38A, all 24-bits of the previous output data "Xn" are low level "L". For the current input data "Yn", twelve bits, for example, first to seventh bits and thirteenth to seventeenth bits are high level "H", whilst the remaining twelve bits, for example, eighth to twelfth bits and fourteenth to twenty fourth bits are low level "L". In this case, it is verified whether or not the majority bits of the data in 24-bits unit are changed. Since the majority bits of the current input data "Yn" are not different from the previous output data "Xn", the current input data "Yn" are not changed and the current output data "Zn" with the same polarity of 24-bits are then outputted without polarity inversion operation. As a result, the number of the bits with the changed polarity is 12 which is the maximum bit number with the polarity change of the data of 24-bits.

In FIG. 38B, all 24-bits of the previous output data "Xn" are low level "L". For the current input data "Yn", twelve bits, for example, first to seventh bits and thirteenth to seventeenth bits are high level "H", whilst the remaining twelve bits, for example, eighth to twelfth bits and fourteenth to twenty fourth bits are low level "L". In this case, it is verified whether or not the majority bits of the data in 12-bits unit are changed. The majority of the fist to twelfth bits of the current input data "Yn" are different from the first to twelfth bits of the previous output data "Xn". The minority of the thirteenth to twenty fourth bits of the current input data "Yn" are different from the thirteenth to twenty fourth bits of the previous output data "Xn". The first to twelfth bits of the current input data "Yn" are inverted in polarity, and the first to twelfth bits of the current output data "Zn" with the inverted polarity of 12-bits are then outputted with polarity inversion operation. The thirteenth to twenty fourth bits of the current input data "Yn" are not inverted in polarity, and the thirteenth to twenty fourth bits of the current output data "Zn" with the same polarity of 12-bits are then outputted without polarity inversion operation. As a result, the number of the bits with the changed polarity is 10 which is less by 2-bits than the case shown in FIG. 38A, wherein the data polarity inversion is made in the 24-bits unit.

In FIG. 38C, all 24-bits of the previous output data "Xn" are low level "L". For the current input data "Yn", twelve bits, for example, first to eighth bits and thirteenth to sixteenth bits are high level "H", whilst the remaining twelve bits, for example, ninth to twelfth bits and seventeenth to twenty fourth bits are low level "L". In this case, it is verified whether or not the majority bits of the data in 12-bits unit are changed. The majority of the first to twelfth bits of the current input data "Yn" are different from the first to twelfth bits of the previous output data "Xn". The minority of the thirteenth to twenty fourth bits of the current input data "Yn" are different from the thirteenth to twenty fourth bits of the previous output data "Xn". The first to twelfth bits of the current input data "Yn" are inverted in polarity, and the first to twelfth bits of the current output data "Zn" with the inverted polarity of 12-bits are then outputted with polarity inversion operation. The thirteenth to twenty fourth bits of the current input data "Yn" are not inverted in polarity, and the thirteenth to twenty fourth bits of the current output data "Zn" with the same polarity of 12-bits are then outputted without polarity inversion operation, As a result, the number of the bits with the changed polarity is 8 which is less by 4-bits than the case shown in FIG. 38A, wherein the data polarity inversion is made in the 24-bits unit.

In FIG. 38D, all 24-bits of the previous output data "Xn" are low level "L". For the current input data "Yn", twelve bits, for example, first to ninth bits and thirteenth to fifteenth bits are high level "H", whilst the remaining twelve bits, for example, tenth to twelfth bits and sixteenth to twenty fourth bits are low level "L". In this case, it is verified whether or not the majority bits of the data in 12-bits unit are changed. The majority of the first to twelfth bits of the current input data "Yn" are different from tile first to twelfth bits of the previous output data "Xn". The minority of the thirteenth to twenty fourth bits of the current input data "Yn" are different from the thirteenth to twenty fourth bits of the previous output data "Xn". The first to twelfth bits of the current input data "Yn" are inverted in polarity, and the first to twelfth bits of the current output data "Zn" with the inverted polarity of 12-bits are then outputted with polarity inversion operation. The thirteenth to twenty fourth bits of the current input data "Yu" are not inverted in polarity, and the thirteenth to twenty fourth bits of the current output data "Zn" with the same polarity of 12-bits are then outputted without polarity inversion operation. As a result, the number of the bits with the changed polarity is 6 which is less by 6-bits than the case shown in FIG. 38A, wherein the data polarity inversion is made in the 24-bits unit.

Although the illustration is omitted, if twelve bits, for example, the first to eleventh bits and the thirteenth bit of the current input data "Yn" are high level "H", then the current input data "Yn" are inverted in polarity and the current output data "Zn" with the inverted polarity are outputted. As a result, the number of the bits with the changed polarity is 2 which is less by 10-bits than the case shown in FIG. 38A, wherein the data polarity inversion is made in the 24-bits unit.

If twelve bits, for example, the first to twelfth bits of the current input data "Yn" are high level "H", then the current input data "Yn" in the first 12-bits unit are inverted in polarity and the current output data "Zn" in the first 12-bits unit with the inverted polarity are outputted. As a result, the number of the bits with the changed polarity is 0 which is less by 12-bits than the case shown in FHG. 38A, wherein the data polarity inversion is made in the 24-bits unit.

In accordance with the present invention, the data of 24-bits are divided into two data sets of 12-bits, so that the two data sets of 12-bits are then subjected to the data polarity inversion processings as described above. Assuming that the maximum bit number of different or changed polarity is 12 under the condition of the data polarity inversion in the 24-bits unit, the separate data polarity inversion processes in the 12-bits unit causes that the bit number of the data polarity change is less by 2-bits than the maximum bit number of different or changed polarity, and also allows that the number of the bits with the changed polarity is 0 which is less by 12-bits than the case of the data polarity inversion in the 24-bits unit.

In FIGS. 38A through 38D, the input data comprise 24-bits, and the 24-bits input data are divided into two sets of the 12-bits data sets for two output ports. It is, of course, possible that the input data comprise 96-bits, and the 96-bits input data are divided into four sets of the 24-bits data sets for four output ports.

In the foregoing embodiments, the data polarity inversions process is accomplished in the 24-bits unit, wherein the red color data comprise 8-bits, the green color data comprise 8-bits, and the blue color data comprise 8-bits. It is, of course, possible that the data polarity inversions process is accomplished in the 8-bits unit.

In the foregoing embodiments, the description has been made in case of the display at 256 gray scales with the primary three colors. It is, of course, possible to change the number of the gray scales and the number of the colors.

The driver circuit with the data polarity inversion function reduces the bit number of the output data with the changed polarity, so as to reduce the necessary power for outputting the data from the data output unit 4 in the timing controller 2E. The foregoing embodiment can obtain 25% reduction in the power consumption by the driver circuit as compared to the conventional driver circuit free of any data polarity inversion function. Further, the driver circuit with the data polarity inversion function suppresses the noises generated by the bit number of the output data with the changed polarity.

FIG. 39 is a diagram illustrative of noises from the driver circuit over the frequency in the measurement for the electromagnetic interference characteristic in accordance with the novel liquid crystal display device including the timing controller with the data polarity inversion function in accordance with the present invention. In the measurement for the electromagnetic interference characteristic, a shield plate was removed from the liquid crystal display, so that the electromagnetic interference noises radiated from the driving circuit and the liquid crystal display panel were measured.

FIG. 40 is a block diagram illustrative of a conventional schematic configuration of the driver circuit for the liquid crystal display in the comparative example. The driver circuit includes a timing controller 2F, source drivers 3-1, 3-2, 3-3 and 3-4, - - - 3-m and a liquid crystal panel 5F. The number of the source drivers 3-1, 3-2, 3-3, 3-4, - - - is M. The timing controller 2F has a single data output port connected to a first bus data BUS-A1–A48 for transmitting 48-bits image data. The timing controller 2F has no data polarity inversion function. FIG. 41 is a diagram illustrative of noises from the driver circuit over the frequency in the measurement for the electromagnetic interference characteristic in accordance with the conventional liquid crystal display device including the timing controller with the data polarity inversion function in accordance with the comparative example.

In FIGS. 39 and 41, the horizontal axis represents the frequency of the electromagnetic interference noises in megahertz unit (MHz), whilst the vertical axis represents the intensity of the electromagnetic interference noises in decibel unit (dB). As comparisons between the electromagnetic interference noises in FIGS. 39 and 41, the novel driver circuit reduces the electromagnetic interference noises by not less than 10 dB in the frequency band from 40 MHz to 230 MHz.

In accordance with the present invention, if the majority bits of the image data are changed in polarity, then the polarity of all bits of the image data are changed and supplied onto the bus lines together with the polarity inversion signal which indicates the polarity inversion of the image data, so that each of the source drivers receives the polarity-inverted image data with the polarity inversion signal and generates the image data with the reduced number of the changed polarity bits to reduce the power consumption and suppress the electromagnetic interference noises.

The suppression to the electromagnetic interference would make it unnecessary to provide the countermeasure parts to the expensive shielding members for electromagnetic interference noises. This allows the cost reduction of the liquid crystal display device.

The comparison in the electromagnetic interference characteristic between the novel driver circuit with the data polarity inversion function and the conventional driver circuit free of the data polarity inversion function makes it possible to confirm the frequency band, in which the noises are caused from the bus lines. This allows distinguishing whether or not the electromagnetic interference noises are radiated from the bus lines.

The reduction in the number of the plurality-changed bits of the image data to be supplied onto the bus lines causes the effect of reducing cross-talk noises between the bus lines.

In accordance with the present invention, the data polarity inversion determination circuit and the polarity inversion circuit are provided for every sets of the bus lines for accomplishing the polarity inversion to the data for every sets of the bus lines to reduce the number of the polarity-changed bits of the image data to be supplied onto the bus lines.

Furthermore, the two clock signals different in phase by a half cycle from each other, wherein the two lock signals are used for the first half bits of the image data and for the second half bits of the image data, thereby reducing the number of the bits which are concurrently changed in polarity and reducing the instantaneous current of the timing controller.

In accordance with the first embodiment, the image data to be supplied to the source drivers comprise two system image data, for example, even number image data and odd number image data. The clock signals are used for providing the timings of the input of the image data into the source driver. The clock signals have a cyclic frequency which is equal to a half of the data rate of the two system image data. The clock signals with the reduced cyclic frequency is used and the necessary time margin can be ensured, whereby the reduction of the electromagnetic interference and the ultra high definition liquid crystal display can be obtained.

In this embodiment, the image data comprise two-system image data having the data rate which is a half of the data rate of the image data. The clock signals have the cyclic frequency which is equal to a quarter of the data rate of the image data or equal to a half of the of the half data rate of the two system image data. The two-system image data with the clock signals reduced in the cyclic frequency are supplied to the source drivers, so that the source drivers operate to incorporate the two-system image data at the timings of at least one of the rising and falling edges of the clock signals.

In general, the image data comprise plural-system image data of "2J"-systems having the data rate "I/2" which is a half of the data rate "I" of the image data, where J is a positive integer. The clock signals have the cyclic frequency "I/4" which is equal to a quarter of the data rate "I" of the image data or equal to a half of the of the half data rate "I/2" of the plural-system image data of the "2J"-systems. The plural-system image data with the clock signals reduced in the cyclic frequency are supplied to the source drivers, so that the source drivers operate to incorporate the plural-system image data at the timings of at least one of the rising and falling edges of the clock signals. The single-system or plural-system clock signals with the reduced cyclic frequency are used and the necessary time margin can bc ensured, whereby the reduction of the electromagnetic interference and the ultra high definition liquid crystal display can be obtained.

In accordance with the second embodiment, the image data to be supplied to the source drivers comprise four system image data. The clock signals are used for providing the timings of the input of the image data into the source driver. The clock signals have a cyclic frequency which is equal to a half of the data rate of the four system image data. The clock signals with the reduced cyclic frequency is used and the necessary time margin can be ensured, whereby the reduction of the electromagnetic interference and the ultra high definition liquid crystal display can be obtained.

In this embodiment, the image data comprise four-system image data having the data rate which is a half of the data rate of the image data. The clock signals have the cyclic frequency which is equal to a quarter of the data rate of the image data or equal to a half of the of the half data rate of the four system image data. The four-system image data with the clock signals reduced in the cyclic frequency are supplied to the source drivers, so that the source drivers operate to incorporate the four-system image data at the timings of at least one of the rising and falling edges of the clock signals.

In general, the image data comprise plural-system image data of "4J"-systems having the data rate "I/2" which is a half of the data rate "I" of the image data, where J is a positive integer. The clock signals have the cyclic frequency "I/4" which is equal to a quarter of the data rate "I" of the image data or equal to a half of the of the half data rate "I/2" of the plural-system image data of the "4J"-systems. The plural-system image data with the clock signals reduced in the cyclic frequency are supplied to the source drivers, so that the source drivers operate to incorporate the plural-system image data at the timings of at least one of the rising and falling edges of the clock signals. The single-system or plural-system clock signals with the reduced cyclic frequency are used and the necessary time margin can be ensured, whereby the reduction of the electromagnetic interference and the ultra high definition liquid crystal display can be obtained.

In accordance with the third embodiment, the image data to be supplied to the source drivers comprise multiplexed four system image data. The clock signals are used for providing the timings of the input of the image data into the source driver. The clock signals have a cyclic frequency which is equal to a half of the data rate of the four system image data. The clock signals with the reduced cyclic frequency is used and the necessary time margin can be ensured, whereby the reduction of the electromagnetic interference and the ultra high definition liquid crystal display can be obtained. The process for multiplexing the image data to be supplied to the source drivers allows further time-compression.

In this embodiment, the image data comprise multiplexed four-system image data having the data rate which is a half of the data rate of the image data. The clock signals have the cyclic frequency which is equal to a quarter of the data rate of the image data or equal to a half of the of the half data rate of the four system image data. The four-system image data with the clock signals reduced in the cyclic frequency are supplied to the source drivers, so that the source drivers operate to incorporate the multiplexed four-system image data at the timings of at least one of the rising and falling edges of the clock signals.

In general, the image data comprise multiplexed plural-system image data of "4J"-systems having the data rate "I/2" which is a half of the data rate "I" of the image data, where J is a positive integer. The clock signals have the cyclic frequency "I/4" which is equal to a quarter of the data rate "I" of the image data or equal to a half of the of the half data rate "I/2" of the multiplexed plural-system image data of the "4J"-systems. The multiplexed plural-system image data with the clock signals reduced in the cyclic frequency are supplied to the source drivers, so that the source drivers operate to incorporate the multiplexed plural-system image data at the timings of at least one of the rising and falling edges of the clock signals. The single-system or plural-system clock signals with the reduced cyclic frequency are used and the necessary time margin can be ensured, whereby the reduction of the electromagnetic interference and the ultra high definition liquid crystal display can be obtained. The process for multiplexing the image data to be supplied to the source drivers allows further time-compression.

In accordance with the fourth embodiment, the image data to be supplied to the source drivers comprise multiplexed four system image data. The clock signals are used for providing the timings of the input of the image data into the source driver. The clock signals have a cyclic frequency which is equal to a half of the data rate of the four system image data. The clock signals with the reduced cyclic frequency is used and the necessary time margin can be ensured, whereby the reduction of the electromagnetic interference and the ultra high definition liquid crystal display can be obtained. The process for multiplexing the image data to be supplied to the source drivers allows further time-compression.

In this embodiment, the image data comprise multiplexed four-system image data having the data rate which is a half of the data rate of the image data. The clock signals have the cyclic frequency which is equal to a quarter of the data rate of the image data or equal to a half of the of the half data rate of the four system image data. The four-system image data with the clock signals reduced in the cyclic frequency are supplied to the source drivers, so that the source drivers operate to incorporate the multiplexed four-system image data at the timings of at least one of the rising and falling edges of the clock signals.

In general, the image data comprise multiplexed plural-system image data of "4J"-systems having the data rate "I/2" which is a half of the data rate "I" of the image data, where J is a positive integer. The clock signals have the cyclic frequency "I/4" which is equal to a quarter of the data rate "I" of the image data or equal to a half of the of the half data rate "I/2" of the multiplexed plural-system image data of the "4J"-systems. The multiplexed plural-system image data with the clock signals reduced in the cyclic frequency are supplied to the source drivers, so that the source drivers operate to incorporate the multiplexed plural-system image data at the timings of at least one of the rising and falling edges of the clock signals. The single-system or plural-system clock signals with the reduced cyclic frequency are used and the necessary time margin can be ensured, whereby the reduction of the electromagnetic interference and the ultra high definition liquid crystal display can be obtained. The process for multiplexing the image data to be supplied to the source drivers allows further tire-compression.

Although the invention has been described above in connection with several preferred embodiments therefor, it will be appreciated that those embodiments have been provided solely for illustrating the invention, and not in a limiting sense. Numerous modifications and substitutions of equivalent materials and techniques will be readily apparent to those skilled in the art after reading the present application, and all such modifications and substitutions are expressly understood to fall within the true scope and spirit of the appended claims.

What is claimed is:

1. A method of driving a liquid crystal display device having a plurality of bus lines for transmitting image data, said method comprising:

branching original image data having an original data rate into branched plural-systems image data comprising plural systems having a converted data rate that is equal to either said original data rate or a half of said original data rate;

supplying a source driver circuit with said branched plural-systems image data in synchronization with at least one clock signal having a clock frequency that is less than half of said original data rate; and allowing said source driver circuit to further branch said branched plural-systems image data into gray-scale voltage signals.

2. The method as claimed in claim 1, wherein a number of said systems of said branched plural-systems image data is 2J, and wherein J is a positive integer number.

3. The method as claimed in claim 1, wherein a number of said systems of said branched plural-systems image data is 4J, and wherein J is a positive integer number.

4. The method as claimed in claim 1, wherein said converted data rate is equal to said original data rate.

5. The method as claimed in claim 1, wherein said converted data rate is equal to a half of said original data rate.

6. The method as claimed in claim 1, wherein said at least one clock signal comprises two clock signals different in phase by a half cycle from each other, and wherein rising edges of said two clock signals serve as triggers to input said branched plural-systems image data into said source driver circuit.

7. The method as claimed in claim 1, wherein said at least one clock signal comprises two clock signals different in phase by a half cycle from each other, and wherein falling edges of said two clock signals serve as triggers to input said branched plural-systems image data into said source driver circuit.

8. The method as claimed in claim 1, wherein said at least one clock signal comprises a single clock signal, and wherein both rising edges and falling edges of said single clock signal serve as triggers to input said branched plural-systems image data into said source driver circuit.

9. A circuitry for driving a liquid crystal display device, said circuitry comprising:

a timing controller for generating image data and at least one clock signal;

a plurality of data bus lines for transmitting said image data and at least one clock signal; and a plurality of source driver circuits for incorporating said image data in synchronization with said at least one clock signal and converting said image data into gray-scale voltage signals;

wherein said timing controller comprises:

a branching unit for branching original image data having an original data rate into branched plural-systems image data comprising plural systems having a converted data rate that is equal to either said original data rate or a half of said original data rate.

10. The circuitry as claimed in claim 9, wherein a number of said systems of said branched plural-systems image data is 2J, and wherein J is a positive integer number.

11. The circuitry as claimed in claim 9, wherein a number of said systems of said branched plural-systems image data is 4J, and wherein J is a positive integer number.

12. The circuitry as claimed in claim 9, wherein said converted data rate is equal to said original data rate.

13. The circuitry as claimed in claim 9, wherein said converted data rate is equal to a half of said original data rate.

14. The circuitry as claimed in claim 9, wherein said at least one clock signal comprises two clock signals different in phase by a half cycle from each other, and wherein rising edges of said two clock signals serve as triggers to input said image data into said source driver circuits.

15. The circuitry as claimed in claim 9, wherein said at least one clock signal comprises two clock signals different in phase by a half cycle from each other, and wherein falling edges of said two clock signals serve as triggers to input said image data into said source driver circuits.

16. The circuitry as claimed in claim 9, wherein said at least one clock signal comprises a single clock signal, and wherein both rising edges and falling edges of said single clock signal serve as triggers to input said image data into said source driver circuits.

17. The circuitry as claimed in claim 9, wherein said timing controller further comprises:

a data polarity inversion determination unit for verifying whether or not a majority of bits of said branched plural-systems image data is changed in polarity; and a data polarity inversion unit for inverting all bits of said branched plural-systems image data in polarity if it is verified that said majority of bits of said branched plural-systems image data is changed in polarity.

18. The circuitry as claimed in claim 17, wherein plural pairs of said data polarity inversion determination unit and said data polarity inversion unit are provided, and wherein a number of said pairs is the same as a number of said systems of said branched plural-systems image data.

19. The circuitry as claimed in claim 17, wherein said data polarity inversion determination unit comprises:

a polarity change detecting circuit for detecting polarity change in bit units of said polarity-inverted image data from said branched plural-systems image data; and a majority determination circuit for determining whether or not said majority of bits of said polarity-inverted image data is different in polarity from said branched plural-systems image data.

20. The circuitry as claimed in claim 9, wherein said timing controller further comprises:

a first latch circuit for latching said branched plural-systems image data in synchronization with said at least one clock signal and for outputting said branched plural-systems image data as first output data;

a first data polarity inversion determination circuit for inverting all bits of said branched plural-systems image data in polarity if a first polarity inversion signal has a predetermined level indicating polarity inversion, and for outputting polarity-inverted image data;

a second data polarity inversion determination circuit for comparing said polarity-inverted image data and said branched plural-systems image data to verify whether or not a majority of bits of said polarity-inverted image data is different in polarity from said branched plural-systems image data, and for outputting a second polarity inversion signal that has a predetermined level indicating polarity inversion if said majority of bits of said polarity-inverted image data is different in polarity from said branched plural-systems image data; and a second latch circuit for latching said second polarity inversion signal in synchronization with said at least one clock signal and for supplying said first polarity inversion signal to said first data polarity inversion determination circuit.

21. The circuitry as claimed in claim 20, wherein said timing controller further comprises:

a third latch circuit for latching said polarity-inverted image data in synchronization with said at least one clock signal and for supplying said polarity-inverted image data to said source driver circuits; and a fourth latch circuit for latching said first polarity inversion signal in synchronization with said at least one clock signal and for supplying said first polarity inversion signal to said source driver circuits.

22. The circuitry as claimed in claim 21, wherein plural sets of said first and second data polarity inversion determination circuits and said first to fourth latch circuits are provided, and wherein a number of said sets is the same as a number of said systems of said branched plural-systems image data.

23. The circuitry as claimed in claim 20, wherein said second data polarity inversion determination circuit comprises:

a polarity change detecting circuit for detecting polarity change in bit units of said polarity-inverted image data from said branched plural-systems image data; and a majority determination circuit for determining whether or not said majority of bits of said polarity-inverted image data is different in polarity from said branched plural-systems image data.

24. The method as claimed in claim 1, wherein the at least one clock signal has a clock frequency that is a quarter of said original data rate.

* * * * *

UNITED STATES PATENT AND TRADEMARK OFFICE

CERTIFICATE OF CORRECTION

PATENT NO. : 7,227,522 B2
APPLICATION NO. : 10/026688
DATED : June 5, 2007
INVENTOR(S) : Kazushi Fujimoto It is certified that error appears in the above-identified patent and that said Letters Patent is hereby corrected as shown below:

Col. 9, line 67, delete "BU" and insert --BUS--.

Col. 19, line 16, delete "31 A" and insert --31A--.

Col. 24, line 56, delete "SC" and insert --5C--.

Signed and Sealed this

Twenty-third Day of September, 2008

JON W. DUDAS
*Director of the United States Patent and Trademark Office*